US005258271A

United States Patent [19]

Haijima et al.

[11] Patent Number: 5,258,271

[45] Date of Patent: Nov. 2, 1993

[54] SILVER HALIDE COLOR PHOTOGRAPHIC MATERIAL

[75] Inventors: Akimitsu Haijima; Yasuhiro Yoshioka, both of Minami-ashigara, Japan

[73] Assignee: Fuji Photo Film Co., Ltd., Kanagawa, Japan

[21] Appl. No.: 945,928

[22] Filed: Sep. 17, 1992

[30] Foreign Application Priority Data

Sep. 17, 1991 [JP] Japan ..... 3-265329

[51] Int. Cl.[5] ..... G03C 1/46

[52] U.S. Cl. ..... 430/503; 430/557; 430/957; 430/507; 430/517; 430/522

[58] Field of Search ..... 430/507, 522, 557, 957, 430/517, 503

[56] References Cited

U.S. PATENT DOCUMENTS 5,075,205 12/1991 Inagaki et al. ..... 430/522

5,108,883 4/1992 Matejec et al. ..... 430/522

FOREIGN PATENT DOCUMENTS 1451000 5/1974 United Kingdom .

*Primary Examiner*—Charles L. Bowers, Jr.

*Assistant Examiner*—Geraldine Letscher

*Attorney, Agent, or Firm*—Birch, Stewart, Kolasch & Birch

[57] ABSTRACT

There is disclosed a silver halide color photographic material having a photosensitive silver halide emulsion layer on a support, which comprises, in said photosensitive silver halide emulsion layer, a coupler selected from the group consisting of yellow dye-forming couplers represented by formulas (Y-I) to (Y-III), as defined in claim 1, and a quenching coupler selected from the group consisting of cyan dye-forming couplers or magenta dye-forming couplers represented by formula (C-I), (C-II), (C-III), (M), or (m), as defined in claim 1, or a quenching dye obtained by a coupling reaction of above couplers with the oxidized product of a developing agent represented by formula (A) as defined in claim 2.

21 Claims, No Drawings

SILVER HALIDE COLOR PHOTOGRAPHIC MATERIAL

FIELD OF THE INVENTION

The present invention relates to silver halide color photographic materials, and more particularly to color photographic materials remarkably improved in image fastness under dark storage and under light irradiation.

BACKGROUND OF THE INVENTION

Generally, a silver halide color photographic material comprises at least three layers, i.e., a blue-sensitive layer, a green-sensitive layer, and a red-sensitive layer, which respectively contain a yellow dye-forming coupler, a magenta dye-forming coupler, and a cyan dye-forming coupler.

As yellow couplers out of these couplers, acylacetanilide couplers or malondianilide couplers represented respectively by benzoylacetanilide couplers and pivaloylacetanilide couplers are, widely known. Although benzoylacetanilide couplers are generally high in coupling activity with an aromatic primary amine developing agent at the time of development and are high in the molecular extinction coefficient of the yellow dye produced therefrom, they are defective in that the color image fastness under dark storage is low. Although pivaloylacetanilide couplers are excellent in color image fastness, since the coupling reactivity at the time of development is low and the molecular extinction coefficient is small, a large amount of the color-forming coupler has to be used to obtain a satisfactory color image density, and therefore they are disadvantageous in view of image quality and cost.

Therefore, the development of yellow couplers having merits of both of them, that is, high color-forming properties (a high coupling activity of the coupler and a high molecular extinction coefficient of the dye formed therefrom) and color image fastness, is desired.

From the above point of view, the acyl group of acylacetamide series yellow couplers has been studied. For example, U.S. Pat. Re. No. 27,848 discloses couplers having, as a modification of a pivaloyl group, a 7,7-dimethylnorbornane-1-carbonyl group or a 1-methylcyclohexane-1-carbonyl group. However these couplers are low in coupling activity and small in the molecular extinction coefficient of the dye produced therefrom. Further, JP-A ("JP-A" means unexamined published Japanese patent application) No. 26133/1972 discloses couplers having a cyclopropane-1-carbonyl group or a cyclohexane-1-carbonyl group. However these couplers are not satisfactory because the fastness of the dye produced therefrom is low.

On the other hand, as malondianilide couplers, couplers described, for example, in U.S. Pat. Nos. 4,149,886, 4,095,984, and 4,477,563 or British Patent No. 1,204,680 are known. However, these couplers are not free from a problem because the image fastness, in particular the heat-and-humidity fastness, is low.

Apart from attempts to improve the performance of couplers themselves as stated above, the development of a technique of improving color-forming properties or color image fastness is under way.

For example, it is known that when, to a first organic compound (base dye) having a maximum wavelength absorption peak (λ max) at 590 nm or lower, a second organic compound (quenching dye) having a λ max at 530 nm or higher is added, the light fastness of the base dye is improved, as described in JP-A No. 17228/1975. In examples in that publication, as base dyes, magenta dyes produced from 5-pyrazolone magenta couplers are mainly dealt with, and as yellow dyes only two dyes produced from benzoyl-type yellow couplers are mentioned.

Hereinafter a coupler that can produce a base dye is referred to as a base coupler, and a coupler that can produce a quenching dye is referred to as a quenching coupler.

When as a base coupler a benzoyl-type yellow coupler is chosen, the light fastness of the yellow dye formed after adding a quenching coupler followed by processing is improved fairly in comparison with the case wherein the quenching coupler is not added, but the fastness under dark storage remains inadequate and is unsatisfactory.

On the other hand, concerning photographic materials containing a yellow coupler and a coupler having a λ max which is on the longer side of that of the yellow coupler, for example U.S. Pat. No. 4,806,459 and JP-A Nos. 293545/1988 and 145656/1989 are known. However, although these photographic materials are improved in color reproduction, the fastness is inadequate and is required to be improved.

SUMMARY OF THE INVENTION

The object of the present invention is to provide a color photographic material excellent in color image fastness as a whole by developing a novel yellow dye-forming coupler high in color-forming properties and excellent in dye fastness under dark storage, and also by developing a technique of improving dye image fastness under light irradiation.

Other and further objects, features, and advantages of the invention will be appear more fully from the following description.

DETAILED DESCRIPTION OF THE INVENTION

The above object has been solved by the following invention.

That is, the above object of the present invention has been attained by a silver halide color photographic material having at least one photosensitive silver halide emulsion layer on a support, which comprises, in said photosensitive silver halide emulsion layer, at least one coupler selected from the group consisting of acylacetamide series yellow dye-forming couplers represented by the following formula (Y-I) and yellow dye-forming couplers represented by the following formula (Y-II) or (Y-III); and at least one coupler selected from the group consisting of dye-forming couplers represented by the following formula (C-I), (C-II), (C-III), (M), or (m):

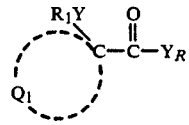

formula (Y-I)

wherein $R_1{}^Y$ represents a monovalent group, $Q_1$ represents a group of non-metallic atoms to form together with the C (carbon atom) a substituted or unsubstituted 3-to 5-membered hydrocarbon ring or a substituted or unsubstituted 3- to 5-membered heterocyclic ring moiety having in the moiety at least one heteroatom selected from the group consisting of N, S, O, and P, and $Y_R$ represents a residue remaining after removing the acyl group

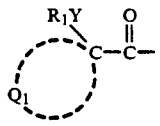

at the α position of the acetamide moiety from the acylacetamide yellow dye-forming coupler represented by formula (Y-I), provided that $R_1^Y$ is not a hydrogen atom and does not bond to $Q_1$ to form a ring, formula (Y-II)

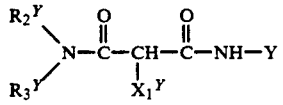

wherein $R_2^Y$ and $R_3^Y$ each represent an alkyl group, an aryl group, or a heterocyclic group, Y represents an aryl group or a heterocyclic group, and $X_1^Y$ represents a hydrogen atom or a group capable of being released upon a coupling reaction of the coupler represented by the formula with the oxidized product of an aromatic primary amine developing agent (hereinafter referred to as a coupling releasing group), formula (Y-III)

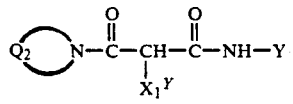

wherein $Q_2$ represents an organic residue to form a nitrogen-containing heterocyclic group together with >N— and Y and $X_1^Y$ have the same meanings as those of Y and $X_1^Y$ of formula (Y-II), formula (C-I)

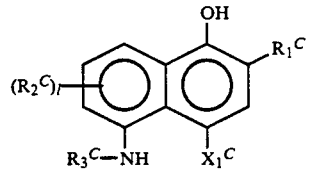

wherein $R_1^C$ represents $—CONR_4^CR_5^C$, $—SO_2NR_4^CR_5^C$, $—NHCOR_4^C$, $—NHCOOR_6^C$, $—NHSO_2R_6^C$, $—NHCONR_4^CR_5^C$, or $—NHSO_2NR_4^CR_5^C$, $R_2^C$ represents a group capable substituting on a naphthalene group, l is an integer of 0 to 3, $R_3^C$ represents a substituent, $X_1^C$ represents a hydrogen atom or a coupling releasing group, $R_4^C$ and $R_5^C$, which may be the same or different, each independently represent a hydrogen atom, an alkyl group, an aryl group, or a heterocyclic group, $R_6^C$ represents an alkyl group, an aryl group, or a heterocyclic group, when l is 2 or 3, the $R_2^C$ groups may be the same or different and may bond together to form a ring, $R_2^C$ and $R_3^C$ or $R_3^C$ and $X_1^C$ may bond together to form a ring, and the compound may form a dimer or more higher polymer by linking through a bivalent group or more higher polyvalent group at $R_1^C$, $R_2^C$, $R_3^C$, or $X_1^C$, formula (C-II)

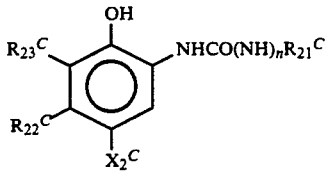

formula (C-III)

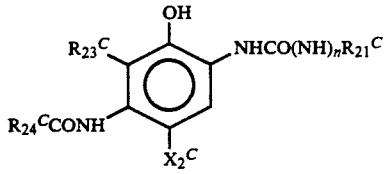

wherein $R_{21}^C$ represents an alkyl group, an aryl group, or a heterocyclic group, $R_{22}^C$ represents an alkyl group, $R_{23}^C$ represents a hydrogen atom, a halogen atom, an alkyl group, an aryl group, an alkoxy group, an aryloxy group, a carbonamido group, or a ureido group, $R_{24}^C$ represents an alkyl group, an aryl group, an alkoxy group, a heterocyclic group, an aryloxy group, or an amino group, $X_2^C$ represents a hydrogen atom or a coupling releasing group, and n is 0 or 1, formula (M)

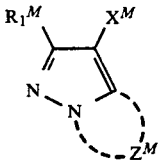

wherein $R_1^M$ represents a hydrogen atom or a substituent, $Z^M$ represents a group of non-metallic atoms to form a 5-membered azole ring containing 2 to 4 nitrogen atoms which may have a substituent (including a condensed ring), and $X^M$ represents a hydrogen atom or a coupling releasing group, formula (m)

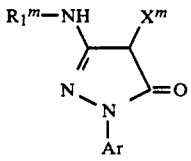

wherein $R_1^m$ represents an alkyl group, an aryl group, an acyl group, or a carbamoyl group, Ar represents a phenyl group or a phenyl group substituted by one or more halogen atoms or alkyl, cyano, alkoxy, alkoxycarbonyl, or acylamino groups, and $X^m$ represents a hydrogen atom or a coupling releasing group.

The object of the present invention also has been solved by the following second invention.

That is, the above object of the present invention has been attained by a silver halide color photographic material having at least one photosensitive silver halide emulsion layer on a support, which comprises, in said silver halide emulsion layer, at least one coupler selected from the group consisting of yellow dye forming couplers represented by formulae (Y-I) to (Y-III) as stated above and at least one dye selected from the group consisting of dyes formed by the coupling reaction of dye-forming couplers represented by formula (C-I), (C-II), (C-III), (M), or (m), as stated above, with the oxidized product of a developing agent represented by the following formula (A):

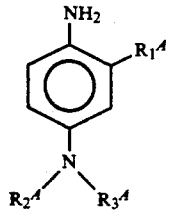

formula (A)

wherein $R_1^A$ represents a hydrogen atom or an alkyl group and $R_2^A$ and $R_3^A$, which may be the same or different, each represent a hydrogen atom, an alkyl group, an aryl group, or a heterocyclic group.

The acylacetamide yellow couplers of the present invention are preferably represented by the following formula (Y-IV):

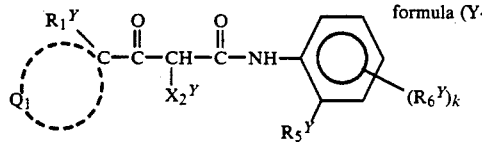

formula (Y-IV)

In formula (Y-IV), $R_1^Y$ represents a monovalent substituent other than hydrogen; $Q_1$ represents a group of non-metallic atoms to form together with the C a substituted or unsubstituted 3- to 5-membered cyclic hydrocarbon ring or a substituted or unsubstituted 3- to 5-membered heterocyclic ring moiety that has in the group at least one heteroatom selected from a group consisting of N, O, S, and P; $R_5^Y$ represents a hydrogen atom, a halogen atom (e.g., F, Cl, Br, and I, which is applied hereinafter to the description of formula (Y-IV)), an alkoxy group, an aryloxy group, an alkyl group, or an amino group, $R_6^Y$ represents a group capable of substitution onto a benzene ring, $X_2^Y$ represents a halogen atom or a coupling releasing group, k is an integer of 0 to 4, and when k is 2 or more, the $R_6^Y$ groups may be the same or different.

In formula (Y-I), $Y_R$ represents a residue remaining after removing the acyl group

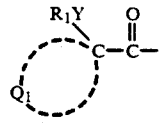

from the acylacetamide yellow dye-forming coupler from the acylacetamide yellow dye-forming coupler represented by formula (Y-I).. In other words, $Y_R$ represents the remaining portion of formula (Y-I) that does not correspond to the acyl group referred to above. Preferably $Y_R$ represents the following residue as shown in formula (Y-IV)

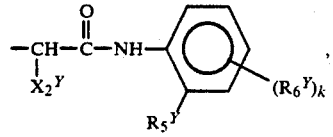

wherein the substituents are as defined in formula (Y-IV). $Y_R$ may also be represented by the corresponding residues as shown in publications.

When any of the substituents in formula (Y-IV) is an alkyl group or contains an alkyl group, unless otherwise specified, the alkyl group means a straight chain, branched-chain, or cyclic alkyl group, which may be substituted and/or unsaturated.

When any of the substituents in formula (Y-IV) is an aryl group or contains an aryl group, unless otherwise specified, the aryl group means a monocyclic or condensed cyclic aryl group, which may be substituted.

When any of the substituents in formula (Y-IV) is a heterocyclic group or contains a heterocyclic group, unless otherwise specified, the heterocyclic group means a 3- to 8-membered monocyclic or condensed ring heterocyclic group that contains at least one heteroatom selected from the group consisting of O, N, S, P, Se and Te.

Substituents preferably used in formula (Y-IV) will now be described below.

In formula (Y-IV), preferably $R_1^Y$ represents a halogen atom, a cyano group, a monovalent aliphatic-type group that may be substituted and has a total number of carbon atoms (hereinafter abbreviated as a C-number) of 1 to 30 (e.g., alkyl and alkoxy) or a monovalent aryl-type group that may be substituted and has a C-number of 6 to 30 (e.g., aryl and aryloxy), whose substituent includes, for example, a halogen atom, an alkyl group (straight, branched, or cyclic), an alkoxy group, a nitro group, an amino group, a carbonamido group, a sulfonamido group, and an acyl group.

In formula (Y-IV), $Q_1$ preferably represents a group of non-metallic atoms which forms together with the C, a substituted or unsubstituted 3- to 5-membered hydrocarbon ring having a C-number of 3 to 30, or a substituted or unsubstituted 2- to 5-membered heterocyclic ring moiety having a C-number of 2 to 30 and in the ring at least one heteroatom selected from a group consisting of N, S, O, and P. The ring formed by $Q_1$ together with the C may have an unsubstituted bond in the ring. As examples of the ring formed by $Q_1$ together with the C are a cyclopropane ring, a cyclobutane ring, a cyclopentane ring, a cyclopropene ring, a cyclobutene ring, a cyclopentene ring, an oxetane ring, an oxolane ring, a 1,3-dioxolane ring, a thiethane ring, a thiolane ring, and a pyrrolidine ring. Examples of substituent for the rings include a halogen atom, a hydroxyl group, an alkyl group, an aryl group, an acyl group, an alkoxy group, an aryloxy group, a cyano group, an alkoxycarbonyl group, an alkylthio group, and an arylthio group.

In formula (Y-IV), $R_5^Y$ preferably represents a halogen atom, an alkoxy group that may be substituted and has a C-number of 1 to 30, an aryloxy group that may be substituted and has a C-number of 6 to 30, an alkyl group that may be substituted and has a C-number of 1 to 30, or a amino group that may be substituted and has a C-number of 0 to 30, and the substituent is, for example, a halogen atom, an alkyl group, an alkoxy group, or an aryloxy group.

Examples of $R_6^Y$ in formula (Y-IV) include a halogen atom, an alkyl group (as defined above), an aryl group (as defined above), an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, a arylsulfonyl group, a ureido group, a sulfamoylamino group, an alkoxycarbonylamino group, an alkoxysulfonyl group, an acyloxy group, a nitro group, a heterocyclic group (as defined above), a cyano group, an acyl group, an amino group, an imido group, an alkylsulfonyloxy group, and an arylsulfonyloxy group (hereinafter these are referred to as substituent group A); and examples of the coupling releasing group include a heterocyclic group (as defined above) bonded to the coupling active site through the nitrogen atom, an aryloxy group, an arylthio group, an acyloxy group, an alkylsulfonyloxy group, an arylsulfonyloxy group, a heterocyclic oxy group (wherein heterocyclic is as defined above), and a halogen atom.

In formula (Y), $R_6^Y$ preferably represents a halogen atom, an alkyl group that has a C-number of 1 to 30, more preferably 1 to 18, an aryl group that has a C-number of 6 to 30, more preferably 6 to 24, an alkoxy group that has a C-number of 1 to 30, more preferably 1 to 18, an aryloxy group that has a C-number of 6 to 30, more preferably 6 to 24, an alkoxycarbonyl group that has a C-number of 2 to 30, more preferably 2 to 19, an aryloxycarbonyl group that has a C-number of 7 to 30, more preferably 7 to 24, a carbonamido group that has a C-number of 1 to 30, more preferably 1 to 20, a sulfonamido group that has a C-number of 1 to 30, more preferably 1 to 24, a carbamoyl group that has a C-number of 1 to 30, more preferably 1 to 20, a sulfamoyl group that a C-number of 0 to 30, more preferably 0 to 24, an alkylsulfonyl group that has a C-number of 1 to 30, more preferably 1 to 20, an arylsulfonyl group that has a C-number of 6 to 30, more preferably 6 to 24, an ureido group that has a C-number of 1 to 30, more preferably 1 to 20, a sulfamoylamino group that has a C-number of 0 to 30, more preferably 0 to 20, an alkoxycarbonylamino group that has a C-number of 2 to 30, more preferably 2 to 20, a heterocyclic group (as defined above) that has a C-number of 1 to 30, more preferably 1 to 20, an acyl group that has a C-number of 1 to 30, more preferably 1 to 20, an alkylsulfonyloxy group that has a C-number of 1 to 30, more preferably 1 to 20, or an arylsulfonyloxy group that has a total C-number of 6 to 30, more preferably 6 to 24, any of which may be substituted (except hydrogen); and examples of substituent for these $R_6^Y$ moieties include, for example, substituents selected from above-mentioned substituent group A.

In formula (Y-IV), k is preferably an integer of 1 or 2, and the position of the substitution of $R_6^Y$ is preferably the meta-position or para-position relative to

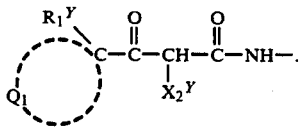

In formula (Y-IV), $X_2^Y$ preferably represents a heterocyclic group bonded to the coupling active site through the nitrogen atom or an aryloxy group.

When $X_2^Y$ represents a heterocyclic group, $X_2^Y$ is preferably a 5- to 7-membered monocyclic ring moiety or condensed ring moiety that may be substituted. Exemplary of such groups are succinimido, maleinimido, phthalimido, diglycolimido, pyrrole, pyrazole, imidazole, 1,2,4-triazole, tetrazole, indole, indazole, benzimidazole, benzotriazole, imidazolidine-2,4-dione, oxazolidine-2,4-dione, thiazolidine-2,4-dione, imidazolidine-2-one, oxazolidine-2-one, thiazolidine-2-one, benzimidazolidine-2-one, benzoxazolidine-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone-2-pyrazone, 2-amino-1,3,4-thiazolidine, 2-imino-1,3,4-thiazolidine-4-one, and the like, any of which heterocyclic rings may be substituted. Examples of the substituent on the heterocyclic group include substituents selected from the above-mentioned substituent group A. When $X_2^Y$ represents an aryloxy group, preferably $X_2^Y$ represents an aryloxy group having a C-number of 6 to 30, which may be substituted by a group selected from the group consisting of those substituents mentioned in the case wherein $X_2^Y$ represents a heterocyclic group. Preferably, the substituent on the aryloxy group is a halogen atom, a cyano group, a nitro group, a carboxyl group, a trifluoromethyl group, an alkoxycarbonyl group, a carbonamido group, a sulfonamido group, a carbamoyl group, a sulfamoyl group, an alkylsulfonyl group, an arylsulfonyl group, or a cyano group.

Substituents which are particularly preferably used in formula (Y-IV) will now be described.

$R_1^Y$ is particularly preferably a halogen atom or an alkyl group having a C-number of 1 to 5, most preferably methyl, ethyl, and n-propyl. $Q_1$ particularly preferably represents a group of non-metallic atoms which form together with the C a 3- to 5-membered cyclic hydrocarbon ring such as $-[C(R)_2]_2-$, $-[C(R)_2]_3-$, and $-[C(R)_2]_4-$ wherein R represents a hydrogen atom, a halogen atom, an alkyl group, provided that the R or $C(R)_2$ groups may be the same or different.

Most preferably $Q_1$ represents $-[C(R)_2]_2-$ which forms a 3-membered ring together with the C bonded thereto.

Particularly preferably $R_5^Y$ represents a chlorine atom, a fluorine atom, an alkyl group having a C-number of 1 to 6 (e.g., methyl, trifluoromethyl, ethyl, isopropyl, and t-butyl), an alkoxy group having a C-number of 1 to 8 (e.g., methoxy, ethoxy, methoxyethoxy, and butoxy), or an aryloxy group having a C-number of 6 to 24 (e.g , phenoxy, p-tolyloxy, and p-methoxyphenoxy); most preferably a chlorine atom, a methoxy group, or a trifluoromethyl group.

Particularly preferably $R_6^Y$ represents a halogen atom, an alkoxy group, an alkoxycarbonyl group, an aryloxycarbonyl group, a carbonamido group, a sulfonamido group, a carbamoyl group, or a sulfamoyl group, most preferably an alkoxy group, an alkoxycarbonyl group, a carbonamido group, or a sulfonamido group.

Particularly preferably $X_2^Y$ is a 5-membered heterocyclic ring moiety bonded to a coupling active site through a nitrogen atom (e.g., imidazolidine-2,4-dione-3-yl and oxazolidine-2,4-dione-3-yl) or an aryloxy group, most preferably imidazilidine-2,4-dione-3-yl group.

The coupler represented by formula (Y-IV) may form a dimer or higher polymer formed by bonding through a divalent group or higher polyvalent group at the substituent $R_1^Y$, $Q_1$, $X_2^Y$, or

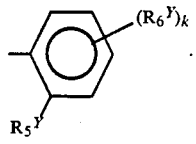

In this case, the total C-number may exceed the range of the total C-number specified in each of the above substituents.

Specific examples of each of the substituents in formula (Y-IV) are shown below.

(1) Examples of the

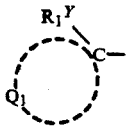

group formed by $R_1^Y$ and $Q_1$ with C are shown below.

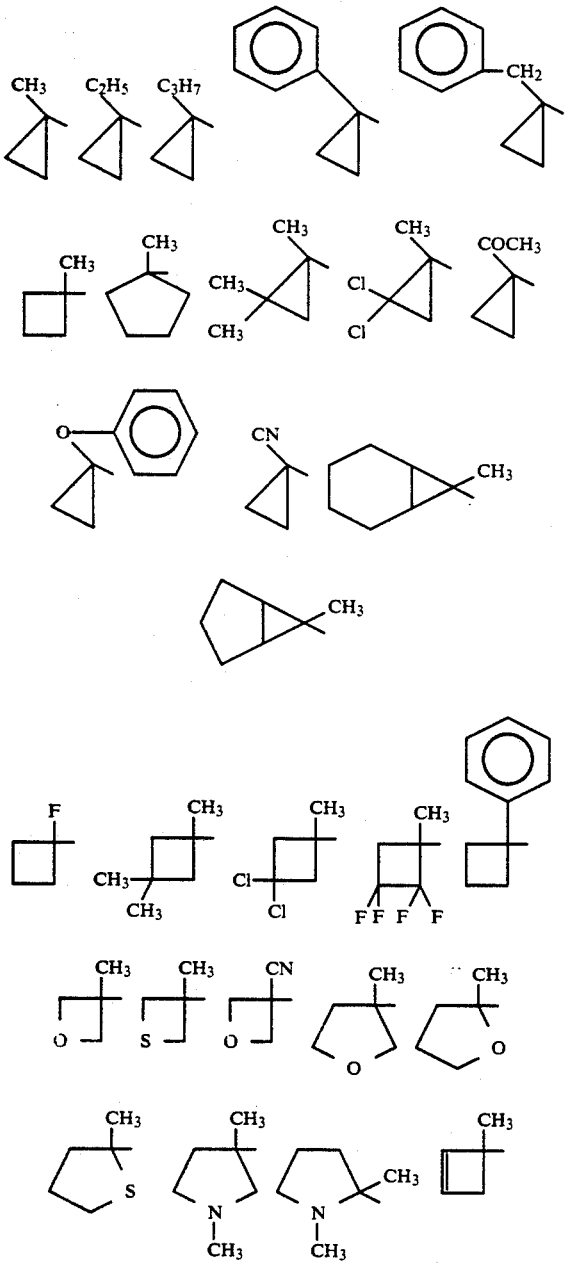

-continued

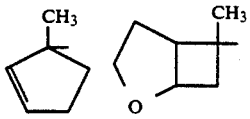

(2) Examples of $R_5^Y$

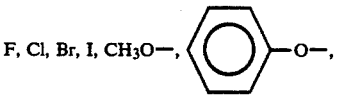

F, Cl, Br, I, $CH_3O$—,

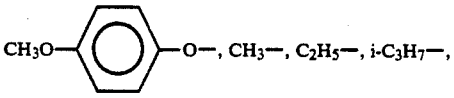

$CH_3O$—, $CH_3$—, $C_2H_5$—, i-$C_3H_7$—, t-$C_4H_9$—, $CH_3OCH_2CH_2O$—, $CF_3$—, $(CH_3)_2N$—,

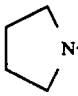

N— n-$C_4H_9O$—, n-$C_{14}H_{29}O$—, n-$C_{16}H_{33}O$—,

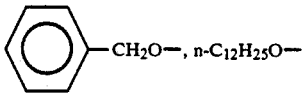

$CH_2O$—, n-$C_{12}H_{25}O$—

(3) Examples of $R_6^Y$

— F Cl Br I —$OCH_3$ —$OC_{12}H_{25}$ $OC_{16}H_{33}$

—$COOCH_3$ —$COOC_{12}H_{25}$ —$COOCH(CH_3)COOC_{12}H_{25}$

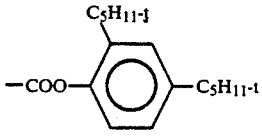

—COO— $C_5H_{11}$-t

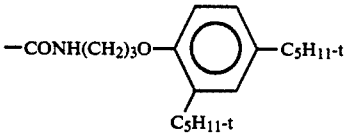

—$CONH(CH_2)_3O$— $C_5H_{11}$-t

—$SO_2NH(CH_2)_3OC_{12}H_{25}$ —$SO_2N(C_8H_{17})_2$ —$SO_2N(CH_3)_2$

—$SO_2NHCOC_2H_5$ —$NHCOC_{13}H_{27}$ —$NHCOCH(C_6H_{13})C_8H_{17}$

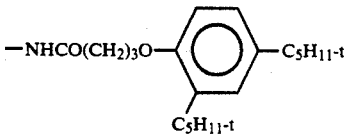

—$NHCO(CH_2)_3O$— $C_5H_{11}$-t

-continued
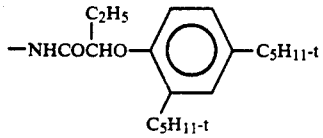
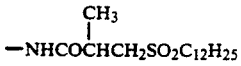
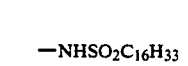
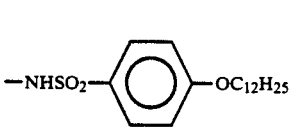
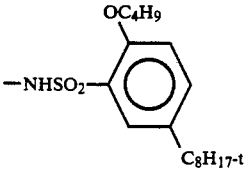
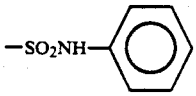
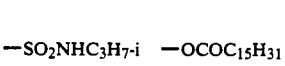
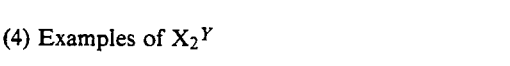
(4) Examples of $X_2^Y$
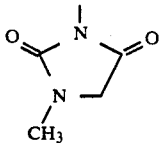
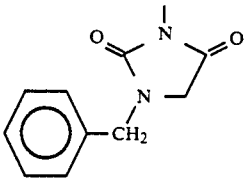
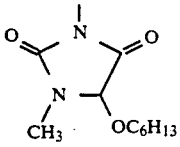
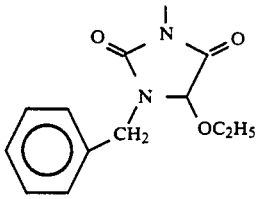
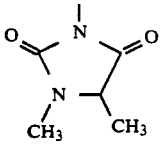
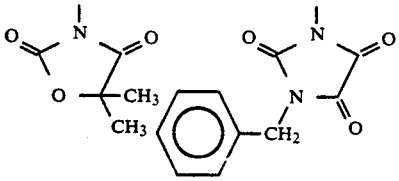
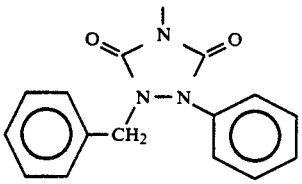
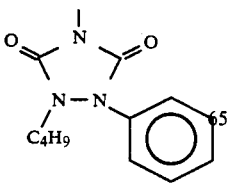
-continued
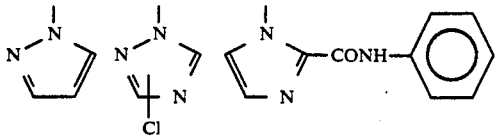
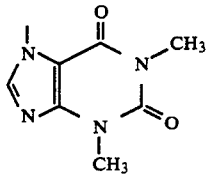
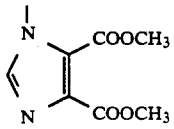
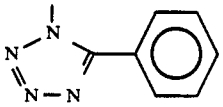
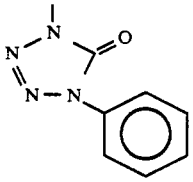
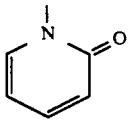
H Cl Br I —OCOCH$_3$ —OSO$_2$CH$_3$
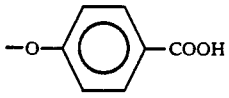
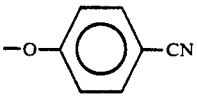
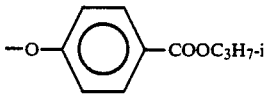
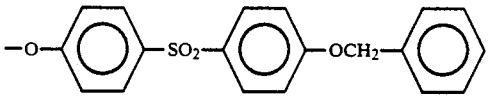
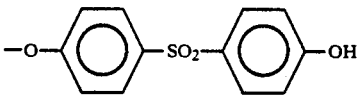
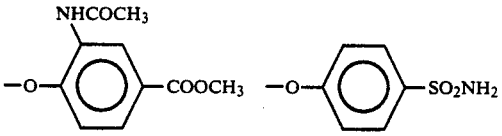
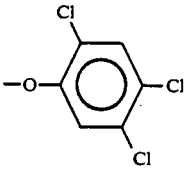

-continued
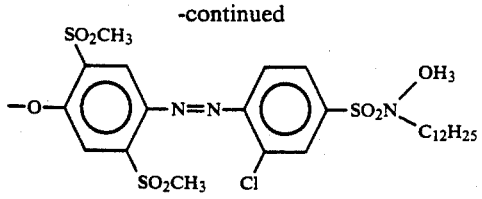
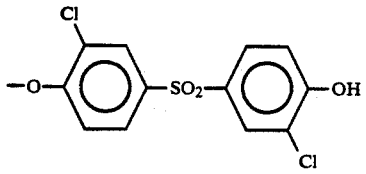
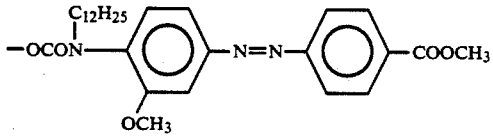
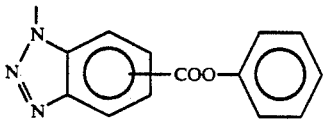
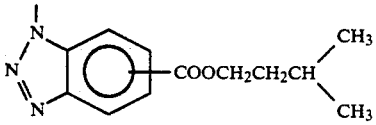
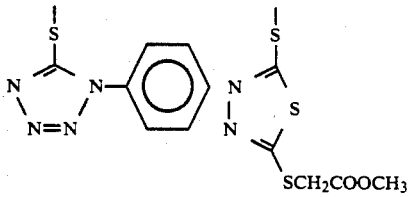
-continued
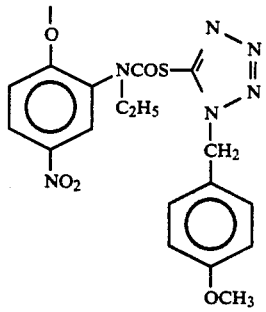
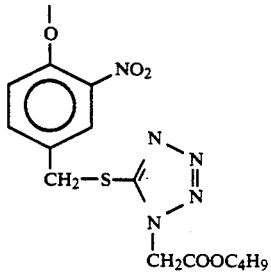
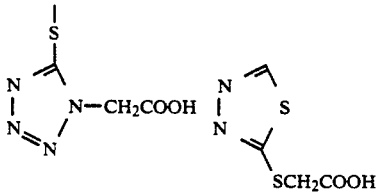
Exemplified yellow couplers represented by formula (Y-IV) are shown below.
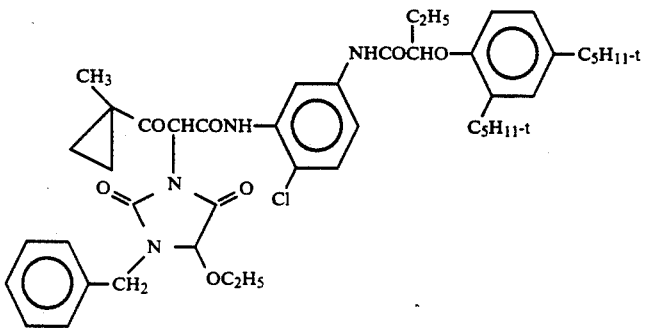
$Y_1$-1

-continued
$Y_1$-2
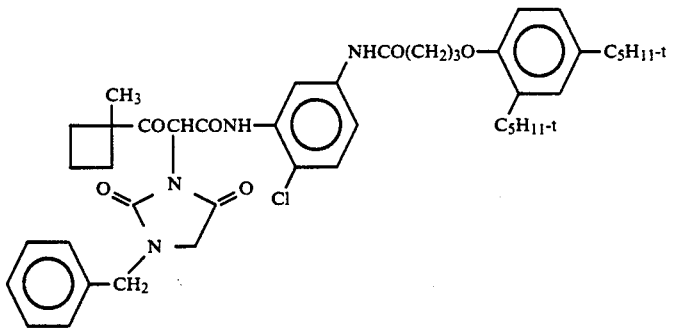
$Y_1$-3
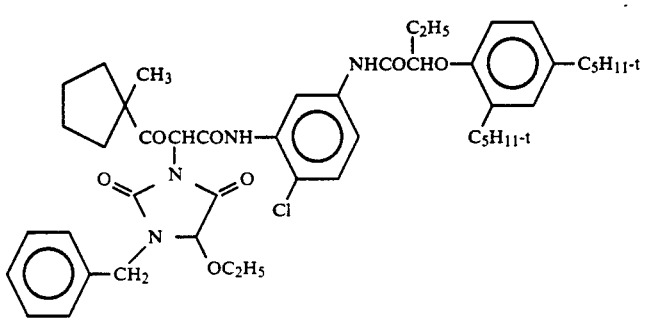
$Y_1$-4
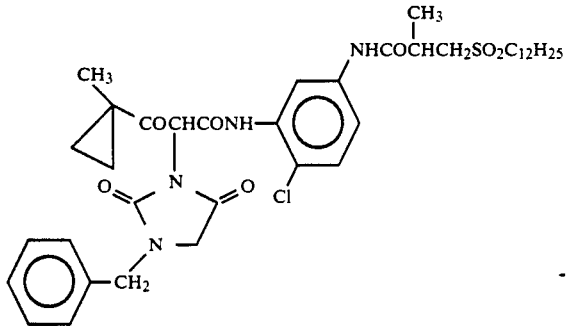
$Y_1$-5
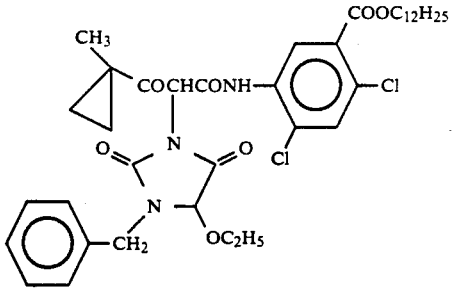
$Y_1$-6
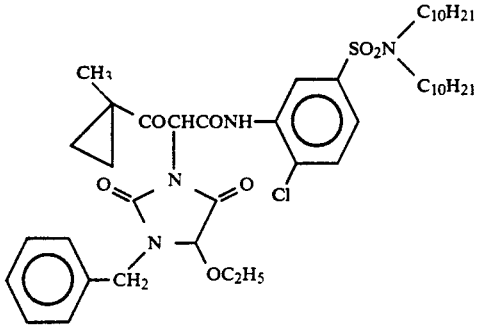

-continued
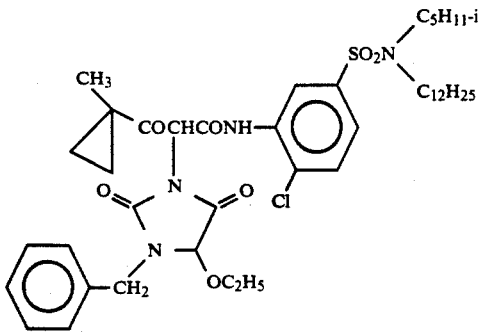
$Y_1$-7
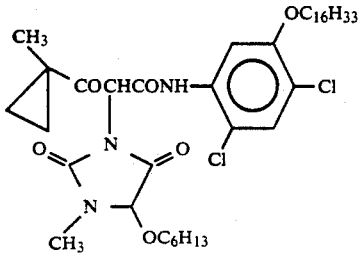
$Y_1$-8
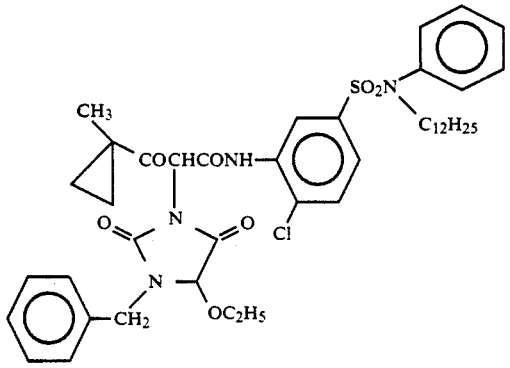
$Y_1$-9
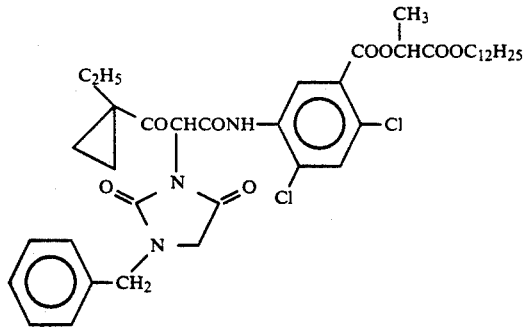
$Y_1$-10
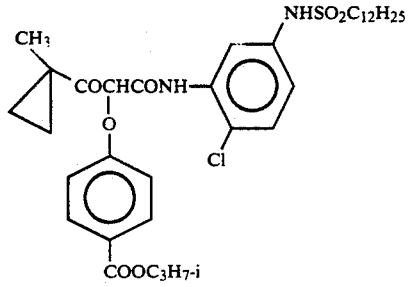
$Y_1$-11

-continued
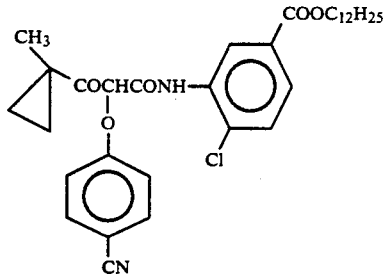
Y1-12
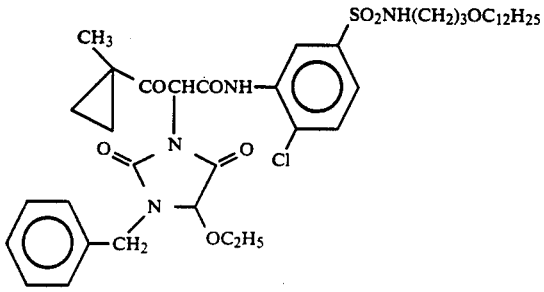
Y1-13
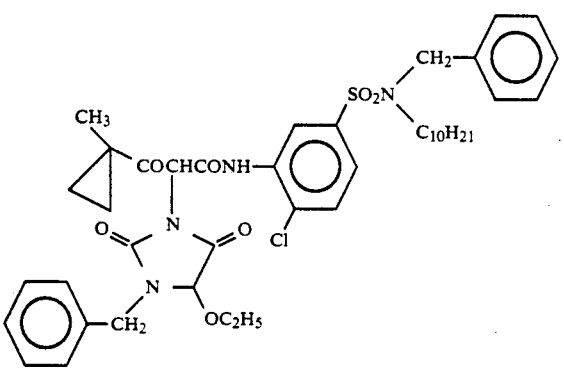
Y1-14
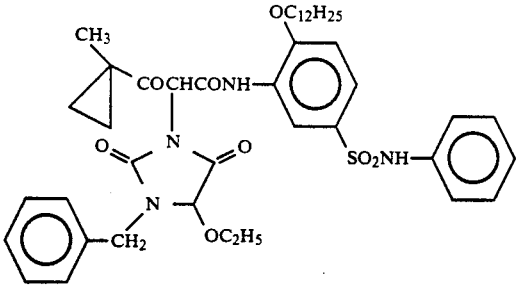
Y1-15
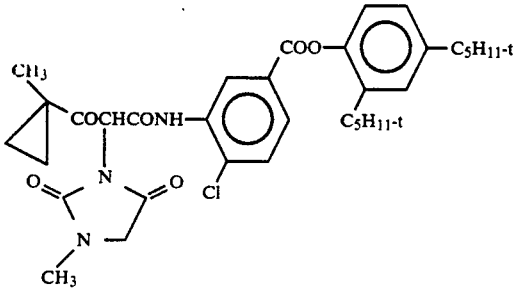
Y1-16

-continued
$Y_1$-17
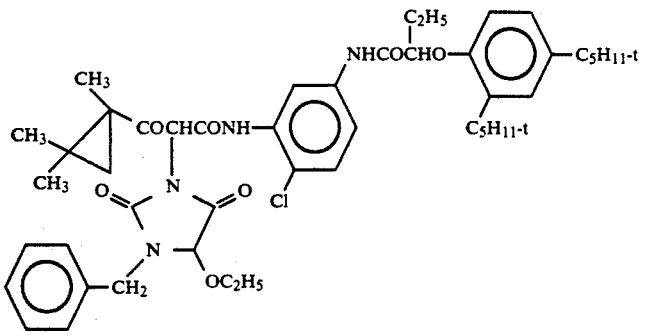
$Y_1$-18
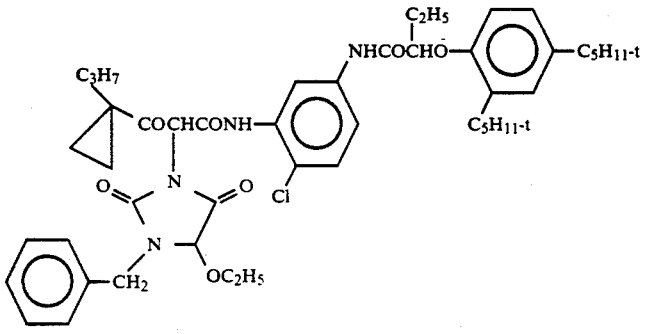
$Y_1$-19
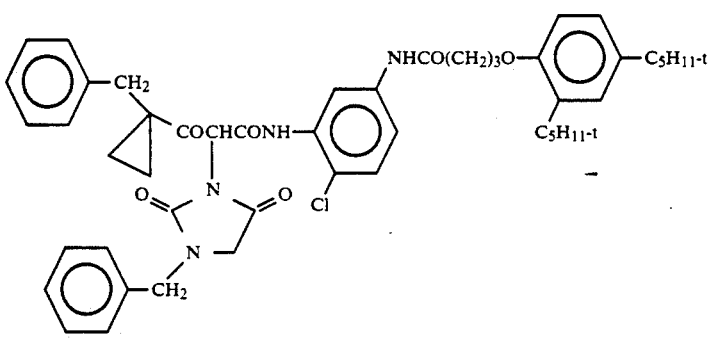
$Y_1$-20
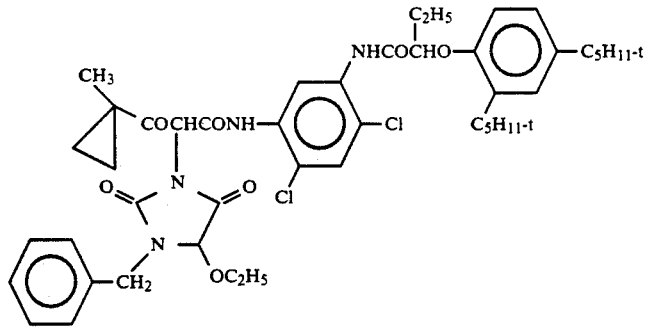
$Y_1$-21
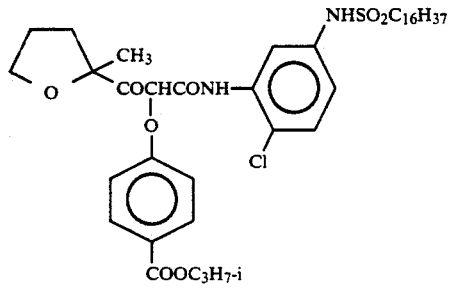

-continued
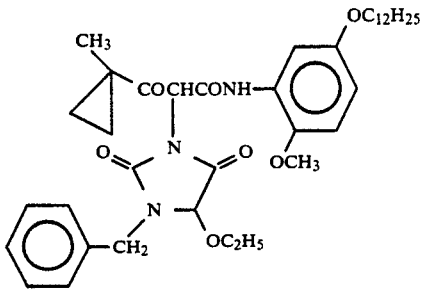
$Y_1$-22
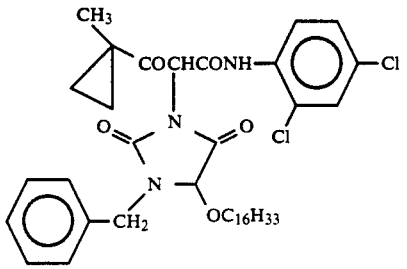
$Y_1$-23
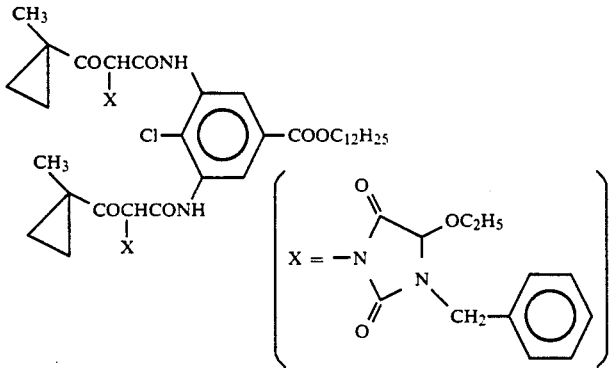
$Y_1$-24
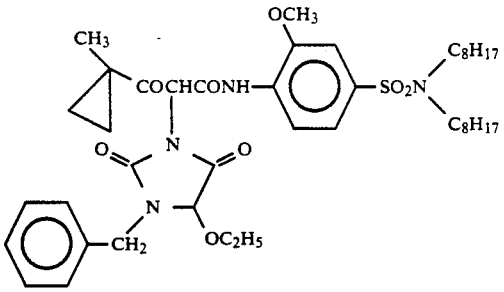
$Y_1$-25
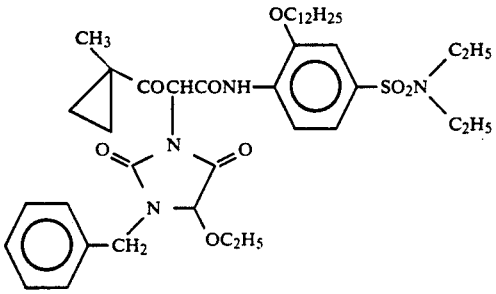
$Y_1$-26

-continued
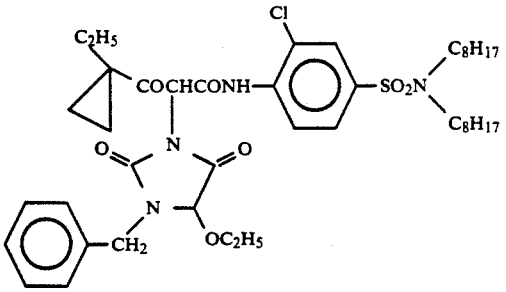
$Y_1$-27
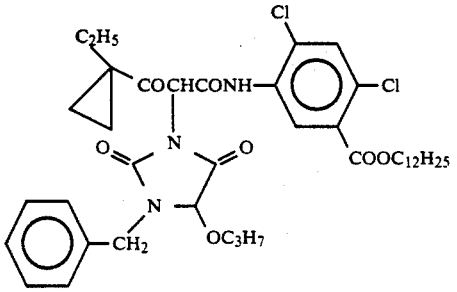
$Y_1$-28
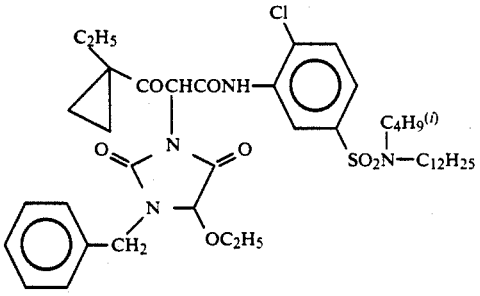
$Y_1$-29
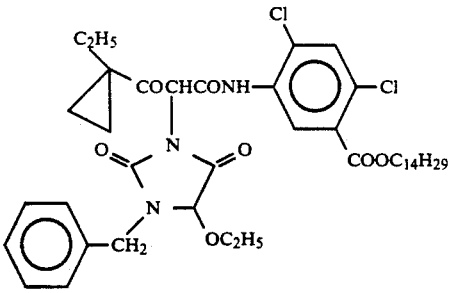
$Y_1$-30
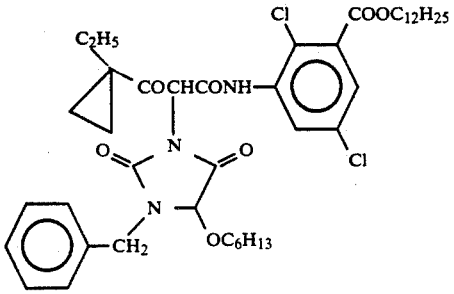
$Y_1$-31

-continued
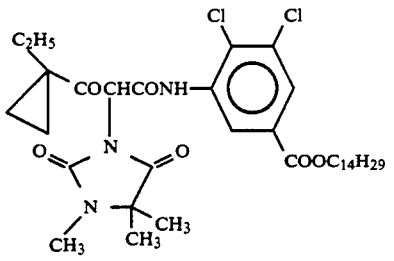
$Y_1$-32
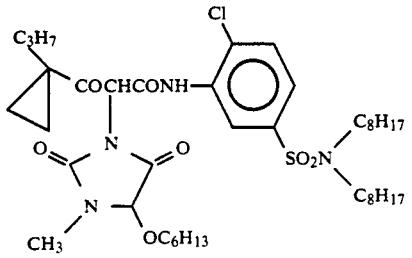
$Y_1$-33
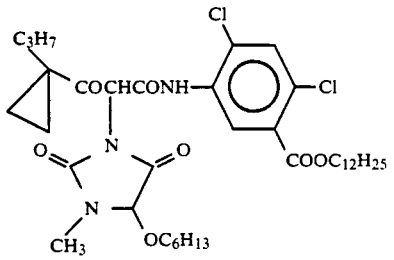
$Y_1$-34
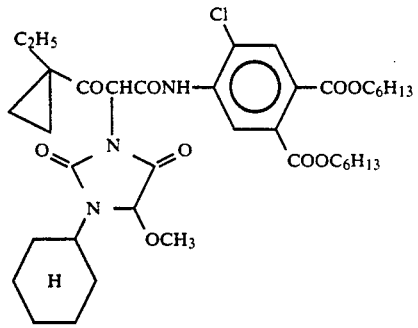
$Y_1$-35
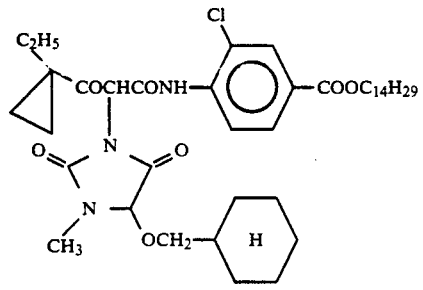
$Y_1$-36

-continued

Y1-37

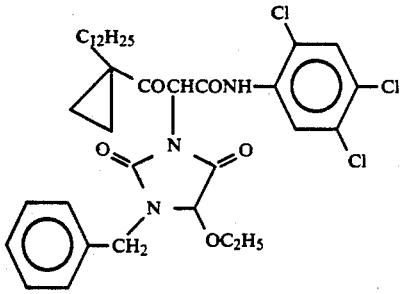

Y1-38

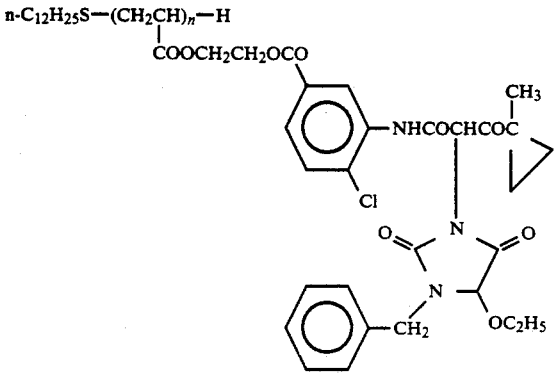

n = 3 (Average)

Y1-39

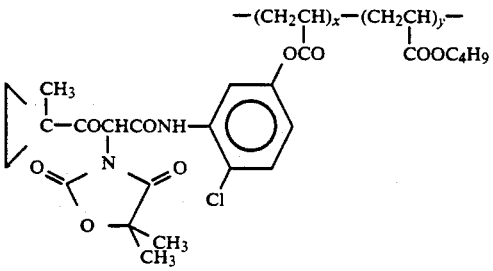

x:y = 50:50 (in weight ratio)
Number-average molecular weight: 50,000

Y1-40

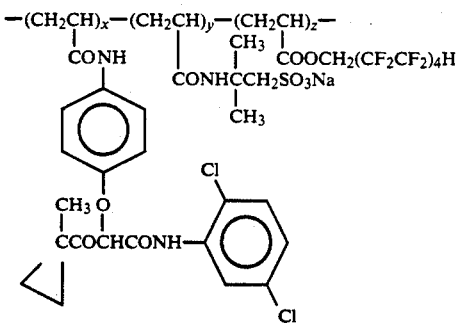

x:y:z = 50:30:20 (in weight ratio)
Number-average molecular weight: 70,000

The yellow coupler represented by formula (Y-IV) of the present invention can be synthesized by any of known methods (e.g., the method described in JP-A No. 102636/1976) after synthesizing a carboxylic acid represented by the following formula (B): formula (B)

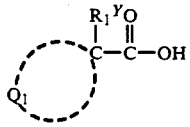

Carboxylic acid represented by formula (B) can be synthesized by an process described, for example, in J.

Chem. Soc. (C), 1968, 2548; J. Am. Chem. Soc., 1934, 56, 2710; Synthesis, 1971, 258; J. Org. Chem., 1978, 43, 1729; or CA. 1960, 66, 18533y.

Couplers represented by formulas (Y-II) and (Y-III) will now be described in detail.

When $R_2^Y$ and $R_3^Y$ represent an alkyl group, the alkyl group is a straight-chain branched chain, or cyclic, saturated or unsaturated, substituted or unsubstituted alkyl group having a C-number of 1 to 30, preferably 1 to 20. Examples of the alkyl group are methyl, ethyl, propyl, butyl, cyclopropyl, allyl, t-octyl, i-butyl, dodecyl, and 2-hexyldecyl.

When $R_2^Y$ and $R_3^Y$ represent a heterocyclic group, the heterocyclic group is preferably a 3- to 12-membered, more preferably a 5- to 6-membered, saturated or unsaturated, substituted or unsubstituted, monocyclic or condensed ring heterocyclic group having preferably C-number of 1 to 20, more preferably 1 to 10, and having at least one heteroatom, such as nitrogen atom, oxygen atom, or sulfur atom. As an example of the heterocyclic group, 3-pyrrolidinyl, 1,2,4-triazole-3-yl, 2-pyridyl, 4-prymidinyl, 3-pyrazolyl, 2-pyrrolyl, 2,4-dioxo-1,3-imidazolidine-5-yl, or pyranyl can be mentioned.

When $R_2^Y$ and $R_3^Y$ represent an aryl group, the aryl group is a substituted or unsubstituted aryl group having preferably C-number of 6 to 20, more preferably 6 to 10. As an example of the aryl group, phenyl and naphthyl can be mentioned.

When $Q_2$ represents a nitrogen-containing heterocyclic group together with the >N—, the heterocyclic group is preferably 3- to 12-membered, more preferably 5-to 6-membered, substituted or unsubstituted, saturated or unsaturated, monocyclic or condensed ring heterocyclic group that have preferably C-number of 1 to 20, more preferably 1 to 15 and may contain in addition to the nitrogen atom, for example, an oxygen atom or a sulfur atom as heteroatom. As an example of the heterocyclic group, pyrrolidino, piperidino, morpholino, 1-piperazinyl, 1-indolinyl, 1,2,3,4-tetrahydroquinoline-1-yl, 1-imidazolidinyl, 1-pyrazolyl, 1-pyrrolinyl, 1-pyrazolidinyl, 2,3-dihydro-1-indazolyl, 2-isoindolinyl, 1-indolyl, 1-pyrrolyl, 4-thiazine-S,S-dioxo-4-yl or benzoxadine-4-yl can be mentioned.

When $R_2^Y$ and $R_3^Y$ represent a substituted alkyl, aryl or heterocyclic group and $Q_2$ represents a substituted nitrogen-containing heterocyclic group together with the >N—, examples of the substituent include: a halogen atom (e.g., fluorine and chlorine), an alkoxycarbonyl group (preferably having a C-number of 2 to 30, and more preferably 2 to 20, e.g., methoxycarbonyl, dodecyloxycarbonyl, and hexadecyloxycarbonyl), an acylamino group (preferably having a C-number of 2 to 30, and more preferably 2 to 20, e.g., acetamido, tetradecaneamido, 2-(2,4-di-t-amylphenoxy)butaneamido, and benzamido), a sulfonamido group (preferably having a C-number of 1 to 30, and more preferably 1 to 20, e.g., methanesulfonamido. dodecanesulfonamido, hexadecylsulfonamido, and benzenesulfonamido), a carbamoyl group (preferably having a C-number of 1 to 30, and more preferably 1 to 20, e.g., N-butylcarbamoyl and N,N-diethylcarbamoyl), a an N-sulfonylcarbamoyl group (preferably having a C-number of 1 to 30, and more preferably 1 to 20, e.g., N-mesylcarbamoyl and N-dodecylsulfonylcarbamoyl), a sulfamoyl group (preferably having a C-number of 1 to 30, and more preferably 1 to 20, e.g., N-butylsulfamoyl, N-dodecylsulfamoyl, N-hexadecylsulfamoyl, N-3-(2,4-di-t-amylphenoxy)butylsulfamoyl, and N,N-diethylsulfamoyl), an alkoxy group (preferably having a C-number of 1 to 30, and more preferably 1 to 20, e.g., methoxy, hexadecyloxy, and isopropoxy), an aryloxy group (preferably having a C-number of 6 to 20, and more preferably 6 to 10, e.g., phenoxy, 4-methoxyphenoxy, 3-t-butyl-4-hydroxyphenoxy, and naphthoxy), an aryloxycarbonyl group (preferably having a C-number of 7 to 21, and more preferably 7 to 11, e.g., phenoxycarbonyl), an N-acylsulfamoyl group (preferably having a C-number of 2 to 30, and more preferably 2 to 20, e.g., N-propanoylsulfamoyl and N-tetradecanoylsulfamoyl), a sulfonyl group (preferably having a C-number of 1 to 30, and more preferably 1 to 20, e.g., methanesulfonyl, octanesulfonyl, 4-hydroxyphenylsulfonyl, and dodecanesulfonyl), an alkoxycarbonylamino group (preferably having a C-number of 1 to 30, and more preferably 1 to 20, e.g., ethoxycarbonylamino), a cyano group, a nitro group, a carboxyl group, a hydroxyl group, a sulfo group, an alkylthio group (preferably having a C-number of 1 to 30, and more preferably 1 to 20, e.g., methylthio, dodecylthio, and dodecylcarbamoylmethylthio), a ureido group (having a C-number of 1 to 30, and more preferably 1 to 20, e.g., N-phenylureido and N-hexadecylureido), an aryl group (preferably having a C-number of 6 to 20, and more preferably 6 to 10, e.g., phenyl, naphthyl, and 4-methoxyphenyl), a heterocyclic group (which is a 3- to 12-membered, preferably 5- to 6-membered, monocyclic or condensed ring having preferably a C-number of 1 to 20, and more preferably 1 to 10 and containing at least one heteroatom, such as a nitrogen atom, an oxygen atom, and a sulfur atom, e.g., 2-pyridyl, 3-pyrazolyl, 1-pyrrolyl, 2,4-dioxo-1,3-imidazolidine-1-yl, 2-benzoxazolyl, morpholino, and indolyl), an alkyl group (which may be straight-chain, branched chain, or cyclic and saturated or unsaturated and preferably has a C-number of 1 to 30, and more preferably 1 to 20, e.g., methyl, ethyl, isopropyl, cyclopropyl, t-pentyl, t-octyl, cyclopentyl, t-butyl, s-butyl, dodecyl, and 2-hexyldecyl), an acyl group (preferably having a C-number of 1 to 30, and more preferably 2 to 20, e.g., acetyl and benzoyl), an acyloxy group (preferably having a C-number of 2 to 30, and more preferably 2 to 20, e.g., propanoyloxy and tetradecanoyloxy), an arylthio group (preferably having a C-number of 6 to 20, and more preferably 6 to 10, e.g., phenylthio and naphthylthio), a sulfamoylamino group (preferably having a C-number of 0 to 30, and more preferably 0 to 20, e.g., N-butylsulfamoylamino, N-dodecylsulfamoylamino, and N-phenylsulfamoylamino), or an N-sulfonylsulfamoyl group (preferably having a C-number of 1 to 30, and more preferably 1 to 20, e.g., N-mesylsulfamoyl, N-ethanesulfonylsulfamoyl, N-dodecanesulfonylsulfamoyl, and N-hexadecanesulfonylsulfamoyl). These substituents may be further substituted. Examples of the substituent include those mentioned above.

Among the above substituents, preferable ones include, for example, an alkoxy group, a halogen atom, an alkoxycarbonyl group, an acyloxy group, an acylamino group, a sulfonyl group, a carbamoyl group, a sulfamoyl group, a sulfonamido group, a nitro group, an alkyl group, or an aryl group.

When Y in formulas (Y-II) and (Y-III) represents an aryl group, the aryl group is a substituted or unsubstituted aryl group preferably having a C-number of 6 to 20, and more preferably 6 to 10. Typical examples thereof are phenyl and naphthyl group.

When Y in formulas (Y-II) and (Y-III) represents a heterocyclic group, the heterocyclic group has the same meaning as that of the heterocyclic group represented by $R_2^Y$ and $R_3^Y$.

When Y represents a substituted aryl group or a substituted heterocyclic group, examples of the substituent include those mentioned as examples of the substituent possessed by $R_2^Y$. Preferable examples of the substituted aryl group and heterocyclic group represented by Y are those wherein the substituted group has a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, an N-sulfonylcarbamoyl group, a sulfonamido group, or an alkyl group.

A particularly preferable example of Y is a phenyl group having at least one substituent in the ortho position.

The group represented by $X_1^Y$ in formulas (Y-II) and (Y-III) may be any one of conventionally known coupling releasing group. Preferably $X_1^Y$ includes, for example, a nitrogen-containing heterocyclic group bonded to the coupling site through the nitrogen atom, an aryloxy group, an arylthio group, a heterocyclic oxy group, a heterocyclic thio group, an acyloxy group, a carbamoyloxy group, an alkylthio group, or a halogen atom.

These coupling releasing groups may be any one of nonphotographically useful groups, photographically useful groups, or precursors therefor (e.g., a development retarder, a development accelerator, a desilvering accelerator, a fogging agent, a dye, a hardener, a coupler, a developing agent oxidized product scavenger, a fluorescent dye, a developing agent, or an electron transfer agent).

When $X_1^Y$ is a photographically useful group, one which is conventionally known is useful. For example, photographically useful groups described, for example, in U.S. Pat. No. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571, or 4,741,994, and Europe Publication Patent No. 193389 A, 348139 A, or 272573 A or coupling split-off groups for releasing them (e.g., a timing group) are used.

When $X_1^Y$ represents a nitrogen-containing heterocyclic group bonded to the coupling site through the atom, preferably $X_1^Y$ represents a 5- to 6-nitrogen membered, substituted or unsubstituted, saturated or unsaturated, monocyclic or condensed ring heterocyclic group preferably having a C-number of 1 to 15, and more preferably 1 to 10. As heteroatom, in addition to the nitrogen atom, an oxygen atom or a sulfur atom may be present. As a preferable example of the heterocyclic group, 1-pyrazolyl, 1-imidazolyl, pyrrolino, 1,2,4-triazole-2-yl, 1,2,3-triazole-1-yl, benzotriazolyl, benzimidazolyl. imidazolidine-2,4-dione-3-yl, oxazolidine-2,4-dione-3-yl, 1,2,4-triazolidine-3,5-dione-4-yl, imidazolidine-2,4,5-trion-3-yl, 2-imidazolinone-1-yl, 3,5-dioxomorpholino, or 1-indazolyl can be mentioned. When these heterocyclic groups are substituted, the substituent includes those mentioned as examples of the substituent which may be possessed by the $R_2^Y$ group. Preferable substituents are those wherein one substituent is an alkyl group, an alkoxy group, a halogen atom, an alkoxycarbonyl group, an aryloxycarbonyl group, an alkylthio group, an acylamino group, a sulfonamido group, an aryl group, a nitro group, a carbamoyl group, or a sulfonyl group.

When $X_1^Y$ represents an aromatic oxy group, preferably the aromatic oxy group is a substituted or unsubstituted aromatic oxy group having a C-number of 6 to 10, and more preferably a substituted or unsubstituted phenoxy group. If the aromatic oxy group is substituted, examples of the substituent include those mentioned as examples of the substituent which may be possessed by $R_2^Y$ mentioned above. Among them, preferable substituents are those wherein at least one substituent is an electron-attractive substituent, such as a sulfonyl group, an alkoxycarbonyl group, a sulfamoyl group, a halogen atom, a carboxyl group, a carbamoyl group, a nitro group, a cyano group, or an acyl group.

When $X_1^Y$ represents an aromatic thio group, preferably the aromatic thio group is a substituted or unsubstituted aromatic thio group having a C-number of 6 to 10, and more preferably a substituted or unsubstituted phenylthio group. When the aromatic thio group is substituted, examples of the substituent include those mentioned as examples of the substituent which may be possessed by $R_2^Y$ mentioned above. Among them, preferable substituents are those wherein at least one substituent is an alkyl group, an alkoxy group, a sulfonyl group, an alkoxycarbonyl group, a sulfamoyl group, a halogen atom, a carbamoyl group, or a nitro group.

When $X_1^Y$ represents a heterocyclic oxy group, preferably the heterocyclic moiety has 1 to 20 carbon atoms, and more preferably 1 to 10 carbon atoms and at least one heteroatom, for example, one nitrogen atom, one oxygen atom, or one sulfur atom and is 3- to 12-membered, more preferably 5- to 6-membered, substituted or unsubstituted, saturated or unsaturated, monocyclic or condensed ring, heterocyclic group. As an example of the heterocyclic oxy group, a pyridyloxy group, a pyrazolyloxy group, or a furyloxy group can be mentioned. When the heterocyclic oxy group is substituted, examples of the substituent include those mentioned as examples of the substituent which may be possessed by $R_2^Y$ mentioned above. Among them, preferable substituents are those wherein at least one substituent is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, or a sulfonyl group.

When $X_1^Y$ represents a heterocyclic thio group, preferably the heterocyclic moiety has 1 to 20 carbon atoms, and more preferably 1 to 10 carbon atoms and at least one heteroatom, for example, one nitrogen atom, one oxygen atom, or one sulfur atom and is 3- to 12-membered, more preferably 5- to 6-membered, substituted or unsubstituted, saturated or unsaturated, monocyclic or condensed ring, heterocyclic group. As an example of the heterocyclic thio group, a tetrazolylthio group, a 1,3,4-thiadiazolylthio group, a 1,3,4-oxadiazolylthio group, a 1,3,4-triazolylthio group, a benzoimidazolylthio group, a benzothiazolylthio group, or a 2-pyridylthio group can be mentioned. When the heterocyclic thio group is substituted, examples of the substituent include those mentioned as examples of the substituent which may be possessed by $R_2^Y$ mentioned above. Among them, preferable substituents are those wherein at least one substituent is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, a heterocyclic group, or a sulfonyl group.

When $X_1^Y$ represents an acyloxy group, the acyloxy group is a monocyclic or condensed ring, substituted or unsubstituted, aromatic acyloxy group preferably having 6 to 10 carbon atoms or a substituted or unsubstituted aliphatic acyloxy group preferably having 2 to 30 carbon atoms, and more preferably 2 to 20 carbon atoms. When the acyloxy group is substituted, examples of the substituent include those mentioned as examples of the substituent which may be possessed by $R_2^Y$ mentioned above.

When $X_1^Y$ represents a carbamoyloxy group, the carbamoyloxy group is an aliphatic or aromatic or heterocyclic, substituted or unsubstituted carbamoyloxy group preferably having 1 to 30 carbon atoms, and more preferably 1 to 20 carbon atoms. As an example, N,N-diethylcarbamoyloxy, N-phenylcarbamoyloxy, 1-imidazolylcarbonyloxy, or 1-pyrrolocarbonyloxy can be mentioned. When the carbamoyloxy group is substituted, examples of the substituent include those mentioned as examples of the substituent which may be possessed by $R_2^Y$ mentioned above.

When $X_1^Y$ represents an alkylthio group, the alkylthio group is a substituted or unsubstituted, straight-chain, branched chain, or cyclic, saturated or unsaturated alkylthio group having 1 to 30 carbon atoms, more preferably 1 to 20 carbon atoms. When the alkylthio group is substituted, examples of the substituent include those mentioned as examples of the substituent which may be possessed by $R_2^Y$ mentioned above.

Now, couplers represented by formulas (Y-II) and (Y-III) that fall in a particularly preferable range will be described.

The group represented by $R_2^Y$ in formula (Y-II) is preferably an alkyl group, and particularly preferably an alkyl group having 1 to 10 carbon atoms.

The group represented by Y in formulas (Y-II) and (Y-III) is preferably an aromatic group, and particularly preferably a phenyl group having at least one substituent on the ortho position. The substituent includes those mentioned above, which may be possessed by the aromatic group represented by Y. Preferable substituents are similar to ones mentioned above Y.

The group represented by $X_1^Y$ in formulas (Y-II) and (Y-III) includes preferably a 5- to 6-membered nitrogen-containing heterocyclic group bonded to the coupling site through the nitrogen atom, an aromatic oxy group, a 5- or 6-membered heterocyclic oxy group, or a 5-or 6-membered heterocyclic thio group.

Preferable couplers in formulas (Y-II) and (Y-III) are represented by the following formula (Y-V), (Y-VI), or (Y-VII):

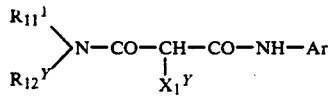

formula (Y-V)

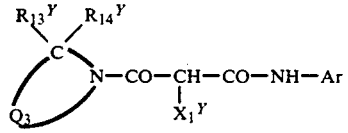

formula (Y-VI)

-continued

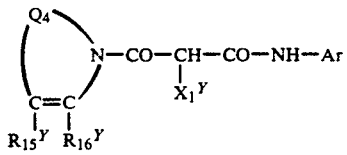

formula (Y-VII)

wherein $X_1^Y$ has the same meaning defined in formula (Y-II), $R_{11}^Y$ represents an alkyl group, $R_{12}^Y$ represents an alkyl group or an aromatic group, Ar represents a phenyl group having at least one substituent on the ortho position, $Q_3$ represents an organic residue to form a nitrogen-containing cyclic group (monocyclic or condensed ring) together with the $—C(R_{13}^YR_{14}^Y)—N<$, $Q_4$ represents an organic residue to form a nitrogen-containing cyclic group (monocyclic or condensed ring) containing cyclic group (monocyclic or condensed ring) together with the $—C(R_{15}^Y)=C(R_{16}^Y)—N<$, $R_{13}^Y$, $R_{14}^Y$, $R_{15}^Y$, and $R_{16}^Y$ each represent a hydrogen atom or a substituent.

Substituents on ortho position of Ar include preferably a chlorine atom, a fluorine atom, an alkyl group having 1 to 6 carbon atoms (e.g., methyl, trifluoromethyl, ethyl, isopropyl, and t-butyl), an alkoxy group having 1 to 8 carbon atoms (e.g., methoxy, ethoxy, methoxyethoxy, and butoxy), and an aryloxy group having 6 to 24 carbon atoms (e.g., phenoxy, p-tolyloxy, and p-methoxyphenoxy), and most preferably a chlorine atom, methoxy, and trifluoromethyl group.

With respect to a detailed description and a preferable range of the groups represented by $R_{11}^Y$, $R_{12}^Y$, $Q_3$, $Q_4$, Ar, and $X_1^Y$ in formulas (Y-V) to (Y-VII), the description in the relevant range described for formulas (Y-II) and (Y-III) is applied. When $R_{13}^Y$ to $R_{16}^Y$ represent a substituent, examples include those substituents that may be possessed by $R_2^Y$ mentioned above.

Among the couplers represented by the above mentioned formulas, particularly preferable couplers are those represented by formula (Y-VI) or (Y-VII).

The couplers represented by formulas (Y-II), (Y-III), and (Y-V) to (Y-VII) may form a dimer or higher polymer (e.g., a telomer or a polymer) by bonding at the groups represented by $R_2Y$, $R_3^Y$, $R_{11}^Y$ to $R_{16}^Y$, $Q_2$ to $Q_4$, Y, Ar, and $X_1^Y$ through a divalent group or more higher polyvalent group. In that case, the number of carbon atoms may fall outside the range of the number of carbon atoms defined in the above-mentioned substituents.

Preferable examples of the couplers represented by formulas (Y-II), (Y-III), and (Y-V) to (Y-VII) are nondiffusible couplers. The term "nondiffusible couplers" refers to couplers having in the molecule a group with a molecular weight large enough to make the molecule immobilized in the layer in which the molecule is added Generally an alkyl group having a total C-number of 8 to 30, preferably 10 to 20, or an aryl group having a total C-number of 4 to 40, is used. These nondiffusible groups may be substituted on any position in the molecule, and two or more of them may be present in the molecule.

Specific examples of the couplers represented by formulas (1), (2), (I), (II), and (III) are shown below, but the present invention is not restricted to them.

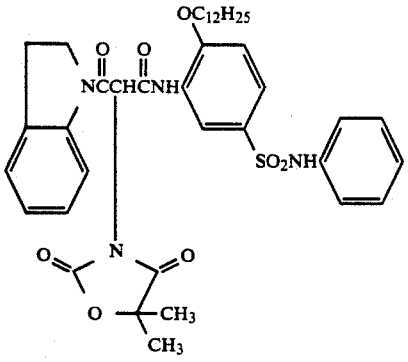
$Y_2$-1
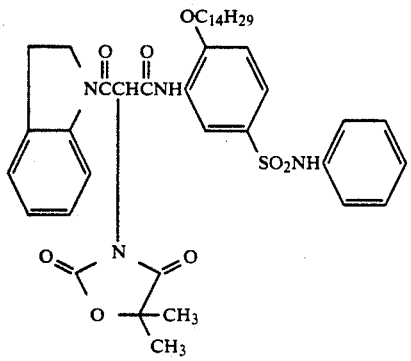
$Y_2$-2
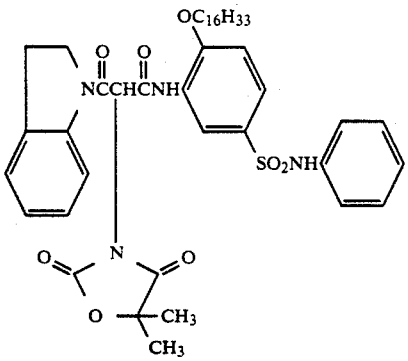
$Y_2$-3
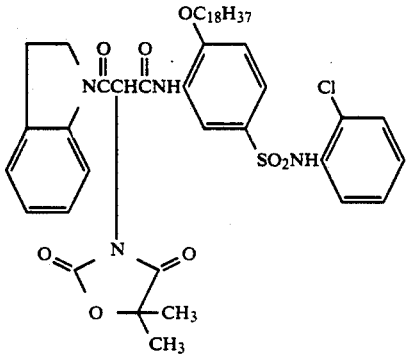
$Y_2$-4

-continued
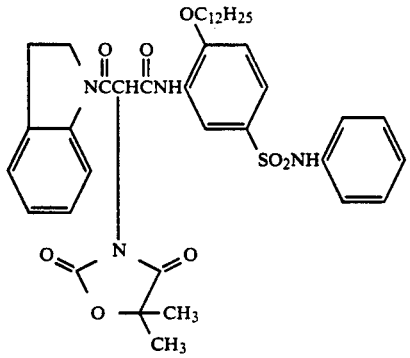
$Y_2$-5
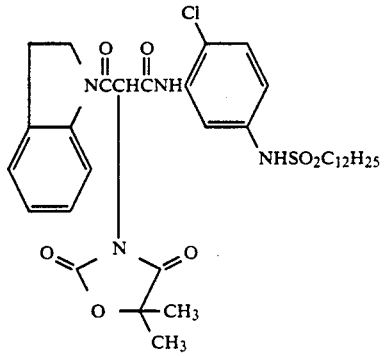
$Y_2$-6
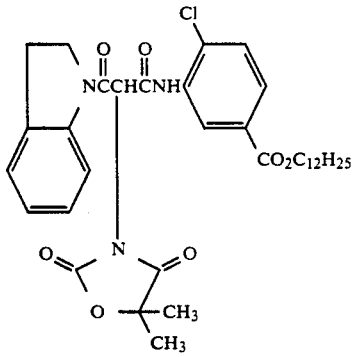
$Y_2$-7
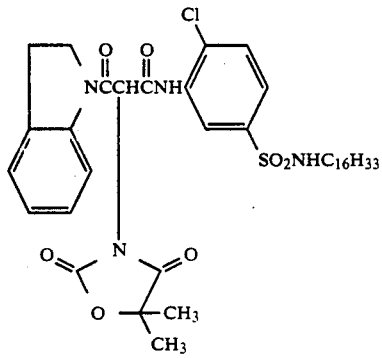
$Y_2$-8

-continued
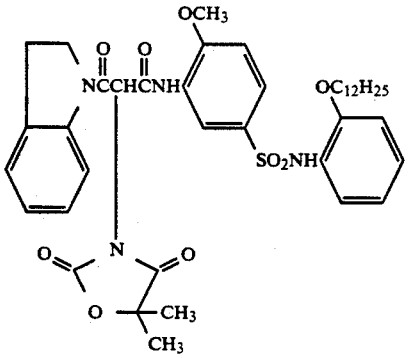
$Y_2$-9
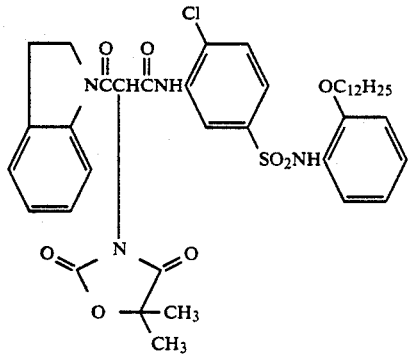
$Y_2$-10
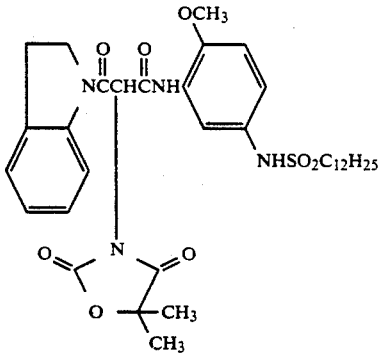
$Y_2$-11
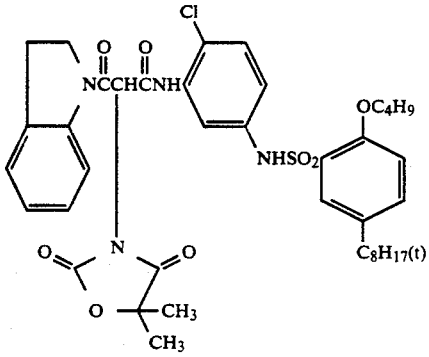
$Y_2$-12

-continued
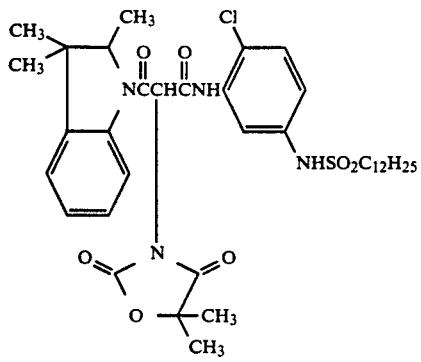
$Y_2$-13
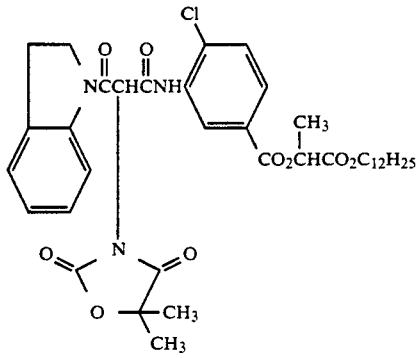
$Y_2$-14
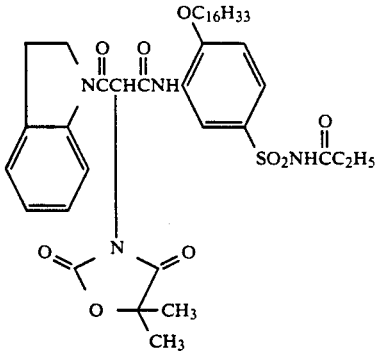
$Y_2$-15
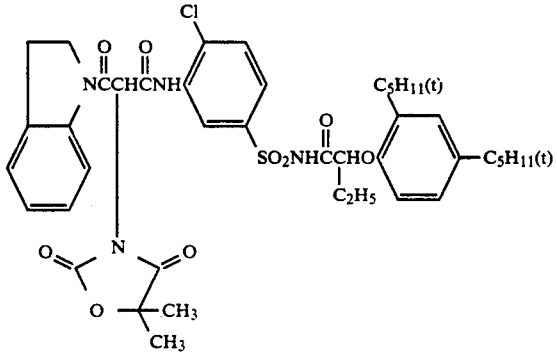
$Y_2$-16

-continued
$Y_{2-17}$
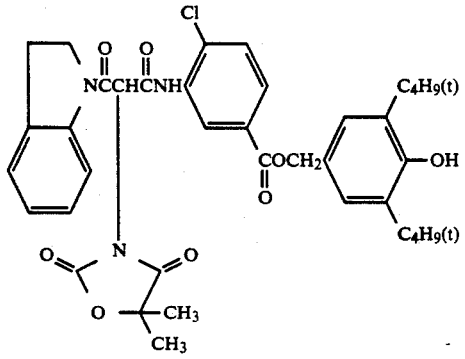
$Y_{2-18}$
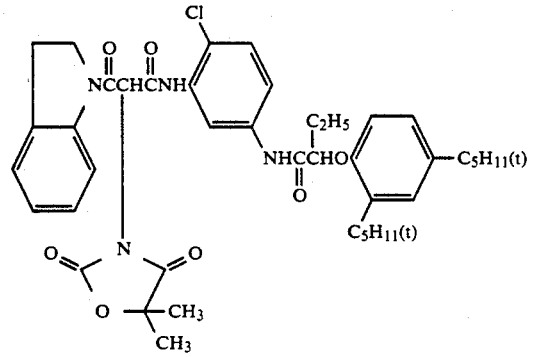
$Y_{2-19}$
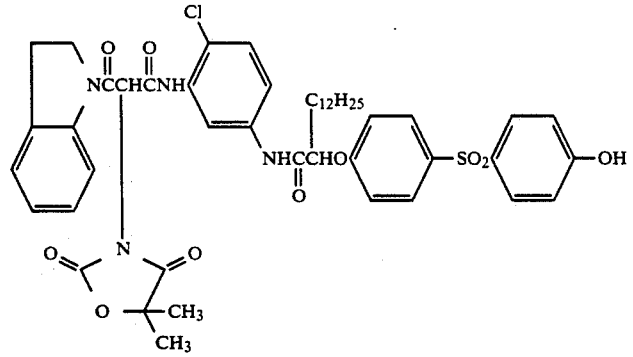
$Y_{2-20}$
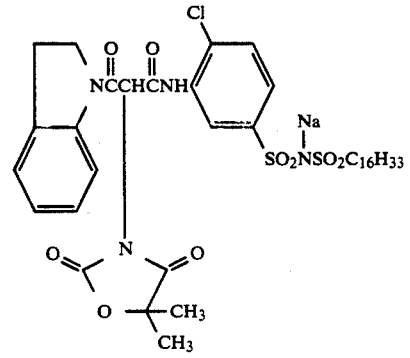

-continued
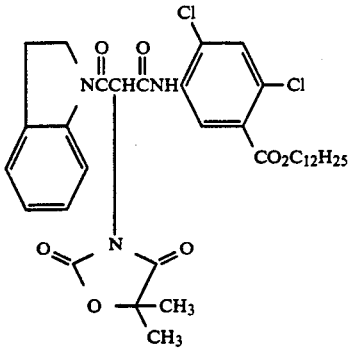
$Y_2$-21
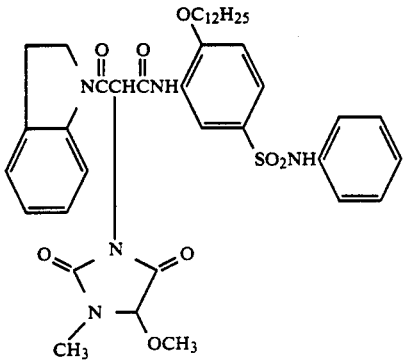
$Y_2$-22
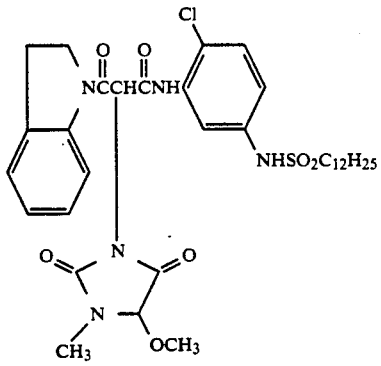
$Y_2$-23
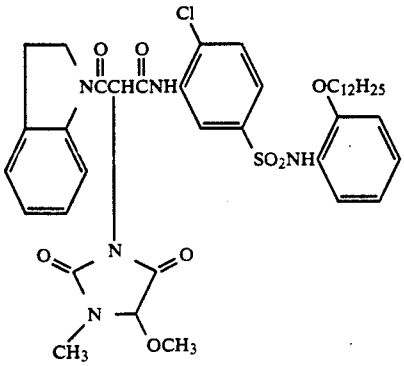
$Y_2$-24

-continued
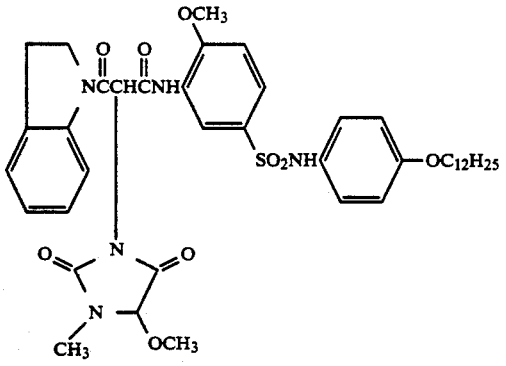
Y2-25
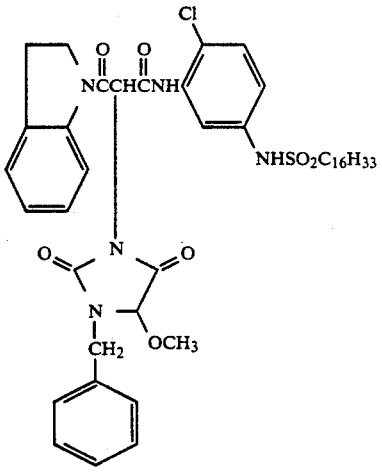
Y2-26
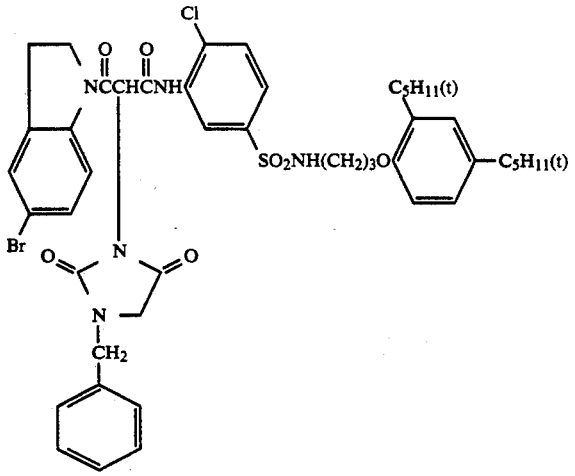
Y2-27

-continued
$Y_2$-28
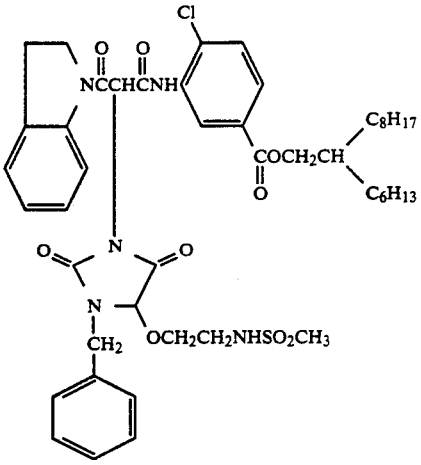
$Y_2$-29
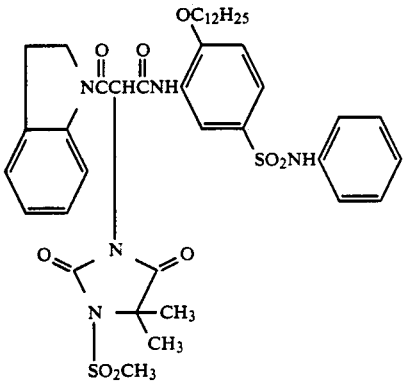
$Y_2$-30
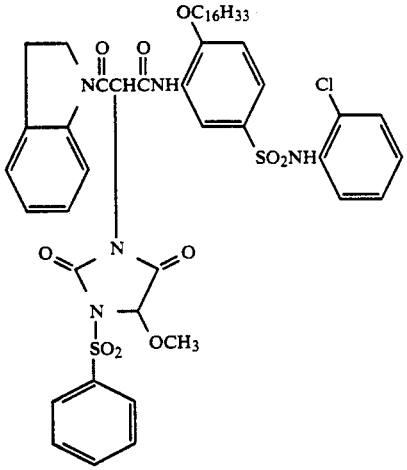
$Y_2$-31
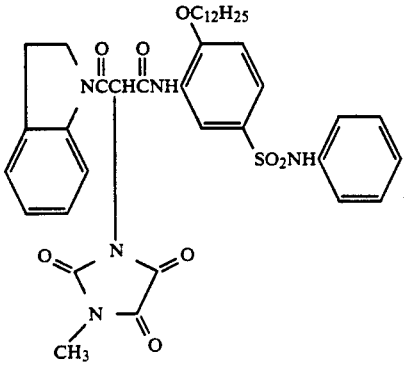

-continued
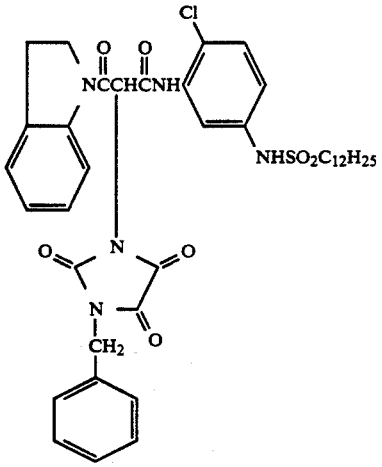
$Y_2$-32
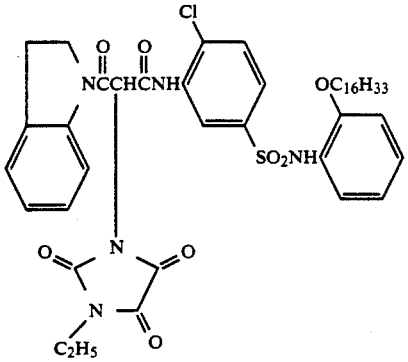
$Y_2$-33
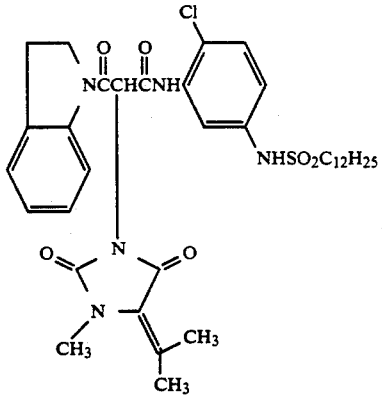
$Y_2$-34
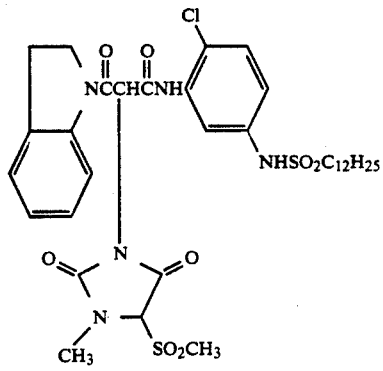
$Y_2$-35

-continued
$Y_2$-36
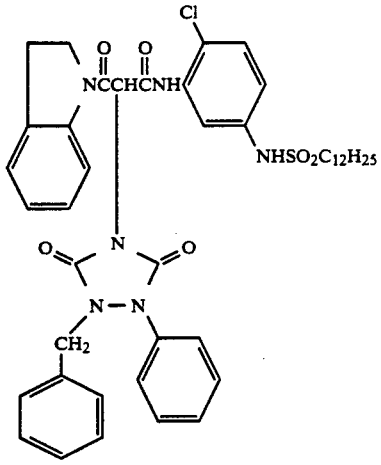
$Y_2$-37
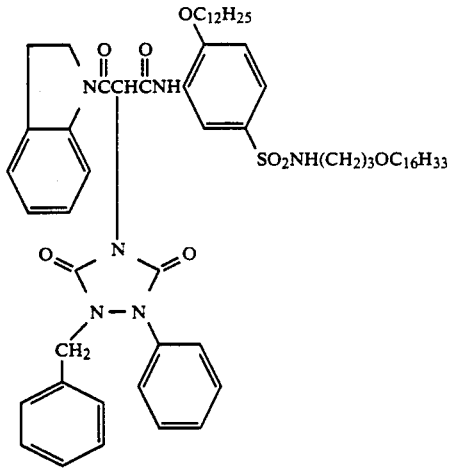
$Y_2$-38
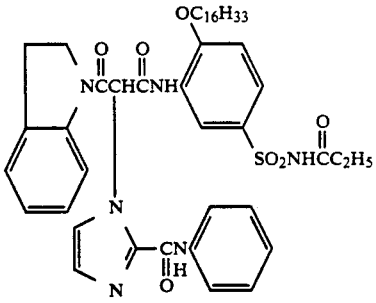
$Y_2$-39
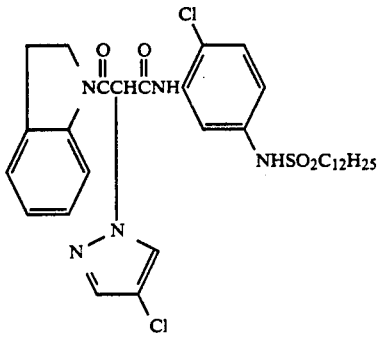

-continued
$Y_2$-40
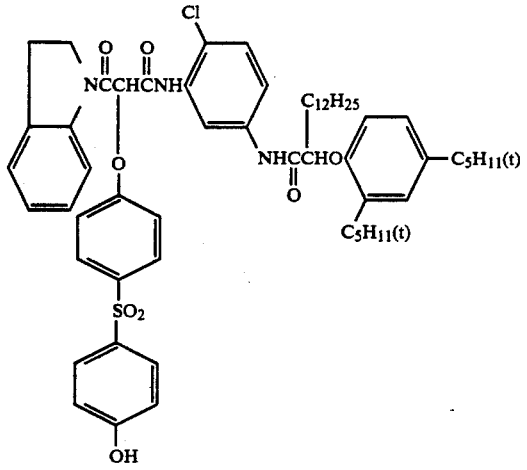
$Y_2$-41
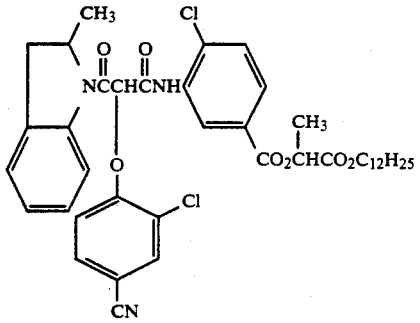
$Y_2$-42
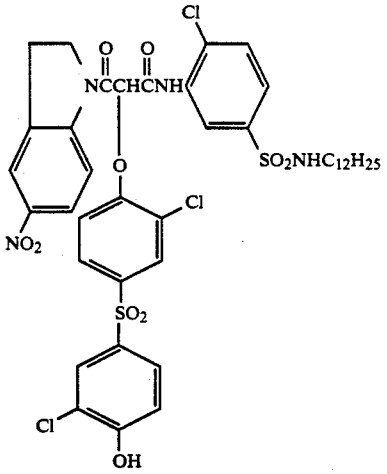
$Y_2$-43
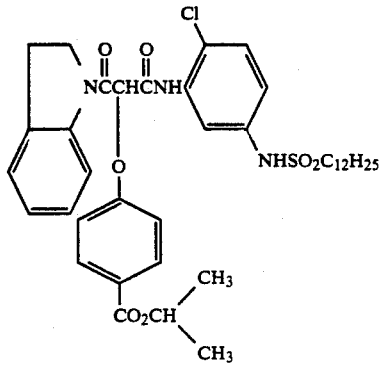

-continued
$Y_2$-44
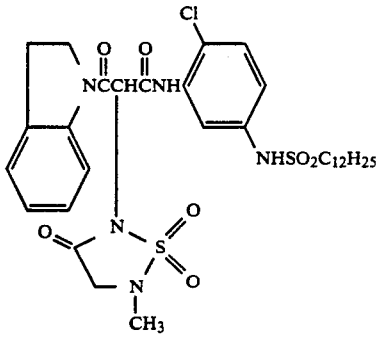
$Y_2$-45
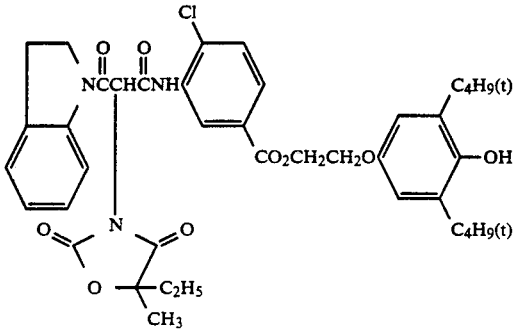
$Y_2$-46
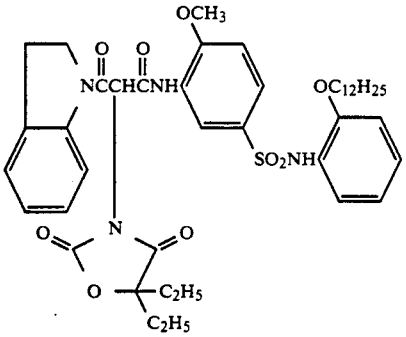
$Y_2$-47
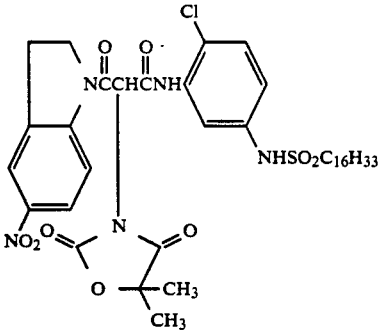
$Y_2$-48
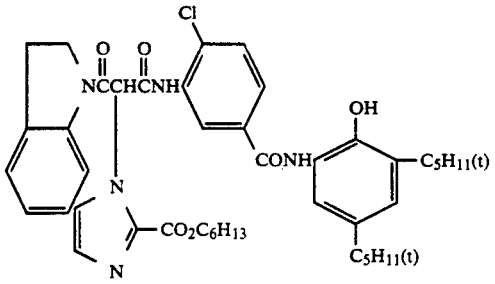

-continued
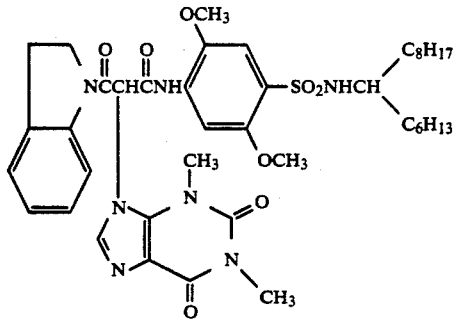
Y2-49
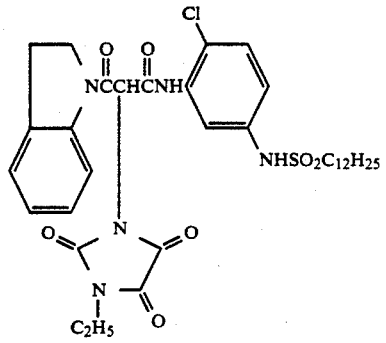
Y2-50
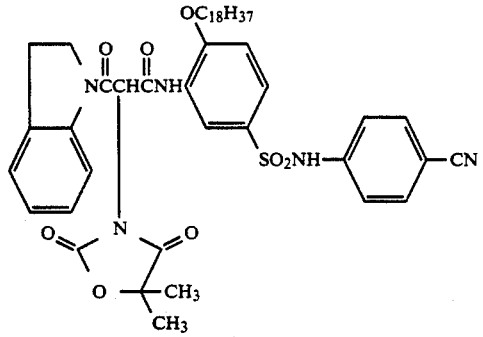
Y2-51
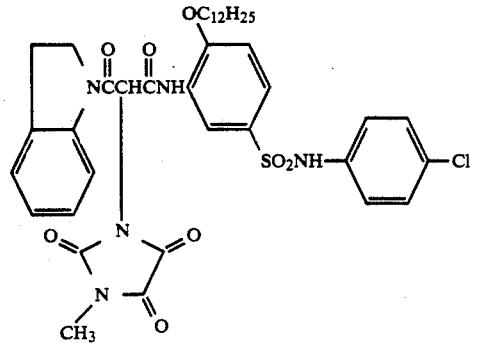
Y2-52

-continued
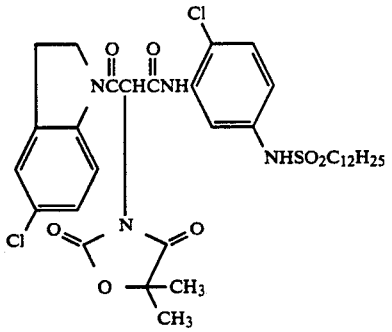
Y2-53
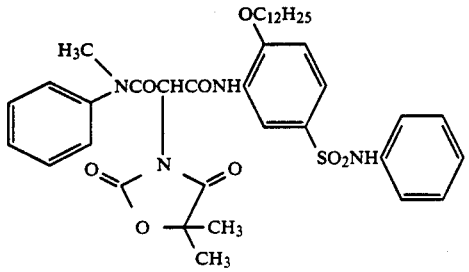
Y2-54
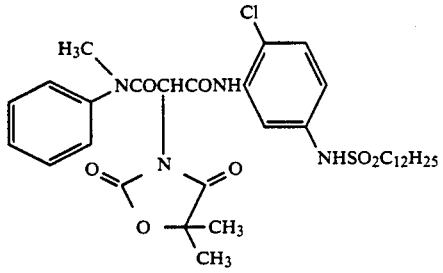
Y2-55
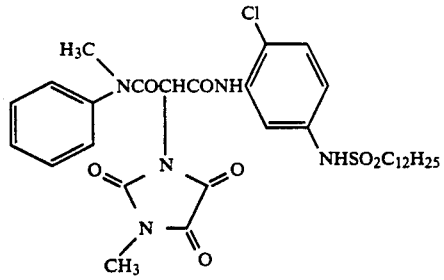
Y2-56
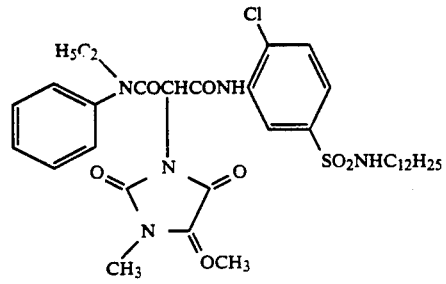
Y2-57

-continued
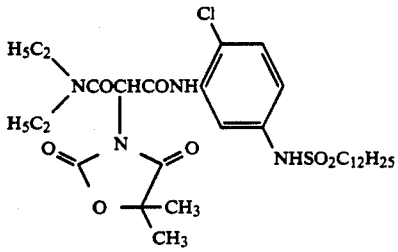
Y2-58
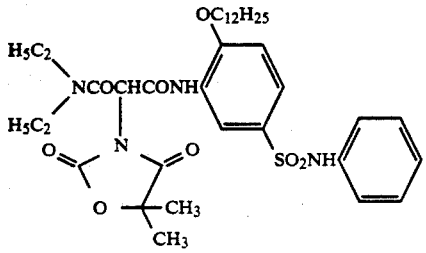
Y2-59
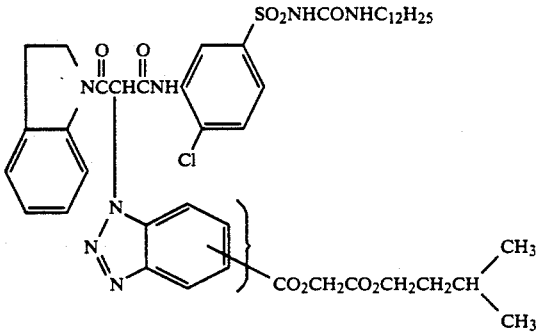
Y2-60
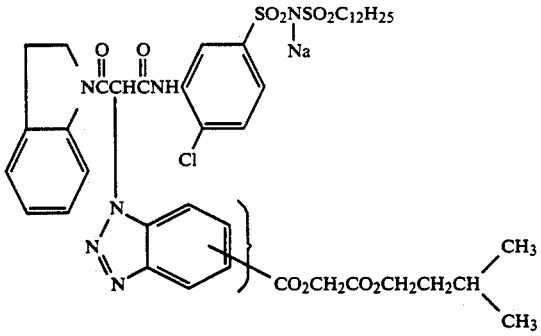
Y2-61
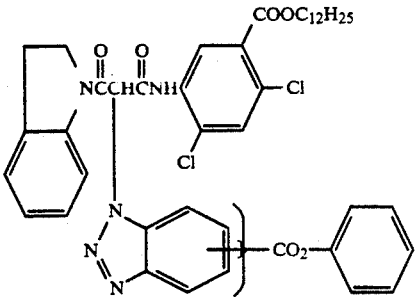
Y2-62

-continued

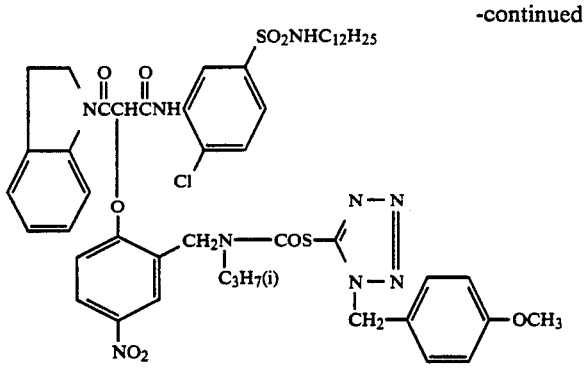

Y2-63

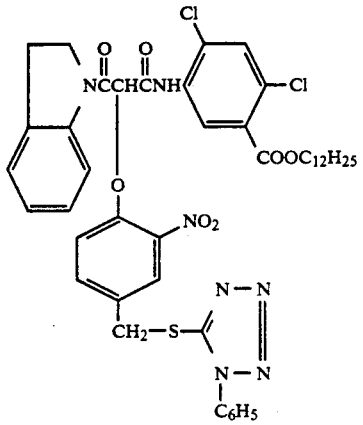

Y2-64

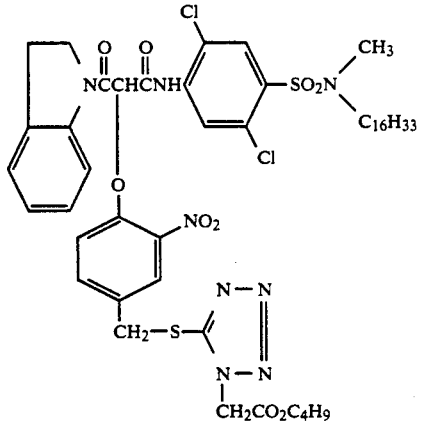

Y2-65

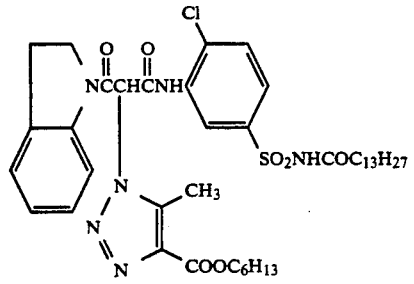

Y2-66

Now the compound represented by formula (C-I) will be described in detail.

$R_1^C$ represents $—CONR_4^CR_5^C$, $—SO_2NR_4^CR_5^C$, $—NHCOR_4^C$, $—NHCOOR_6^C$, $—NHSO_2R_6^C$, $—NHCONR_4^CR_5^C$, or $—NHSO_2NR_4^CR_5^C$ wherein $R_4^C$, $R_5^C$, and $R_6^C$ each represent independently an alkyl group having a C-number of 1 to 30, an aryl group having a C-number of 6 to 30, or a heterocyclic ring having a C-number of 2 to 30. $R_4^C$ and $R_5^C$ each may be a hydrogen atom.

$R_2^C$ represents a group (including an atom, the same being applied hereinafter) capable of substitution onto a naphthalene ring and typical examples of $R_2^C$ include a halogen atom, (F, Cl, Br, and I), a hydroxyl group, a carbonyl group, an amino group, a sulfo group, a cyano group, an alkyl group, an aryl group, a heterocyclic group, a carbonamido group, a sulfonamido group, a carbamoyl group, a sulfamoyl group, a ureido group, an acyl group, an acyloxy group, an alkoxy group, an aryloxy group, an alkylthio group, an arylthio group, an alkylsulfonyl group, an arylsulfonyl group, a sulfamoylamino group, an alkoxycarbonylamino group, a nitro group, and an imido group. If l=2, examples are a dioxymethylene group and a trimethylene group. The total C-number of $(R_2^C)_l$ is 0 to 30.

$R_3^C$ represents a substituent, preferably represented by the following formula (II-1): formula (II-1)

$$R_7^C(Y^C)_p-$$

wherein $Y^C$ represents >NH, >CO, or $>SO_2$, p is an integer of 0 or 1, $R_7^C$ represents a hydrogen atom, an alkyl group having a C-number of 1 to 30, an aryl group having a C-number of 6 to 30, a heterocyclic group having a C-number of 2 to 30, $-COR_8^C$,

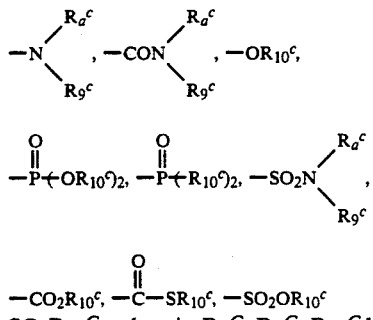

or $-SO_2R_{10}^C$, wherein $R_8^C$, $R_9^C$, $R_{10}^C$ have the same meanings as those of $R_4^C$, $R_5^C$, and $R_6^C$ defined above respectively.

In $R_1^C$ or $R_7^C$, $R_4^C$ *and* $R_5^C$ of $-NR_4^CR_5^C$ and $R_8^C$ and $R^{9C}$ of $-NR_8^CR_9^C$ may bond together to form a nitrogen-containing heterocyclic ring (e.g., a pyrrolidine ring, a piperidine ring, and a morpholine ring).

$X_1^C$ represents a hydrogen atom or a coupling releasing group and, as typical examples of the coupling releasing group, a halogen atom,

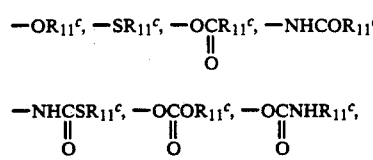

a thiocyanato group, and a heterocyclic group having a C-number of 1 to 30 and bonded to the coupling active site through the nitrogen atom (e.g., a succinimido group, a phthalimido group, a pyrazolyl group, a hydantoinyl group, and a 2-benzotriazolyl group) can be mentioned. Herein, $R_{11}^C$ has the same meaning as that of $R_6^C$ mentioned above.

In the above, the alkyl group may be linear, branched, or cyclic, may be unsaturated, and may be substituted (for example, by a halogen atom, a hydroxyl group, an aryl group, a heterocyclic group, an alkoxy group, an aryloxy group, an alkylsulfonyl group, an arylsulfonyl group, an alkoxycarbonyl group, an acyloxy group, and an acyl group) and typical examples are methyl, ethyl, isopropyl, isobutyl, t-butyl, 2-ethylhexyl, cyclohexyl, n-dodecyl, n-hexadecyl, 2-methoxyethyl, benzyl, trifluoromethyl, 3-dodecyloxypropyl, or 3-(2,4-di-t-pentylphenoxy)propyl.

The aryl group may be a condensed ring (e.g., a naphthyl group) and may be substituted (for example, by a halogen atom, an alkyl group, an aryl group, an alkoxy group, an aryloxy group, a cyano group, an acyl group, an alkoxycarbonyl group, a carbonamido group, a sulfonamido group, a carbamoyl group, a sulfamoyl group, an alkylsulfonyl group, or an arylsulfonyl group) and typical examples are phenyl, tolyl, pentafluorophenyl, 2-chlorophenyl, 4-hydroxyphenyl, 4-cyanophenyl, 2-tetradecyloxyphenyl, 2-chloro-5-dodecyloxyphenyl, and 4-t-butylphenyl.

The heterocyclic group is a 3- to 8-membered monocyclic or condensed cyclic heterocyclic group having at least one heterocyclic atom of O, N, S, P, Se, and Te and may be substituted (for example, by a halogen atom, a carboxyl group, a hydroxyl group, a nitro group, an alkyl group, an aryl group, an alkoxy group, an aryloxy group, an alkoxycarbonyl group, an aryloxycarbonyl group, an amino group, a carbamoyl group, a sulfamoyl group, an alkylsulfonyl group, or an arylsulfonyl group), and typical examples are 2-pyridyl, 4-pyridyl, 2-furyl, 4-thienyl, benzotriazole-1-yl, 5-phenyltetrazole-1-yl, 5-methylthio-1,3,4-thiadiazole-2-yl, and 5-methyl-1,3,4-oxadiazole-2-yl.

Preferable examples of the substituents of the present invention will now be described.

$R_1^C$ is preferably $-CONR_4^CR_5^C$ or $-SO_2NR_4^CR_5^C$ and specific examples are carbamoyl, N-n-butylcarbamoyl, N-n-dodecylcarbamoyl, N-(3-n-dodecyloxypropyl)carbamoyl, N-cyclohexylcarbamoyl, N-[3-(2,4-di-t-pentylphenoxy)propyl]-carbamoyl, N-hexadecylcarbamoyl, N-[4-(2,4-di-t-pentylphenoxy)butyl]carbamoyl, N-(3-dodecyloxy-2-methylpropylcarbamoyl, N-[3-(4-t-octylphenoxy)propyl]carbamoyl, N-hexadecyl-N-methylcarbamoyl, N-(3-dodecyloxypropyl)sulfamoyl, and N-[4-(2,4-di-t-pentylphenoxy)butyl]sulfamoyl. Particularly preferably $R_1^C$ is $-CONR_4^CR_5^C$.

$R_2^C$ is most preferably an unsubstituted one, that is, l=0 is most preferable and l=1 is preferable. Preferably $R_2^c$ is a halogen atom, an alkyl group (e.g., methyl, isopropyl, t-butyl, and cyclopentyl), a carbonamido group (e.g., acetamido, pivalinamido, trifluoroacetamido, and benzamido), a sulfonamido group (e.g., methanesulfon-amido and toluenesulfonamido) or a cyano group.

$R_3^C$ preferably is one wherein in formula (II-1) p=0, more preferably when $R_7^C$ is $-COR_8^C$ [e.g., formyl, acetyl, trifluoroacetyl, 2-ethylhexanoyl, pivaloyl, benzoyl, pentafluorobenzoyl, and 4-(2,4-di-t-pentylphenoxy)butanoyl], $-COOR_{10}^C$ [e.g., methoxycarbonyl, ethoxycarbonyl, isobutoxycarbonyl, 2-ethylhexyloxycarbonyl, n-dodecyloxycarbonyl, and 2-methoxyethoxycarbonyl], or $-SO_2R_{10}^C$ [e.g., methylsulfonyl, n-butylsulfonyl, n-hexadecylsulfonyl, phenylsulfonyl, p-tolylsulfonyl, p-chlorophenylsulfonyl, and trifluoromethylsulfonyl], and particularly preferably when $R_7^C$ is $-COOR_{10}^C$.

Preferably $X_1^C$ is a hydrogen atom, a halogen atom, $-OR_{11}^C$ [e.g., an alkoxy group such as ethoxy, 2-hydroxyethoxy, 2-methoxyethoxy, 2-(2-hydroxyethoxy)ethoxy, 2-methylsulfonylethoxy, ethoxycarbonylmethoxy, carboxymethoxy, 3-carboxypropoxy, N-(2-methoxyethyl)carbamoylmethoxy, 1-carboxytridecyloxy, 2-methanesulfonamidoethoxy, 2-(carboxymethylthio)ethoxy, and 2-(1-carboxytridecylthio)e-thoxy, and an aryloxy group, such as 4-cyanophenoxy, 4-carboxyphenoxy, 4-methoxyphenoxy, 4-t-octylphenoxy, 4-nitrophenoxy, 4-(3-carboxypropaneamido)-phenoxy, and 4-acetamidophenoxy], or —$SR_{11}^C$ [e.g., an alkylthio group, such as carboxymethylthio, 2-carboxymethylthio, 2-methoxyethylthio, ethoxycarbonylmethylthio, 2,3-dihydroxypropylthio, and 2-(N,N-dimethylamino)ethylthio and an arylthio group, such as 4-carboxyphenylthio, 4-methoxyphenylthio, and 4-(3-carboxypropaneamido)phenylthio, particularly preferably a hydrogen atom, a chlorine atom, an alkoxy group, or an alkylthio group.

The coupler represented by formula (C-I) may form a dimer or higher polymer by bonding at the substituent $R_1^C$, $R_2^C$, $R_3^C$, or $X_1^C$ through a divalent group or higher polyvalent group. In that case, the total C-number may fall outside the total C-number defined for each substituent.

When the coupler represented by formula (C-I) forms a polymer, typical examples of the polymer are homopolymers and copolymers of addition polymerizable ethylenically unsaturated compounds that have a cyan dye forming coupler residue (cyan-forming monomers), which are preferably represented by formula (II-2): formula (II-2)

$$-(G_i)_{gi}-(H_j)_{hj}-$$

wherein $G_i$ represents a repeating unit which is derived from a color forming monomer and is a group represented by formula (II-3), $H_j$ is a repeating unit which is derived from a non-color forming monomer and is represented by formula (II-3), i is a positive integer, j is 0 or a positive integer, and gi and hi each represent percent by weight of $G_i$ and $H_i$ respectively, and when i or j is 2 or over, it means that two or more $G_i$s or $H_j$s are present.

formula (II-3)

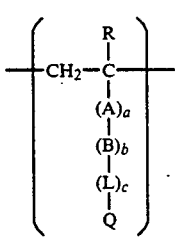

In formula (II-3), R represents a hydrogen atom, an alkyl group having 1 to 4 carbon atoms, or a chlorine atom, A represents —CONH—, —COO—, or a substituted or unsubstituted phenylene group, B represents a divalent group having a carbon atom at each end such as an unsubstituted alkylene group, phenylene group, and oxydialkylene group, L represents —CONH—, —NHCONH—, —NHCOO—, —NHCO—, —OCONH—, —NH—, —COO—, —OCO—, —CO—, —O—, —$SO_2$—, $NHSO_2$—, or —$SO_2NH$—, a, b, and c each are an integer of 0 or 1, and Q represents a cyan coupler residue formed by removing a hydrogen atom from $R_1^C$, $R_2^C$, $R_3^C$, or $X_1^c$ of the compound represented by formula (C-I).

The non-color forming ethylenically-unsaturated monomer that gives the repeating unit $H_j$ and does not couple with the oxidation product of an aromatic primary amine developing agent includes, for example, acrylic acid, α-chloroacrylic acid, an α-alkylacrylic acid, an amide or an ester derived from these acrylic acids (e.g., acrylamide, methacrylamide, n-butylacrylamide, t-butylacrylamide, diacetone acrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, and β-hydroxyethyl methacrylate), a vinyl ester (e.g., vinyl acetate, vinyl propionate, and vinyl laurate), acrylonitrile, methacrylonitrile, an aromatic vinyl compound (e.g., styrene and its derivatives such as vinyltoluene, divinylbenzene, vinylacetophenone, and sulfostyrene), itaconic acid, citraconic acid, crotonic acid, vinylidene chloride, a vinyl alkyl ether (e.g., vinyl ethyl ether), a maleate, N-vinyl-2-pyrrolidone, N-vinylpyridine, and 2- and 4-vinylpyridine.

Particularly, an acrylate, a methacrylate, and a maleate are preferred. These non-color forming ethylenically unsaturated monomers used herein may be used as a mixture of two or more. For example, a combination of methyl acrylate with butyl acrylate, a combination of butyl acrylate with styrene, a combination of butyl methacrylate with methacrylic acid, and a combination of methyl acrylate with diacetoneacrylamide can be used.

As is well known in the field of polymer couplers, the ethylenically unsaturated monomer to be copolymerized with the vinyl monomer corresponding to formula (II-3) given above can be selected so that, for example, the form of the copolymer to be formed, such as the solid state, the liquid state, or the micell state, or the physical properties and/or the chemical properties thereof, such as the solubility (solubility in water or an organic solvent), the compatibility with the binder of the photographic colloid composition, for example with the gelatin, its flexibility, its heat stability, the coupling reactivity with the oxidized product of a developing agent, and the ballasting properties in the photographic colloid, may be influenced favorably. The copolymer may be a random copolymer or a copolymer having a special sequence (e.g., a block copolymer or an alternating copolymer).

Although the number-average molecular weight of the cyan polymer coupler used in the present invention is generally on the order of from thousands to millions, a polymer coupler having a number-average molecular weight of 5000 or less in the form of an oligomer can also be employed.

The cyan polymer coupler used in the present invention may be a lipophilic polymer soluble in an organic solvent (e.g., ethyl acetate, butyl acetate, ethanol, methylene chloride, cyclohexanone, dibutyl phthalate, and tricresyl phosphate), a hydrophilic polymer miscible with a hydrophilic colloid such as an aqueous gelatin solution, or a polymer of such structure and properties that it can form micelles in a hydrophilic colloid.

If a lipophilic polymer coupler soluble in an organic solvent is to be obtained, generally it is preferable to select as a copolymer component a lipophilic non-color-forming ethylenically-unsaturated monomer (e.g., an acrylate, a methacrylate, a maleate, and vinylbenzene).

The lipophilic polymer coupler obtained by polymerization of a vinyl monomer that will give the coupler unit represented by formula (II-3) given above may be dissolved in an organic solvent, and the solution may be emulsified and dispersed into an aqueous gelatin solution to form a latex, or the lipophilic polymer coupler may be prepared directly by emulsion polymerization.

To emulsify and disperse the lipophilic polymer coupler into an aqueous gelatin solution to form a latex, the method described in U.S. Pat. No. 3,451,820 can be used, and with respect to the emulsion polymerization, the methods described in U.S. Pat. Nos. 4,080,211 and 3,370,952 can be used.

To obtain a hydrophilic polymer coupler soluble in neutral or alkaline water, a hydrophilic non-color forming ethylenically-unsaturated monomer such as N-(1,1-dimethyl-2-sulfonatoethyl)acrylamide, 3-sulfonatopropyl acrylate, sodium styrenesulfonate, potassium styrenesulfinate, acrylamide, methacrylamide, acrylic acid, methacrylic acid, N-vinylpyrrolidone, and N-vinylpyridine, is preferably used as a copolymer component.

The hydrophilic polymer coupler can be added, in the form of an aqueous solution, to a coating liquid; or the hydrophilic polymer coupler can be dissolved in a mixed solvent of water and an organic solvent miscible with water, such as a lower alcohol, tetrahydrofuran, acetone, ethyl acetate, cyclohexanone, ethyl lactate, dimethylformamide, and dimethylacetamide, or in an alkali aqueous solution or an alkali-water-containing organic solvent; and then the solution can be added to a coating liquid. A small amount of a surface-active agent may also be added.

Specific examples of the substituents in formula (C-I) and the cyan coupler represented by formula (C-I) are shown below.

Examples of $R_1^c$ $-CONH(CH_2)_3O-A$ $-CONH(CH_2)_4O-A$
$-CONH(CH_2)_3OC_{12}H_{25}\text{-}n$ $-CONH(CH_2)_3OC_{10}H_{21}\text{-}n$ $-CONH(CH_2)_3OCH_2CH(C_2H_5)C_4H_9\text{-}n$ $-CONHC_{16}H_{33}\text{-}n$ $-CONHCH_2CH(CH_3)CH_2C_{12}H_{25}\text{-}n$ $-CONH(CH_2CH_2O)_2C_{12}H_{25}\text{-}n$
$-CONHCH_2CH_2OC_{12}H_{25}\text{-}n$

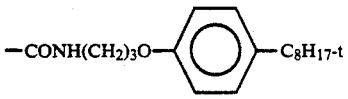

$-CONHCH_2CH(C_6H_{13})C_8H_{17}\text{-}n$

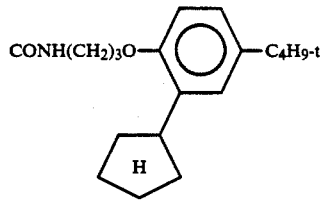

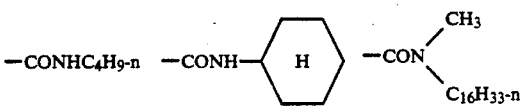

$-CONH(CH_2)_3OC_{14}H_{29}\text{-}n$ $-CONH(CH_2)_3OC_{11}H_{23}\text{-}n$
$-SO_2NH(CH_2)_3OC_{12}H_{25}\text{-}n$

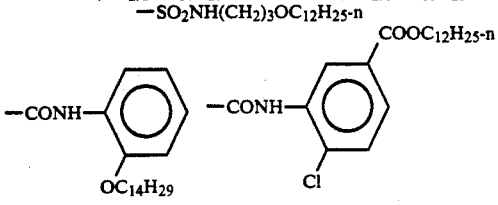

-continued

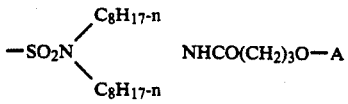

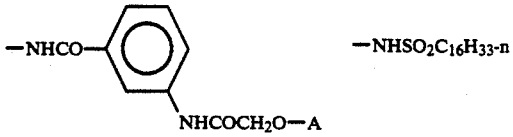

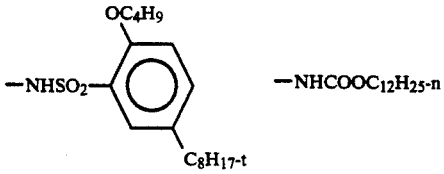

Examples of $R_2^c$ $-F$ $-Cl$ $-CN$ $-CH_3$ $-CF_3$ $-C_4H_{9}\text{-}t$ $-C_8H_{17}\text{-}t$
$-NHCOCH_3$ $-NHSO_2CH_3$ $-NHCOOC_2H_5$

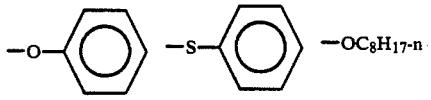

Examples of $R_3^cNH-$ $-NHCOCH_3$ $-NHCOCF_3$

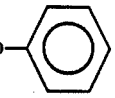

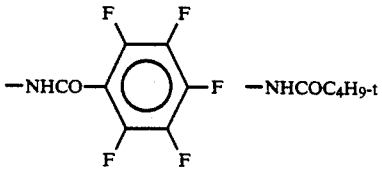

$-NHCO(CH_2)_3O-A$

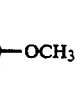

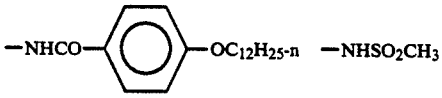

$-NHSO_2CF_3$ $-NHSO_2C_4H_{9}\text{-}n$

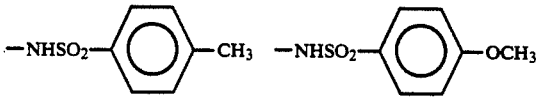

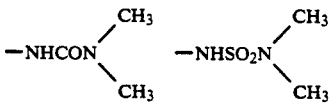

-continued

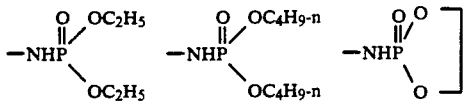

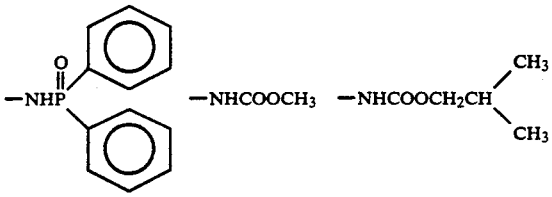

$-NHCOOC_4H_{9}$-n $-NHCOOCH_2CH_2OCH_3$ $-NHCOOCH_2CH(C_2H_5)C_4H_9$ $-NHCOOC_{12}H_{25}$-n $-NHCOOCH_2CH_2O-A$ $-NHCOCOCH_3$

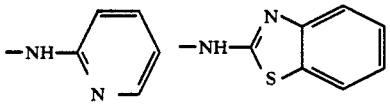

Examples of $X_1^c$ $-OC_2H_5$ $-OCH_2CH_2OH$ $-OCH_2CH_2SO_2CH_3$
$-O(CH_2CH_2O)_2H$ $-OCH_2COOH$ $-O(CH_2)_3COOH$
$-OCH_2COOC_2H_5$ $-OCH_2CONHCH_2CH_2OCH_3$ $-OCH_2CH_2SCH_2COOH$ $-OCH_2CH_2S(C_{12}H_{25}\text{-}n)CHCOOH$ $-OCH_2CH_2OCH_3$ $-OCH_2CH_2NHSO_2CH_3$

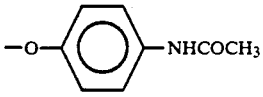

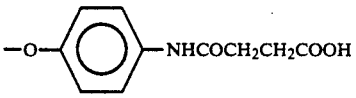

-continued

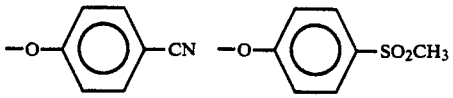

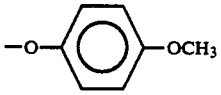

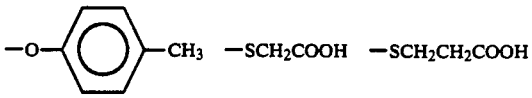

$-SCH(CH_3)COOH$ $-SCH_2COOC_2H_5$ $-SCH_2CH_2OH$

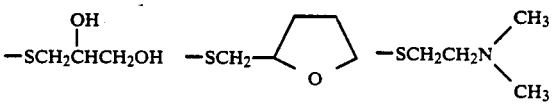

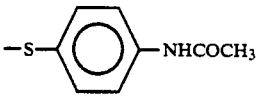

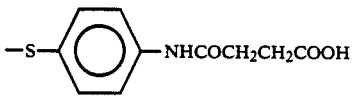

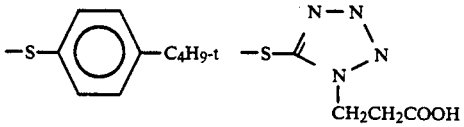

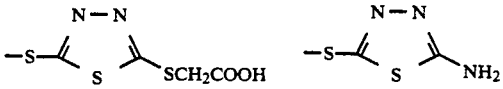

Specified examples of cyan coupler represented by formula (C-I)

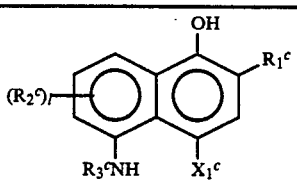

| No. | $R_1^c$ | $R_3^c$ | $X_1^c$ |
|---|---|---|---|
| IC-1 | $-CONH(CH_2)_3O-A$ | $CH_3CO-$ | H |
| IC-2 | $-CONH(CH_2)_3O-A$ | $CF_3CO-$ | H |
| IC-3 | $-CONH(CH_2)_3O-A$ | $CH_3SO_2-$ | H |
| IC-4 | $-CONH(CH_2)_3O-A$ | $C_2H_5OCO-$ | H |
| IC-5 | $-CONH(CH_2)_4O-A$ | t-$C_4H_9CO-$ | H |
| IC-6 | $-CONH(CH_2)_3O-C_{12}H_{25}$-n | $C_2H_5OCO-$ | H |
| IC-7 | $-CONH(CH_2)_3O-C_{12}H_{25}$-n | i-$C_4H_9OCO-$ | H |
| IC-8 | $-CONH(CH_2)_3OC_{10}H_{21}$-n | i-$C_4H_9OCO-$ | H |
| IC-9 | $-CONH(CH_2)_3OC_{10}H_{21}$-n | $n\text{-}C_4H_9CH(C_2H_5)CH_2OCO-$ | H |
| IC-10 | $-CONH(CH_2)_3O-A$ | i-$C_4H_9OCO-$ | H |

-continued

| | | | |
|---|---|---|---|
| IC-11 | 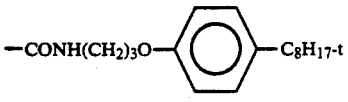 | i-$C_4H_9OCO$— | H |
| IC-12 | —$CONHCH_2CH(CH_3)CH_2OC_{12}H_{25}$-n | i-$C_4H_9OCO$— | H |
| IC-13 | —$CONH(CH_2)_3OCH_2CH(C_2H_5)C_4H_9$ | n-$C_6H_{17}OCO$— | H |
| IC-14 | 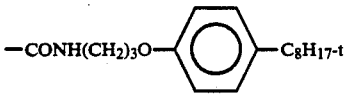 | n-$C_4H_9SO_2$— | H |
| IC-15 | —$CONH(CH_2)_3OC_{12}H_{25}$-n | $(C_2H_5O)_2P(=O)$— | H |
| IC-16 | —$CONH(CH_2)_3O$—A | 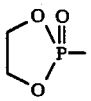 | H |
| IC-17 | —$CONHCH_2CH_2OC_{12}H_{25}$-n | i-$C_4H_9OCO$— | H |
| IC-18 | —$CON(CH_3)(C_{16}H_{33}$-n) | $C_2H_5OCO$— | H |
| IC-19 | —$CONHCH_2CH_2OCOC_{11}H_{23}$-n | i-$C_4H_9OCO$— | H |
| IC-20 | —$CONHC_{12}H_{25}$-n | n-$C_4H_9CH(CH_3)CH_2OCO$— | H |
| IC-21 | —$SO_2NH(CH_2)_3OC_{12}H_{25}$-n | i-$C_4H_9OCO$— | H |
| IC-22 | —$SO_2N(CH_3)(C_{18}H_{37}$-n) | $C_2H_5OCO$— | H |
| IC-23 | —$CONHCH_2CH(C_6H_{13}$-n)$C_8H_{17}$-n | i-$C_4H_9OCO$— | H |
| IC-24 | —$CONH(CH_3)_3OC_{12}H_{25}$-n | 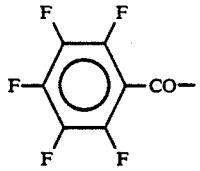 | H |
| IC-25 | 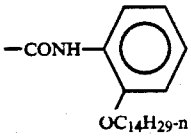 | $CH_3SO_2$— | H |
| IC-26 | 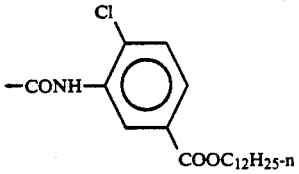 | 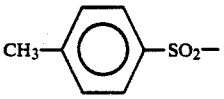 | H |
| IC-27 | —$CONH(CH_2)_3OC_{12}H_{25}$-n | i-$C_4H_9OCO$— | Cl |

-continued

| | | | |
|---|---|---|---|
| IC-28 | $-CONH(CH_2)_3OC_{12}H_{25}$-n | n-$C_4H_9OCO-$ | Cl |
| IC-29 | $-CONH(CH_2)_3OC_{14}H_{29}$-n | t-$C_4H_9CO-$ | Cl |
| IC-30 | $-CONH(CH_2)_3OC_{12}H_{25}$-n | i-$C_4H_9OCO-$ | $-OCH_2CH_2OH$ |
| IC-32 | $-CONH(CH_2)_3OC_{12}H_{25}$-n | i-$C_4H_9OCO-$ | $-O(CH_2CH_2O)_2H$ |
| IC-33 | $-CONH(CH_2)_3OC_{12}H_{25}$-n | i-$C_4H_9OCO-$ | $-OCH_2CH_2OCH_3$ |
| IC-34 | $-CONH(CH_2)_3OC_{12}H_{25}$-n | i-$C_4H_9OCO-$ | $-OCH_2CH_2SCH_2COOH$ |
| IC-35 | $-CONHC_4H_9$-n | i-$C_4H_9OCO-$ | $-OCH_2CH_2S\overset{COOH}{\overset{\vert}{C}}HC_{12}H_{25}$-n |
| IC-36 | $-CONHCH_2\overset{CH_3}{\overset{\vert}{C}}HCH_2OC_{12}H_{25}$-n | i-$C_4H_9OCO-$ | $-O(CH_2)_3COOH$ |
| IC-37 | $-CONH(CH_2)_4O-A$ | i-$C_4H_9OCO-$ | 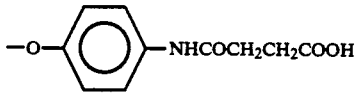 |
| IC-38 | $-CONH(CH_2)_3O-A$ | i-$C_4H_9OCO-$ | 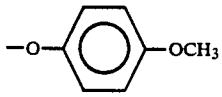 |
| IC-39 | 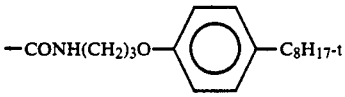 | i-$C_4H_9OCO-$ | $-SCH_2COOH$ |
| IC-40 | $-CONH(CH_2)_3OC_{12}H_{25}$-n | i-$C_4H_9OCO-$ | $-SCH_2CH_2COOH$ |
| IC-41 | $-CONH(CH_2)_3OC_{12}H_{25}$-n | i-$C_4H_9OCO-$ | $-SCH_2CH_2OH$ |
| IC-42 | $-CONH(CH_2)_4O-A$ | $CH_3SO_2-$ | 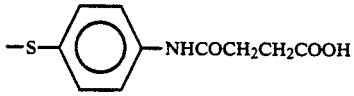 |
| IC-43 | $-SO_2NH(CH_2)_3O-A$ | n-$C_4H_9SO_2-$ | $-OCH_2CH_2OH$ |
| IC-44 | $-CONHCH_2\overset{CH_3}{\overset{\vert}{C}}HCH_2OC_{12}H_{25}$-n | i-$C_4H_9OCO-$ | $-OCH_2CH_2OH$ |
| IC-45 | $-CONH(CH_2CH_2O)\ C_{12}H_{25}$-n | $(C_2H_5O)_2\overset{O}{\overset{\Vert}{P}}-$ | $-OCH_2CH_2OCH_3$ |
| IC-46 | $-CONH(CH_2)_4O-A$ | t-$C_4H_9CO-$ | $-OCH_2COOC_2H_5$ |

Coupler of l = O

IC-47

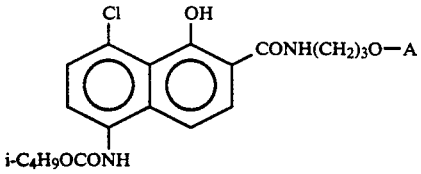

IC-48

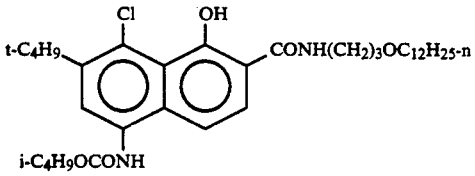

IC-49

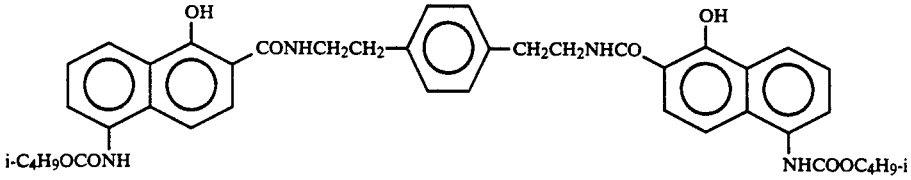

-continued
IC-50
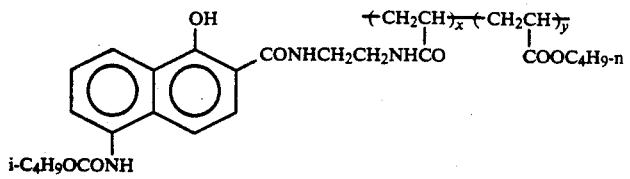
x:y = 60:40
Number-average Molecular Weight: ca. 60,000
IC-51
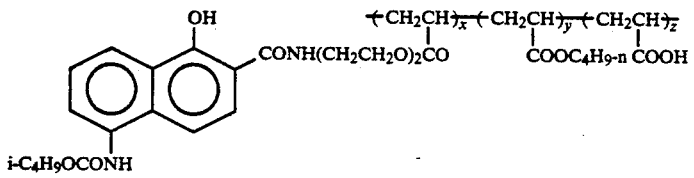
x:y:z = 50:40:10
Number-average Molecular Weight: ca. 50,000
IC-52
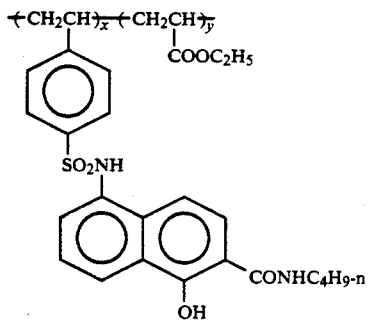
x:y = 70:30
Number-average Molecular Weight: ca. 55,000
IC-53
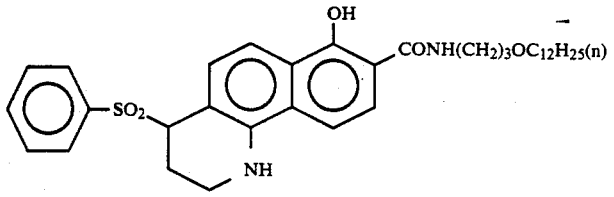
IC-54
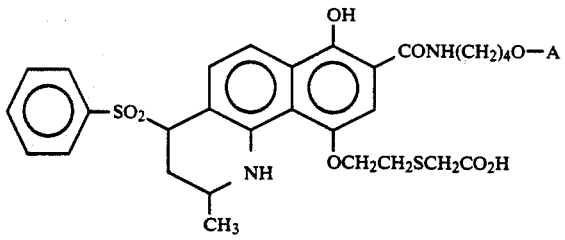
IC-55
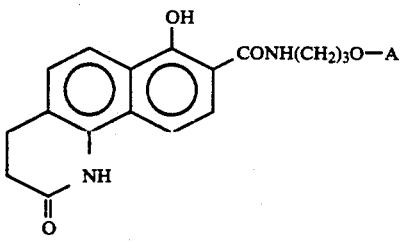
In the specific examples of IC-1 to IC-55 that are cyan couplers represented by formula (C-I) A represents

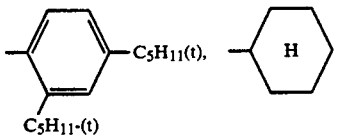

represents a cyclohexyl group,

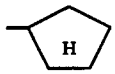

represents a cyclopentyl group, and —$C_8H_{17}$—t represents —$C(CH_3)_2CH_2C(CH_3)_3$.

Specific examples of cyan couplers represented by formula (C-I) other than those mentioned above and/or methods of synthesizing those compounds are described, for example, in U.S. Pat. No. 4,690,889, JP-A Nos. 237448/1985, 153640/1986, 145557/1986, 208042/1988, and 31159/1989, and West German Patent No. 3823049 A.

Cyan couplers represented by formula (C-II) or (C-III) contained in the present silver halide color photographic material, i.e., phenol type cyan couplers will now be described below in detail.

In formula (C-II) or (C-III), $R_{21}{}^C$ represents a straight-chain, branched-chain, or cyclic alkyl group having a C-number of 1 to 36 (preferably 1 to 24), which may be unsaturated and may be substituted, an aryl group having a C-number of 6 to 36 (preferably 6 to 24), which may be substituted, or a heterocyclic group having a C-number of 2 to 36 (preferably 2 to 24), which may be substituted. Herein by "heterocyclic group" is meant a 5to 7-membered heterocyclic group, which may be substituted, having at least one heteroatom selected from the group consisting of N, O, S, P, Se, and Te and, for example, 2-furyl, 2-thienyl, 4-pyridine, 2-imidazolyl, and 4-quinolyl can be mentioned. An example of a substituent on $R_{21}{}^C$ includes a halogen atom, a cyano group, a nitro group, a carboxyl group, a sulfo group, an alkyl group, an aryl group, a heterocyclic group, an alkoxy group, an aryloxy group, an alkylthio group, an arylthio group, an alkylsulfonyl group, an arylsulfonyl group, an alkoxycarbonyl group, an aryloxycarbonyl group, an acyl group, a carbonamido group, a sulfonamido group, a carbamoyl group, a sulfamoyl group, a ureido group, an alkoxycarbonylamino group, or a sulfamoyl group (which are called hereinafter a substituent group A). The substituent is preferably, for example, a halogen atom (e.g., F, Cl, Br, and I), a cyano group, an alkyl group, an aryloxy group, an alkylsulfonyl group, an arylsulfonyl group, a carbonamido group, or a sulfonamido group.

In formula (C-II), $R_{21}{}^C$ is preferably an alkyl group and in formula (C-III), $R_{21}{}^C$ is preferably an alkyl group or an aryl group.

In formula (C-II), $R_{22}{}^C$ represents a straight-chained, branched-chain, or cyclic alkyl group having a C-number of 1 to 36 (preferably 1 to 24). $R_{22}{}^C$ is preferably an alkyl group having a C-number of 1 to 8 (e.g., methyl, ethyl, propyl, isopropyl, t-butyl, and cyclopentyl).

In formula (C-II) or (C-III), $R_{23}{}^C$ is a hydrogen atom, a halogen atom (e.g., F, Cl, Br, and I), a straight-chain, branched-chain, or cyclic alkyl group having a C-number of 1 to 16 (preferably 1 to 8), an aryl group having a C-number of 6 to 24 (preferably 6 to 12), an alkoxy group having a C-number of 1 to 24 (preferably 1 to 8), an aryloxy group having a C-number of 6 to 24 (preferably 6 to 12), a carbonamido group having a C-number of 1 to 24 (preferably 2 to 12), or a ureido group having a C-number of 1 to 24 (preferably 1 to 12). Herein, if R23C is an alkyl group, an aryl group, an alkoxy group, an aryloxy group, a carbonamido group, or a ureido group, the group may be substituted by a substituent selected from the above substituent group.

In formula (C-II), $R_{23}{}^C$ is preferably a halogen atom, and in formula (C-III), $R_{23}{}^C$ is preferably a hydrogen atom, a halogen atom, an alkoxy group, or a carbonamido group with hydrogen being particularly preferred.

In formula (C-II), $R_{22}{}^C$ and $R_{23}{}^C$ may bond together to form a ring. Also, in formula (C-III), $R_{23}{}^C$ and $R_{24}{}^C$ may bond together to form a ring. In that case, $R_{23}{}^C$ may be a single bond or may be an imino group as a constituent of a ring.

In formula (C-III), $R_{24}{}^C$ has the same meaning as that of $R_{21}{}^C$ and is an alkoxy group having a C-number of 1 to 36 (preferably 1 to 24), an aryloxy group having a C-number of 6 to 36 (preferably 6 to 24), or an alkyl- or aryl-substituted amino group having a C-number of 1 to 36 (preferably 1 to 24). Preferably $R_{24}{}^C$ has the same meaning as that of $R_{21}{}^C$ and more preferably is an alkyl group.

In formula (C-II) or (C-III), $X_2{}^C$ represents a hydrogen atom or a coupling release group capable of being released upon a coupling reaction with the oxidized product of an aromatic primary amine developing agent. As examples of the coupling releasing group, a halogen atom (e.g., F, Cl, Br, and I), a sulfo group, an alkoxy group having a C-number of 1 to 36 (preferably 1 to 24), an aryloxy group having a C-number of 6 to 36 (preferably 6 to 24), an acyloxy group having a C-number of 2 to 36 (preferably 2 to 24), an alkyl- or aryl-sulfonyloxy group having a C-number of 1 to 36 (preferably 1 to 24), an alkylthio group having a C-number of 1 to 36 (preferably 1 to 24), an arylthio group having a C-number of 6 to 36 (preferably 6 to 24), an imido group having a C-number of 4 to 36 (preferably 4 to 24), a carbamoyloxy group having a C-number of 1 to 36 (preferably 1 to 24), and a heterocyclic group bonded to the coupling active site through the nitrogen atom (e.g., tetrazol-5-yl, pyrazolyl, imidazolyl, and 1,2,4-triazol-1-yl) can be mentioned. The groups mentioned after the alkoxy group may be substituted by a group selected from the above-mentioned substituent group A. $X_2{}^C$ preferably is a hydrogen atom, a fluorine atom, a chlorine atom, a sulfo group, an alkoxy group, or an aryloxy group, and particularly preferably a hydrogen atom or a chlorine atom.

In formula (C-II) or (C-III), n is an integer of 0 or 1, and preferably 0.

Examples of substituents of formula (C-II) or (C-III) are shown below.

Specific examples of the substituents in formula (C-II) or (C-III) other than those mentioned above and methods of synthesizing cyan couplers including them are described, for example, in U.S. Pat. Nos. 2,369,929, 2,772,162, 2,895,826, 3,772,002, 4,327,173, 4,333,999, 4,334,011, 4,430,423, 4,500,635, 4,518,687, 4,564,586, 4,609,619, 4,686,177, and 4,746,602, and JP-A No. 164555/1984.

Examples of $R_{21}{}^C$

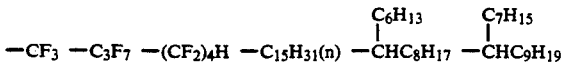
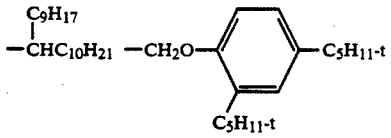
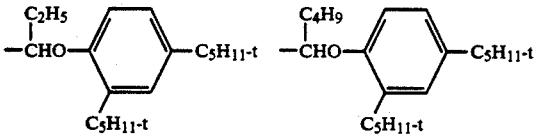
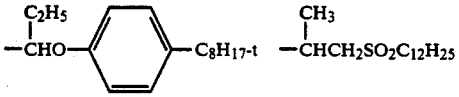
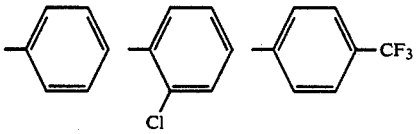
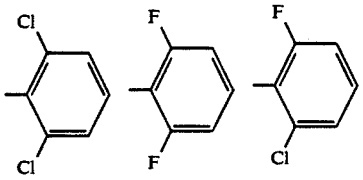
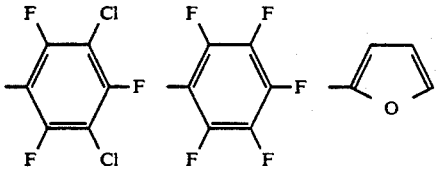
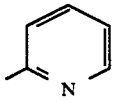
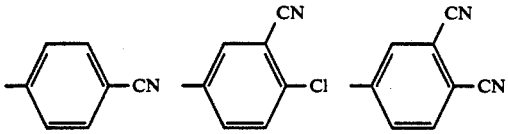
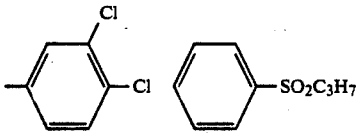
Examples of $R_{22}^c$
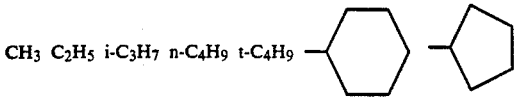
Examples of $R_{23}^c$
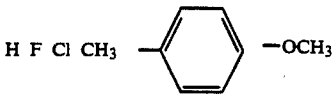
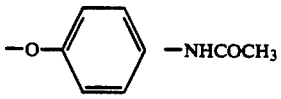
Examples of $R_{24}^c$ (in addition to examples of $R_{21}^c$)
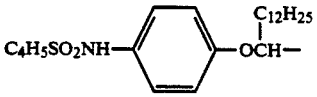
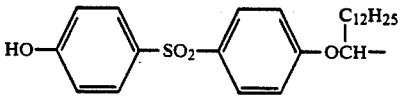
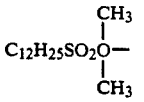
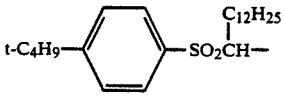
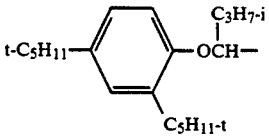
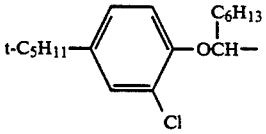
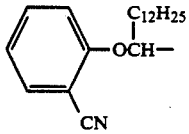
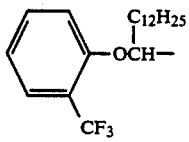
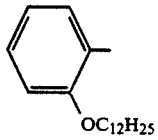
Examples of $X_2^c$ H F Cl Br I $SO_3H$ $-OCH_2COOCH_3$ $-OCH_2CH_2CH_2COOH$
$-OCH(CH_3)COOH$, $-OCH_2CH_2SCH_2COOH$,
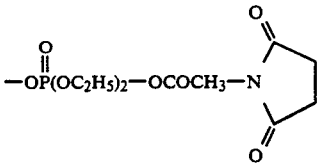
$-OSO_2CH_3$ $OCONHC_2H_5$
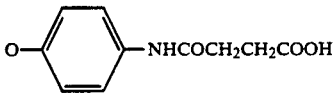
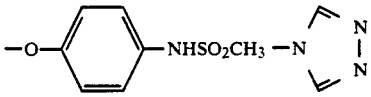
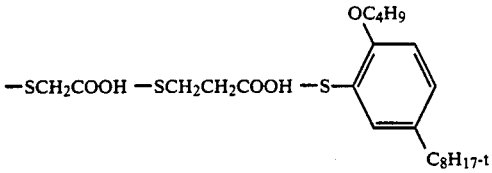
Examples of coupler represented by formula (C-II)
IIC-1
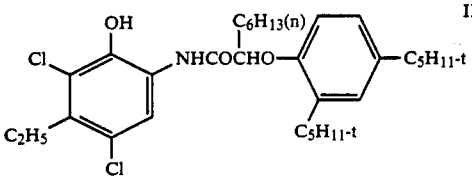
IIC-2
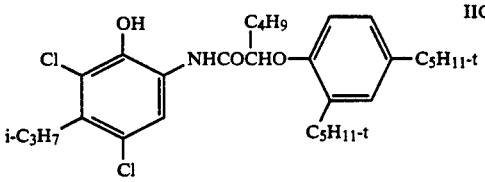
IIC-3
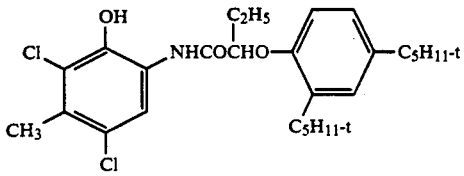
-continued
IIC-4
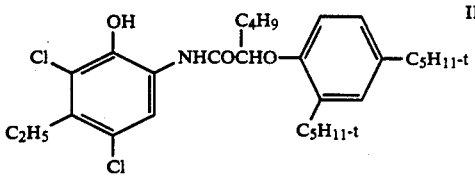
IIC-5
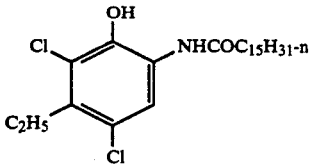
IIC-6
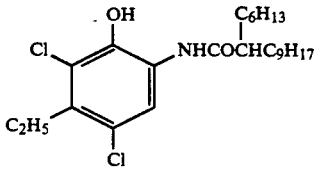
IIC-7
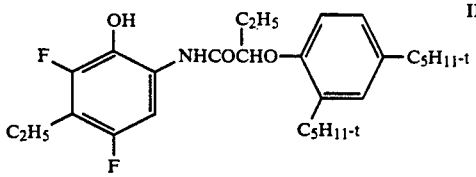
IIC-8
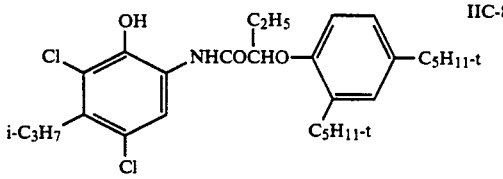
IIC-9
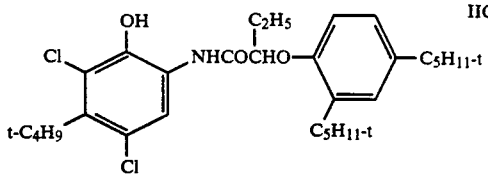
IIC-10
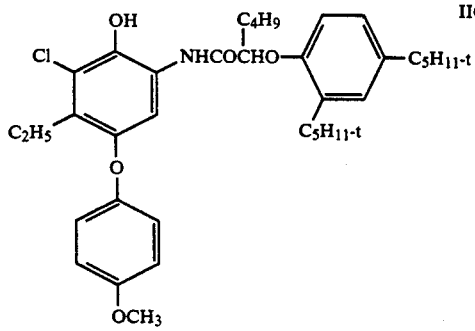
Examples of coupler represented by formula (C-III)

IIIC-11
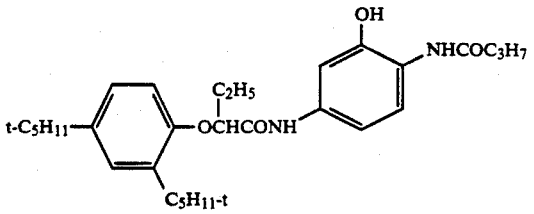
IIIC-12
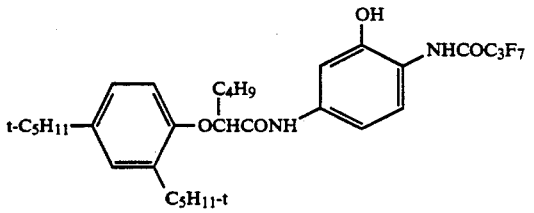
IIIC-13
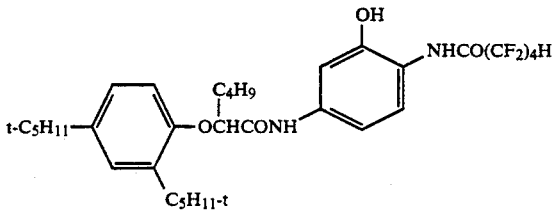
IIIC-14
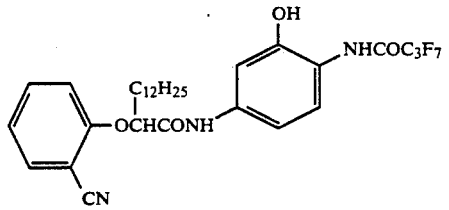
IIIC-15
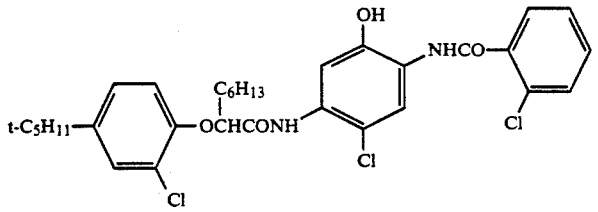
IIIC-16
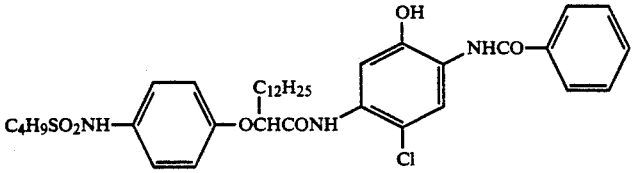
IIIC-17
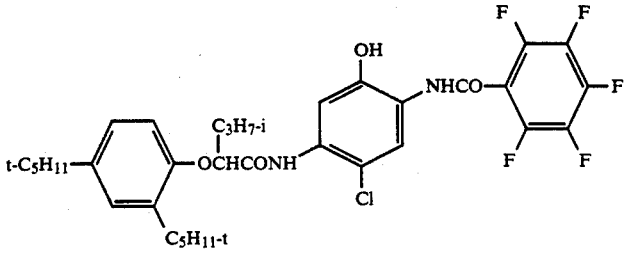

-continued
IIIC-18
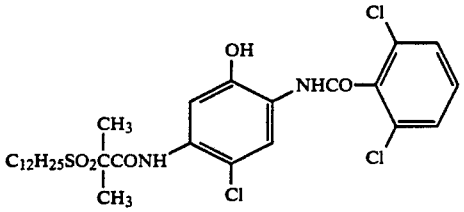
IIIC-19
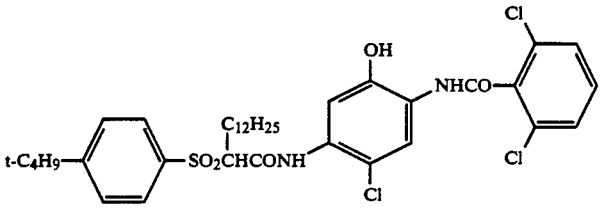
IIIC-20
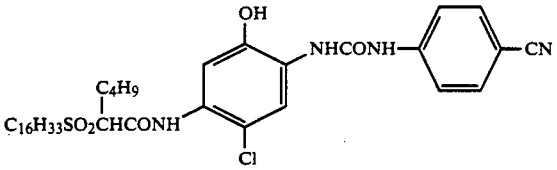
IIIC-21
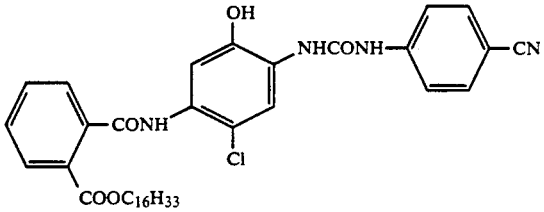
IIIC-22
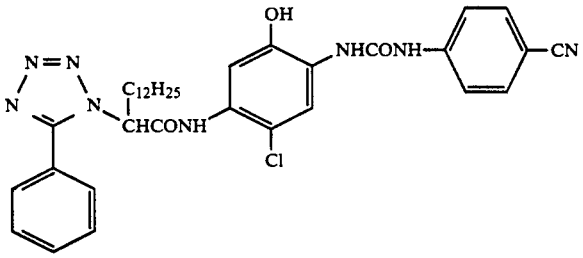
IIIC-23
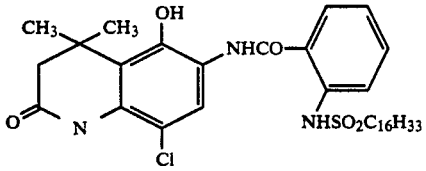
IIIC-24
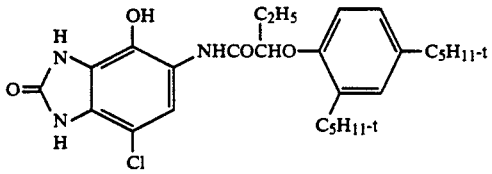

-continued

IIIC-25

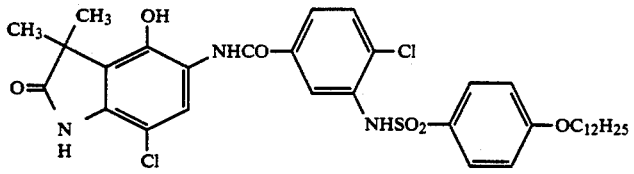

IIIC-26

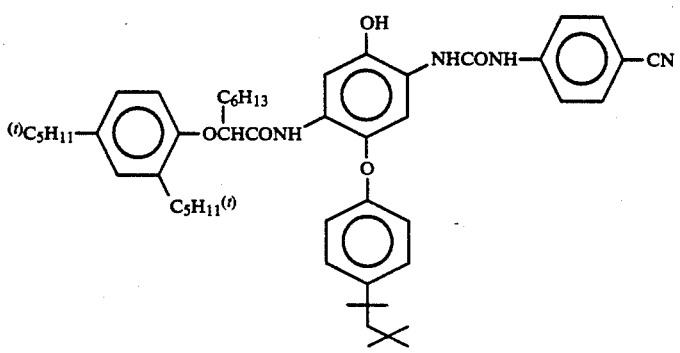

The compounds represented by formula (M) will be described in detail below.

Among the pyrazoloazole type couplers represented by formula (M), imidazo[1,2-b]pyrazoles described in U.S. Pat. No. 4,500,630, pyrazolo[1,5-b][1,2,4]triazoles described in U.S. Pat. No. 4,540,654, and pyrazolo[1,5-c][1,2,4]triazoles described in U.S. Pat. No. 3,725,067 are preferable because of the absorption properties of the color formed dyes.

Details of substitutes of azole rings represented by substituents $R_1^M$, $X_1^M$, and $Z^M$ are described, for example, in U.S. Pat. No. 4,540,654, second column, line 41 to eight column, line 27. Pyrazoloazole couplers wherein a branched alkyl group is directly linked to the 2-, 3- or 6-position of the pyrazolotriazole ring, pyrazoloazole couplers containing a sulfonamido group in the molecule described in JP-A No. 65246/1986, pyrazoloazole couplers having an alkoxyphenylsulofonamido ballasting group described in JP-A 147254/1986, pyrazolotriazole couplers having an alkoxy group or an aryloxy group in the 6-position described in JP-A No. 307453/1988, and pyrazolotriazole couplers having a carbonamido group in the molecule described in Japanese Patent Application No. 22279/1989 are preferable.

Out of these couplers, specific examples of the pyrazolotriazole couplers are mentioned below.

| Compound | $R_1^M$ | $R_2^M$ | $X^M$ |
|---|---|---|---|
| | | 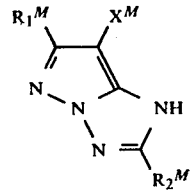 | |
| M-1 | $CH_3$— | 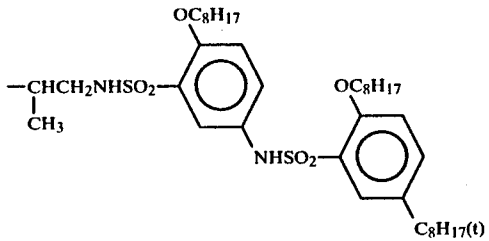 | Cl |
| M-2 | The same as the above | 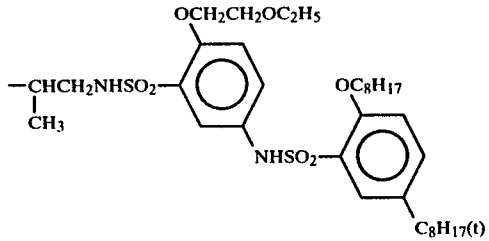 | The same as the above |
| M-3 | The same as the above | 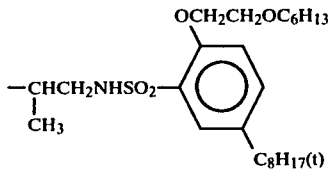 | The same as the above |
| M-4 | The same as the above | 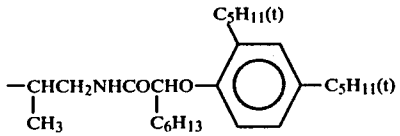 | The same as the above |

-continued
| Compound | $R_1^M$ | $R_2^M$ | $X^M$ |
|---|---|---|---|
| M-5 | The same as the above | 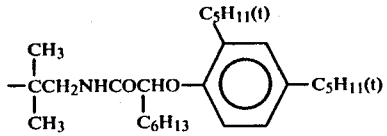 | The same as the above |
| M-6 | 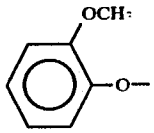 | 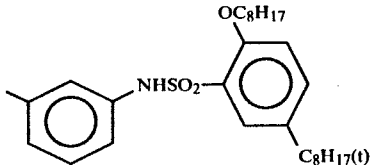 | 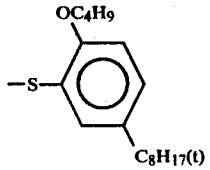 |
| M-7 | The same as the above | 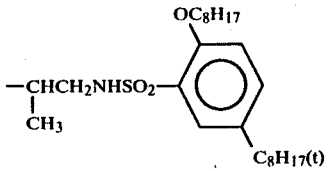 | The same as the above |
| M-8 | 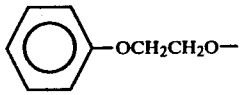 | 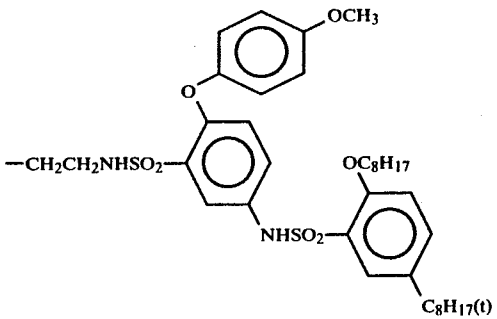 | The same as the above |
| M-9 | 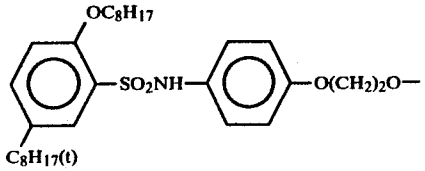 | 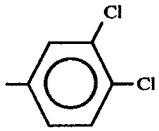 | 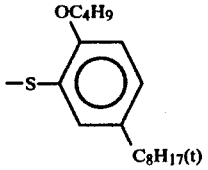 |

-continued
| Compound | $R_1^M$ | $R_2^M$ | $X^M$ |
|---|---|---|---|
| M-10 | $(CH_3)_2CH-O-$ | 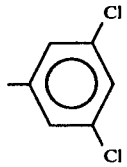 | The same as the above |
| M-11 | $C_2H_5-$ | 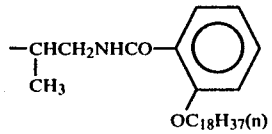 | 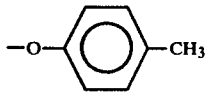 |
| M-12 | $CH_3-$ | 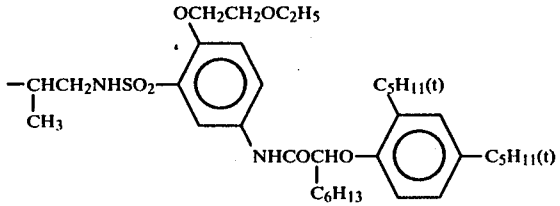 | Cl |
| M-13 | 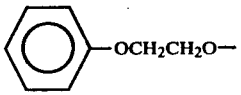 | 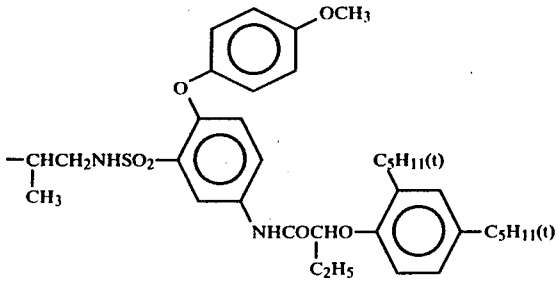 | 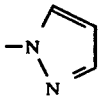 |

-continued
| Compound | $R_1^M$ | $R_2^M$ | $X^M$ |
|---|---|---|---|
| M-14 | The same as the above | 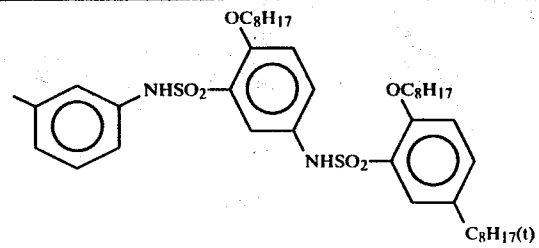 | 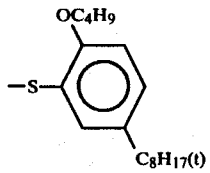 |
| M-15 | 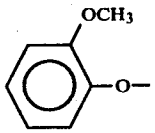 | 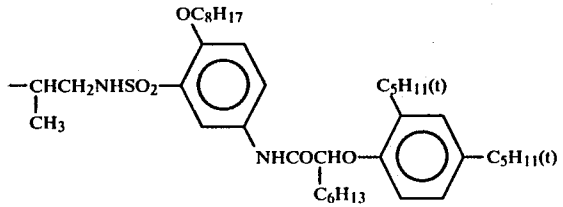 | Cl |
| M-16 | The same as the above | The same as the above | 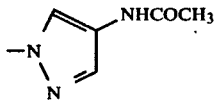 |
| M-17 | 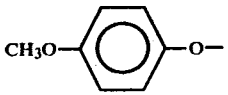 | 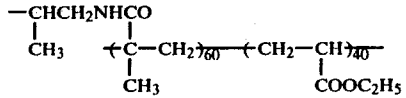 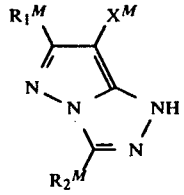 | 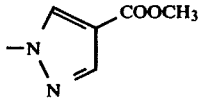 |
| M-18 | $CH_3$— | 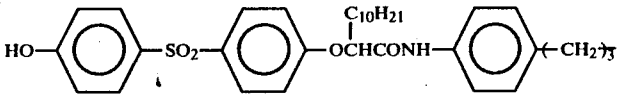 | Cl |

-continued
| Compound | $R_1^M$ | $R_2^M$ | $X^M$ |
|---|---|---|---|
| M-19 | The same as the above | 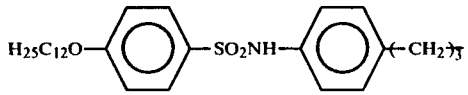 | The same as the above |
| M-20 | The same as the above | 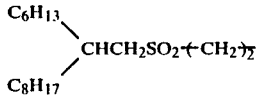 | The same as the above |
| M-21 | 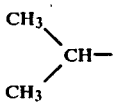 | 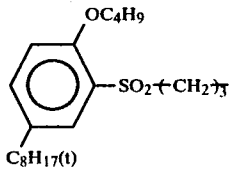 | The same as the above |
| M-22 | $CH_3$— | 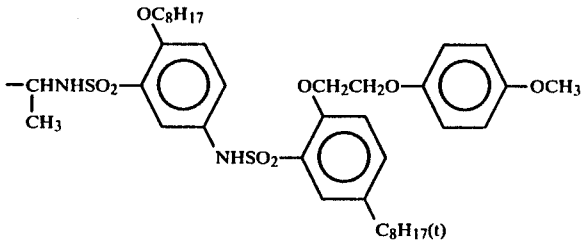 | The same as the above |
| M-23 | $C_2H_5$— | The same as the above | 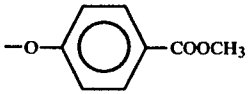 |

-continued
| Compound | $R_1^M$ | $R_2^M$ | $X^M$ |
|---|---|---|---|
| M-24 | The same as the above | 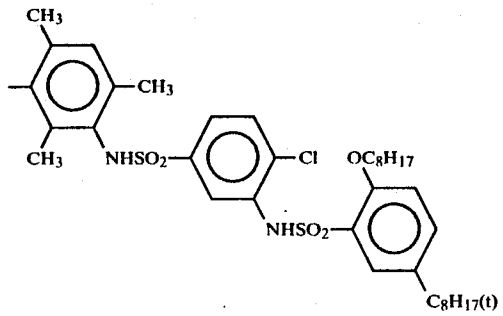 | The same as the above |
| M-25 | $CH_3$— | 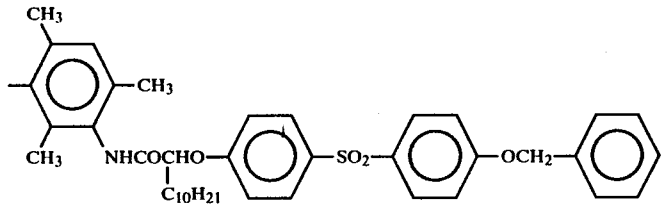 | Cl |
| M-26 | The same as the above | 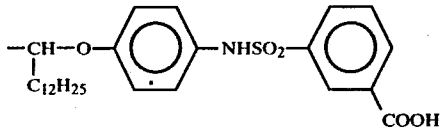 | The same as the above |
| M-27 | $CH_3$— | 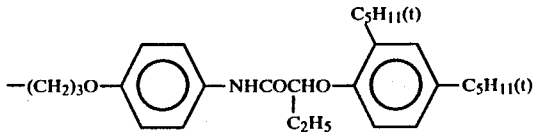 | Cl |

-continued
| Compound | $R_1^M$ | $R_2^M$ | $X^M$ |
|---|---|---|---|
| M-28 | $C_2H_5$— | 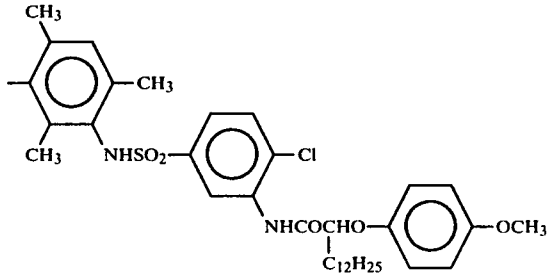 | 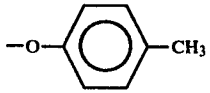 |
| M-29 | 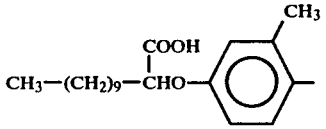 | 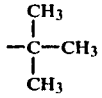 | Cl |
| M-30 | 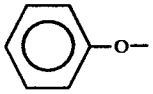 | 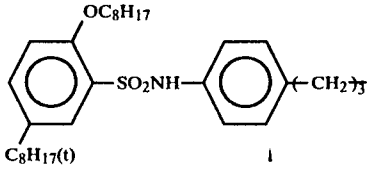 | The same as the above |
| M-31 | 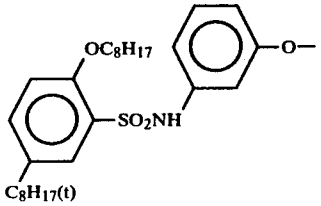 | $H_5C_2$— | The same as the above |
| M-32 | 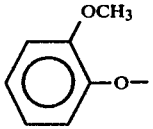 | $H_5C_2OOC$— | 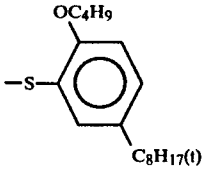 |

-continued
| Compound | $R_1^M$ | $R_2^M$ | $X^M$ |
|---|---|---|---|
| M-33 | $CH_3-C(CH_3)_2-$ | $H_{25}C_{12}SO_2-(CH_2)_3-$ | Cl |
| M-34 | $CH_3-$ | 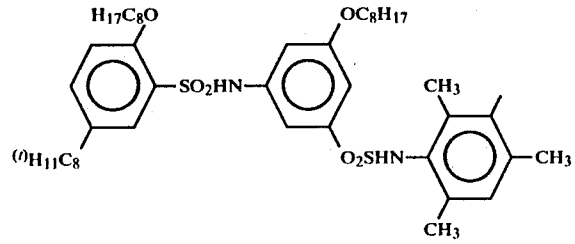 | The same as the above |

The couplers represented by formula (M) can be synthesized by the methods described in U.S. Pat. Nos. 4,540,654 and 4,705,863, and JP-A Nos. 65245/1986, 209457/1987, and 249155/1987, JP-B ("JP-B" means examined Japanese patent publication) No. 27411/1982, and U.S. Pat. No. 3,725,067.

The compounds represented by formula (m) will now be described in detail below.

Among the 5-pyrazolone type magenta couplers represented by formula (m), those wherein $R_1{}^m$ is an aryl group or an acyl group, Ar is a phenyl group substituted by one or more halogen atoms (particularly chlorine atoms), $X_m$ is a hydrogen atom or a coupling releasing group comprising an alkyl- or aryl-thio group, or an azolyl group are preferable.

Preferably, $R_1{}^m$ is an aryl group, such as phenyl, 2-chlorophenyl, 2-methoxyphenyl, 2-chloro-5-tetradecaneamidophenyl, 2-chloro-5-(3-octadecenyl-1-succinimido)phenyl, 2-chloro-5-octadecylsulfonamidophenyl or 2-chloro-5-[2-(4-hydroxy-3-tert-butylphenoxy)tetradecaneamido]phenyl, or an acyl group, such as acetyl, pivaloyl, tetradecanoyl, 2-(2,4-di-tert-pentylphenoxy)acetyl, 2-(2,4-di-tert-pentylphenoxy)butanoyl, benzoyl, and 3-(2,4-di-tert-amylphenoxyacetamido)benzoyl, which may be substituted, for example, by a halogen atom or an organic substituent linking through a carbon atom, an oxygen atom, a nitrogen atom, or a sulfur atom.

Ar is a substituted phenyl group, such as 2,4,6-trichlorophenyl, 2,5-dichlorophenyl, and 2-chlorophenyl.

A preferable coupling releasing group represented by $X^m$ is an alkyl- or aryl-thio group, such as dodecylthio, benzylthio, 1-carboxyldodecylthio, phenylthio, 2-butoxy-5-tert-octylphenylthio, 2,5-dioctyloxyphenylthio, 2-(2-ethoxyethoxy)-5-tert-octylphenylthio, 2-pivaloylaminophenylthio, or tetrazolylthio, or an azolyl group, such as 1-pyrazolyl, -benzotriazolyl, or 5-chloro-1,2,4-triazol-1-yl.

Preferable combinations of substituents of two-equivalent couplers having these coupling releasing groups are those described in JP-A Nos. 35858/1982 and 20826/1976.

Preferable specific examples of the couplers are listed below:

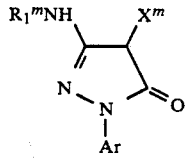

| Compound | $R_1{}^m$ | Ar | $X^m$ |
|---|---|---|---|
| m-1 | 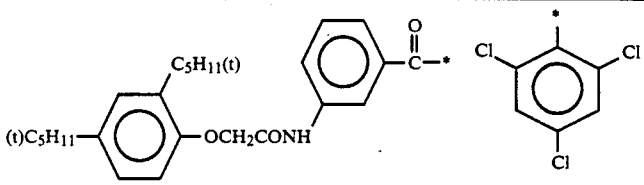 |  | H |
| m-2 | 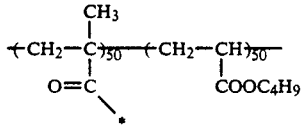 | 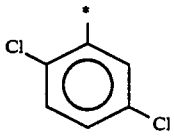 | The same as the above |
| m-3 | 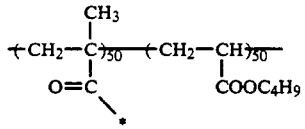 | 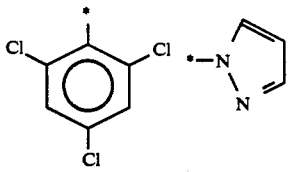 | |
| m-4 | 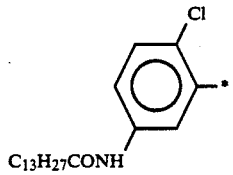 | The same as the above | H |
| m-5 | 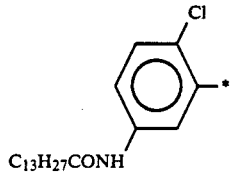 | 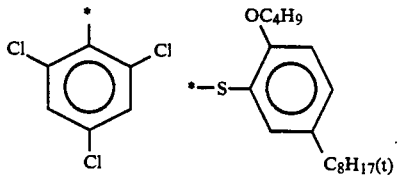 | |

-continued
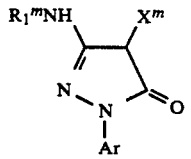
| Compound | $R_1^m$ | Ar | $X^m$ |
|---|---|---|---|
| m-6 | 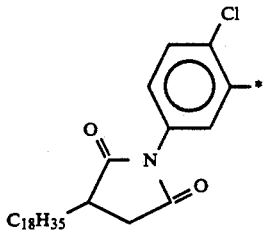 | The same as the above | H |
| m-7 | 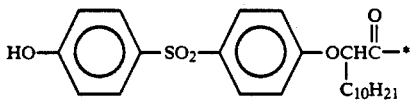 | The same as the above | The same as the above |
| m-8 | 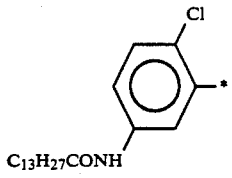 | 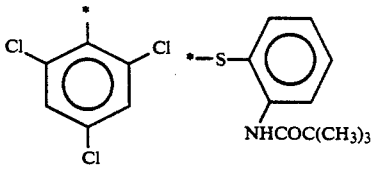 | |
| m-9 | 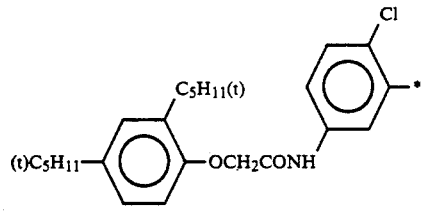 | The same as the above | The same as the above |
| m-10 | 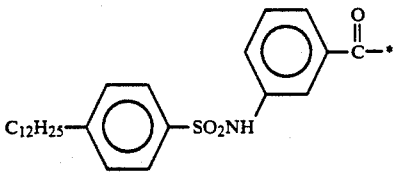 | The same as the above | H |
| m-11 | 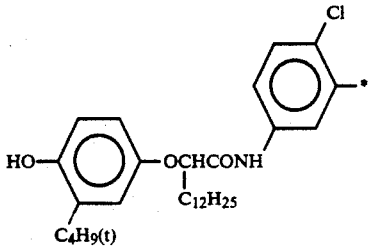 | The same as the above | The same as the above |
| m-12 | 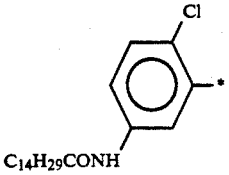 | The same as the above | The same as the above |

-continued

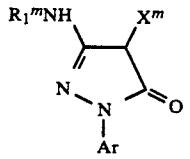

| Compound | $R_1^m$ | Ar | $X^m$ |
|---|---|---|---|
| m-13 | 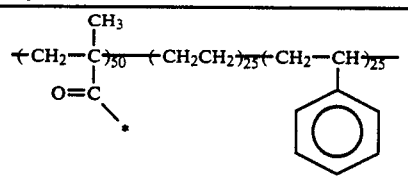 | The same as the above | 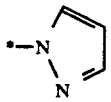 |
| m-14 | 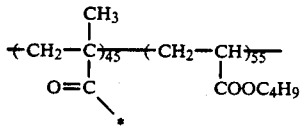 | 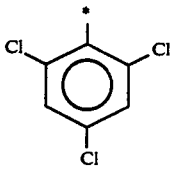 | H |
| m-15 | 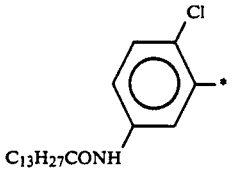 | 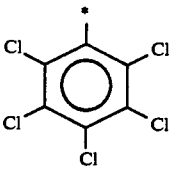 | The same as the above |
| m-16 | The same as the above | 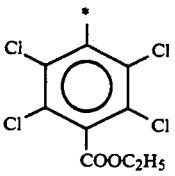 | The same as the above |
| m-17 | 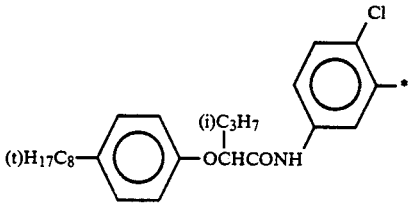 | 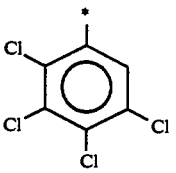 | The same as the above |

*; Bonding site

Methods of synthesizing typical two-equivalent couplers having a coupling releasing group are described in detail in JP-A Nos. 20826/1976 and 35858/1982.

Formula (A) will be described in more detail below.

$R_1^A$ represents a hydrogen atom or an alkyl group, which is a straight-chain, branched-chain, or cyclic alkyl group having a C-number of 1 to 16 which may be substituted by an alkenyl group, an alkynyl group, a hydroxyl group, a nitro group, a cyano group, a halogen atom, or a substituent which will be linked through an oxygen atom, a nitrogen atom, a sulfur atom, or a carbonyl group, such as methyl, ethyl, propyl, isopropyl, t-butyl, 2-hydroxyethyl, 3-hydroxypropyl, 2-methanesulfonamidoethyl, 3-methanesulfonamidopropyl, 2-methanesulfonylethyl, 2-methoxyethyl, cyclopentyl, 2-acetamidoethyl, 2-carboxyethyl, 2-carbamoylethyl, 3-carbamoylpropyl, n-hexyl, 2-hydroxypropyl, 4-hydroxybutyl, 2-carbamoylaminoethyl, 3-carbamoylaminopropyl, 4-carbamoylaminobutyl, 4-carbamoylbutyl, 2-carbamoyl-1-methylethyl, and 4-nitrobutyl, and preferably $R_1^A$ is a hydrogen atom or a methyl group.

$R_2^A$ and $R_3^A$, which may be the same or different, each represent a hydrogen atom, an alkyl group, an aryl group, or a heterocyclic group. More particularly $R_2^A$ and $R_3^A$ each represent a hydrogen atom, an alkyl group (which is a straight-chain, branched-chain, or cyclic alkyl group having a C-number of 1 to 16 which may be substituted by an alkenyl group, an alkynyl group, a hydroxyl group, a nitro group, a cyano group, a halogen atom, or a substituent which will be linked through an oxygen atom, a nitrogen atom, a sulfur atom, or a carbonyl group, such as methyl, ethyl, propyl, isopropyl, t-butyl, 2-hydroxyethyl, 3-hydroxypropyl, 2-methanesulfonamido- ethyl, 3-methanesulfonamidopropyl, 2-methanesulfonylethyl, 2-methoxyethyl, cyclopentyl, 2-acetamidoethyl, 2-carboxyethyl, 2-carbamoylethyl, 3-carbamoylpropyl, n-hexyl, 2-hydroxypropyl, 4-hydroxybutyl, benzyl, 2-carbamoylaminoethyl, 3-carbamoylaminopropyl, 4-carbamoylaminobutyl, 4-carbamoylbutyl, 2-carbamoyl-1-methylethyl, 4-nitrobutyl, 3-sulfamoylaminopropyl, and 4-sulfamoyl), an aryl group (e.g., phenyl, naphthyl, and p-methoxyphenyl), or a heterocyclic group (e.g., 2-furyl, 2-thienyl, 2-pyrimidinyl, 2-benzotriazolyl, imidazolyl, pyrazolyl, pyrrolidinyl, and morphonyl).

Preferably at least one of $R_2^A$ and $R_3^A$ is a substituted or unsubstituted alkyl group and more preferably each of $R_2^A$ and $R_3^A$ is a substituted or unsubstituted alkyl group.

When $R_2^A$ and $R_3^A$ each represent a substituted or unsubstituted alkyl group, preferably the number of carbon atoms of the alkyl group is preferably 8 or below, more preferably 5 or below.

Specific examples of the compound represented by formula (A) are shown below, but the present invention is not restricted to them.

A-1

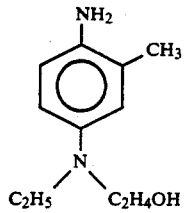

A-2

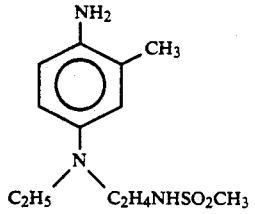

A-3

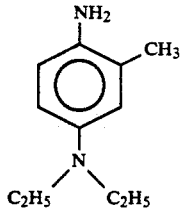

A-4

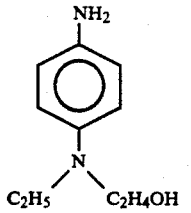

A general method of synthesizing the compounds represented by formula (A) will be described. The compounds represented by formula (A) can be synthesized in accordance with the method described, for example, in Journal of the American Chemical Society, Vol. 73, page 3100.

The layer wherein the yellow couplers represented by formulas (Y-1) to (Y-III) of the present invention are contained is preferably a photosensitive silver halide layer, more preferably a blue sensitive emulsion layer. The yellow coupler may also be used in a non-photosensitive emulsion layer next to a blue sensitive emulsion layer.

The present yellow coupler is preferably added to a photosensitive silver halide emulsion layer in an amount of $1\times10^{-3}$ to 2 mol, more preferably $2\times10^{-2}$ to 0.6 mol, per mol of the silver halide in said emulsion layer.

In the present invention, quenching couplers are preferably dye forming couplers represented by formulas (C-I) to (C-III), (M), and (m), more preferably dye forming couplers represented by formulas (C-I) to (C-III), and most preferably dye forming couplers represented by formula (C-I).

Where the quenching couplers are couplers represented by formulas (C-I) to (C-III), preferably the quenching coupler is used in a molar ratio in the range of $5\times10^{-3}$ to 0.25, more preferably 0.01 to 0.20, and most preferably 0.02 to 0.15, to all the yellow couplers including the present couplers used in the photosensitive silver halide emulsion layer.

If the quenching couplers are couplers represented by formulas (M) and (m), the quenching coupler is preferably used in a molar ratio in the range of $2\times10^{-3}$ to 0.20, more preferably $5\times10^{-3}$ to 0.15, and most preferably 0.01 to 0.10, to all the yellow couplers including the present couplers used in the photosensitive silver halide emulsion layer.

If the present yellow coupler is contained in a non-photosensitive emulsion layer next to a blue sensitive emulsion layer, the present yellow coupler is preferably used in a ratio of $1\times10^{-3}$ to 1 mmol/m$^2$, more preferably $5\times10^{-3}$ to 0.5 mmol/m$^2$. In this case, preferably the quenching coupler is the same as that used in the photosensitive silver halide emulsion layer where the present yellow coupler is used and the amount of the quenching coupler is the same as that used said photosensitive silver halide emulsion layer.

On the other hand, the present invention can use instead of the above quenching coupler a quenching dye. The quenching dye is a dye produced by a coupling reaction of dye forming couplers represented by formulae (C-I) to (C-III), (M), and (m), more preferably by formulae (C-I) to (C-III), most preferably by formula (C-I) with the oxidized product of a developing agent represented by formula (A).

A preferable amount of the quenching dye to be used is the same as the case of the quenching coupler.

To add the quenching coupler, it may be added to an organic solvent together with the yellow coupler containing the present coupler when the yellow coupler is emulsified so that the quenching coupler may be co-emulsified together with the yellow coupler, or the quenching coupler may be added separately from the yellow coupler and thereafter they may be mixed, with preference given to the co-emulsification.

It is adequate if the photographic material of the present invention has on a support at least one blue-sensitive silver halide emulsion layer, at least one green-sensitive silver halide emulsion layer, and at least one red-sensitive silver halide emulsion layer, and there is no particular restriction on the number of silver halide emulsion layers and non-photosensitive layers and on the order of the layers. A typical example is a silver halide photographic material having, on a support, at least one photosensitive layer that comprises several silver halide emulsion layers that have substantially the same color sensitivity but different in sensitivity, which photosensitive layer is a unit photosensitive layer having color sensitivity to any one of blue light, green light, and red light, and, in the case of a multilayer silver halide color photographic material, generally the arrangement of unit photosensitive layers is such that a red-sensitive layer, a green-sensitive layer, and a blue-sensitive layer are provided on a support in the stated order, with the red-sensitive layer adjacent to the support. However, depending on the purpose, the order of the arrangement may be reversed or the arrangement may be such that layers having the same color sensitivity have a layer with different color sensitivity between them.

A non-photosensitive layer, such as various intermediate layers, may be placed between the above-mentioned silver halide photosensitive layers, and such a layer also be placed on the uppermost layer or the lowermost layer.

The intermediate layer may contain such couplers and DIR compounds as described in JP-A Nos. 43748/1986, 113438/1984, 113440/1984, 20037/1986, and 20038/1986, and it may also contain a usually-used color mixing-inhibitor.

For multiple silver halide emulsion layers that constitute each unit photosensitive layer, preferably a two-layer constitution can be used, which comprises a high-sensitive emulsion layer and a low-sensitive emulsion layer, as described in West German Patent No. 1,121,470 and British Patent No. 923,045. Generally, the arrangement is preferably such that the sensitivities are decreased successively toward the support, and a non-photosensitive layer may be placed between halogen emulsions layers. Further, as described in JP-A Nos. 112751/1982, 200350/1987, 206541/1987, and 206543/1987, a low-sensitive emulsion layer may be placed away from the base and a high-sensitive emulsion layer may be placed nearer to the support.

A specific example is an arrangement of a low-sensitive blue-sensitive layer (BL)/a high-sensitive blue-sensitive layer (BH)/a high-sensitive green-sensitive layer (GH)/a low-sensitive green-sensitive layer (GL)/a high-sensitive red-sensitive layer (RH)/a low-sensitive red-sensitive layer (RL), which are named from the side away from the support, or an arrangement of BH/BL/GL/GH/RH/RL, or an arrangement of BH/BL/GH/GL/RL/RH.

Also, as described in JP-B No. 34932/1980, the order may be a blue-sensitive layer/GH/RH/GL/RL, which are named from the side away from the support. Also, as described in JP-A Nos. 25738/1981 and 63936/1987, the order may be a blue-sensitive layer/GL/RL/GH/RH, which are named from the side away from the support.

Further, as described in JP-B No. 15495/1974, an arrangement can be mentioned wherein an upper layer is a silver halide emulsion layer highest in sensitivity, an intermediate layer is a silver halide emulsion layer whose sensitivity is lower than that of the upper layer, and a lower layer is a silver halide emulsion layer whose sensitivity is lower than that of the intermediate layer, so that the sensitivities may be decreased successively toward the support. If the arrangement is made up of three layers different in sensitivity in this way, as described in JP-A No. 202464/1984, in the same color sensitive layer, the order may be an intermediate-sensitive emulsion layer, a high-sensitive emulsion layer, and a low-sensitive emulsion layer, which are stated from the side away from the support.

Further, the order may be, for example, a high-sensitive emulsion layer, a low-sensitive emulsion layer, and an intermediate-emulsion layer, or a low-sensitive emulsion layer, an intermediate-sensitive emulsion layer, and a high-sensitive emulsion layer. If there are four or more layers, the arrangement can be varied as described above.

In order to improve color reproduction, it is preferable that donor layers (CL), described in U.S. Pat. Nos. 4,663,271, 4,705,744, and 4,707,436, and JP-A Nos. 160448/1987 and 89850/1988, whose spectral sensitivity distribution is different from that of a main sensitive layer, such as BL, GL, and, RL and which have a double-layer effect are arranged adjacent or near to the main sensitive layer.

As stated above, various layer constitutions and arrangements can be chosen in accordance with the purpose of each photographic material.

A preferable silver halide to be contained in the photographic emulsion layer of the photographic material utilized in the present invention is silver bromoiodide, silver chloroiodide, or silver bromochloroiodide, containing about 30 mol. % or less of silver iodide. A particularly preferable silver halide is silver bromoiodide or silver bromochloroiodide, containing about 2 to about 10 mol. % of silver iodide.

The silver halide grains in the photographic emulsion may have a regular crystal form, such as a cubic shape, an octahedral shape, and a tetradecahedral shape, or a regular crystal shape, such as spherical shape or a tabular shape, or they may have a crystal defect, such as twin planes, or they may have a composite crystal form.

The silver halide grains may be fine grains having a diameter of about 0.2 μm or less, or large-size grains with the diameter of the projected area being down to about 10 μm, and as the silver halide emulsion, a polydisperse emulsion or a monodisperse emulsion can be used.

The silver halide photographic emulsions that can be used in the present invention may be prepared suitably by known means, for example, by the methods described in *I. Emulsion Preparation and Types*, in *Research Disclosure* (RD) No. 17643 (December 1978), pp. 22–23, and ibid. No. 18716 (November 1979), p. 648, and ibid. No. 307105 (November, 1989), pp. 863–865; the methods described in P. Glafkides, *Chimie et Phisique Photocrachique*, Paul Montel (1967), in G. F. Duffin, *Photographic Emulsion Chemistry*, Focal Press (1966), and in V. L. Zelikman et al., *Making and Coating of Photographic Emulsion*, Focal Press (1964).

A monodisperse emulsion, such as described in U.S. Pat. Nos. 3,574,628 and 3,655,394, and in British Patent No. 1,413,748, is also preferable.

Tabular grains having an aspect ratio of 5 or greater can be used in the emulsion of the present invention. Tabular grains can be easily prepared by the methods described in, for example, Gutoof, *Photographic Science and Engineering*, Vol. 14, pp. 248–257 (1970), U.S. Pat. Nos. 4,434,226, 4,414,310, 4,433,048, and 4,439,520, and British Patent No. 2,112,157.

The crystal structure of silver halide grains may be uniform, the outer halogen composition of the crystal structure may be different from the inner halogen composition, or the crystal structure may be layered. Silver halides whose compositions are different may be joined by the epitaxial joint, or a silver halide may be joined, for example, to a compound other than silver halides, such as silver rhodanide, lead oxide, etc.

Although the above-described emulsions may be either a surface latent image-type that forms latent image mainly on the surface, an internal latent image-type that forms latent image at the inner part of grain, or a type that forms latent image both on the surface and at the inner part of grain, it is necessary to be a negative-type emulsion. Of internal latent image-type emulsions, an internal latent image-type emulsion of core/shell-type grain, as described in JP-A No. 264720/1988, may be used. The preparation method of such internal latent image-type emulsion of core/shell-type grain is described in JP-A No. 133542/1984. The thickness of shell in such emulsion may be different according to a development process or the like, but a range of 3 to 40 nm is preferable, and a range of 5 to 20 nm is particularly preferable.

The silver halide emulsion that has been physically ripened, chemically ripened, and spectrally sensitized is generally used. Additives to be used in these steps are described in *Research Disclosure* Nos. 17643, 18716 and 307105, and involved sections are listed in the Table shown below.

In the photographic material of the present invention, two or more kinds of emulsions in which at least one of characteristics, such as grain size of photosensitive silver halide emulsion, distribution of grain size, composition of silver halide, shape of grain, and sensitivity is different each other can be used in a layer in a form of mixture.

Silver halide grains the surface of which has been fogged as described in, for example, U.S. Pat. No. 4,082,553, and silver halide grains or colloidal silver grains the inner part of which has been fogged as described in, for example, U.S. Pat. No. 4,626,498 and JP-A No. 214852/1984 may be preferably used in a photosensitive silver halide emulsion layer and/or a substantially non-photosensitive hydrophilic colloid layer. "Silver halide emulsion the surface or inner part of which has been fogged" means a silver halide emulsion capable of being uniformly (non-image-wisely) developed without regard to unexposed part or exposed part to light of the photographic material. The method for preparing a silver halide emulsion the surface or inner part of which has been fogged are described, for example, in U.S. Pat. No. 4,626,498 and JP-A No. 214852/1984.

The silver halide composition forming inner nucleus of core/shell-type silver halide grain the inner part of which has been fogged may be the same or different. As a silver halide grain the surface or inner part of which has been fogged, any of silver chloride, silver chlorobromide, silver chloroiodobromide can be used. Although the grain size of such silver halide grains which has been fogged is not particularly restricted, the average grain size is preferably 0.01 to 0.75 μm, particularly preferably 0.05 to 0.6 μm. Further, the shape of grains is not particularly restricted, a regular grain or an irregular grain can be used, and although it may be a polydisperse emulsion, a monodisperse emulsion (that contains at least 95% of silver halide grains in weight or in number of grains having grain diameter within 40% of average grain diameter) is preferable.

In the present invention, it is preferable to use a non-photosensitive fine grain silver halide. "Non-photosensitive fine grain silver halide" means a silver halide grain that does not expose at an imagewise exposure to light to obtain a color image and is not developed substantially at a development processing, and preferably it is not fogged previously.

Fine grain silver halide has a silver bromide content of 0 to 100 mol. %, and may contain silver chloride and/or silver iodide, if needed. Preferable ones contain silver iodide of 0.5 to 10 mol. %.

The average grain diameter (average diameter of circle corresponding to projected area) of fine grain silver halide is preferably 0.01 to 0.5 μm, more preferably 0.02 to 0.2 μm.

The fine grain silver halide can be prepared in the same manner as an ordinary photosensitive silver halide. In this case, it is not necessary to optically sensitize the surface of the silver halide grain and also spectrally sensitizing is not needed. However, to add previously such a compound as triazoles, azaindenes, benzothiazoliums, and mercapto compounds or a known stabilizing agent, such as zinc compounds, is preferable. Colloidal silver is preferably contained in a layer containing this fine grain silver halide.

The coating amount in terms of silver of photographic material of the present invention is preferably 6.0 g/m$^2$ or below, most preferably 4.5 g/m$^2$ or below.

Known photographic additives that can be used in the present invention are also described in the above-mentioned three Research Disclosures, and involved sections are listed in the same Table below.

| | Additive | RD 17643 (December 1978) | RD 18716 (November 1979) | RD 307105 (November 1989) |
|---|---|---|---|---|
| 1 | Chemical sensitizer | p. 23 | p. 648 (right column) | p. 866 |
| 2 | Sensitivity-enhancing agent | — | p. 648 (right column) | — |
| 3 | Spectral sensitizers and Supertabilizers | pp. 23–24 | pp. 648 (right column) –649 (right column) | pp. 866–868 |
| 4 | Brightening agents | p. 24 | p. 647 (right column) | p. 868 |
| 5 | Antifogging agents and Stabilizers | pp. 24–25 | p. 649 (right column) | pp. 868–870 |
| 6 | Light absorbers, Filter dyes, and UV Absorbers | pp. 25–26 | pp. 649 (right column) –650 (left column) | p. 873 |
| 7 | Stain-preventing agent | p. 25 (right column) | p. 650 (left to right column) | p. 872 |
| 8 | Image dye stabilizers | p. 25 | p. 650 (left column) | p. 872 |
| 9 | Hardeners | p. 26 | p. 651 (left column) | pp. 874–875 |
| 10 | Binders | p. 26 | p. 651 (left column) | pp. 873–874 |
| 11 | Plasticizers and Lubricants Lubricants | p. 27 | p. 650 (right column) | p. 876 |
| 12 | Coating aids and Surface-active agents | pp. 26–27 | p. 650 (right column) | pp. 875–876 |
| 13 | Antistatic agents | p. 27 | p. 650 (right column) | pp. 876–877 |
| 14 | Matting agent | — | — | pp. 878–879 |

Further, in order to prevent the lowering of photographic performances due to formaldehyde gas, a compound described in, for example, U.S. Pat. Nos. 4,411,987 and 4,435,503 that is able to react with formaldehyde to immobilize is preferably added to the photographic material.

In the photographic material of the present invention, a mercapto compound described in, for example, U.S. Pat. Nos. 4,740,454 and 4,788,132, and JP-A Nos. 18539/1987 and 283551/1989 is preferably contained.

In the photographic material of the present invention, a compound that releases a fogging agent, a development accelerator, a solvent for silver halide, or the precursor thereof, independent of the amount of silver formed by a development processing, described in, for example, JP-A No. 106052/1989 is preferably contained.

In the photographic material of the present invention, a dye dispersed by a method described in, for example, International Publication No. W088/04794 and Japanese Published Searched Patent Publication No. 502912/1989, or a dye described in, for example, European Patent No. 317,308A, U.S. Patent No. 4,420,555, and JP-A No. 259358/1989 is preferably contained.

In the present invention, various color couplers can be used, and concrete examples of them are described in patents cited in the above-mentioned *Research Disclosure* No. 17643, VII-C to G, and ibid. No. 307105, VII-C to G.

As yellow couplers to be used in combination with the yellow couplers represented by formulas (Y-I) to (Y-III) of the present invention, those described in, for example, U.S. Pat. Nos. 3,933,501, 4,022,620, 4,326,024, 4,401,752, and 4,248,961, JP-B No. 10739/1983, British Patent Nos. 1,425,020 and 1,476,760, U.S. Pat. Nos. 3,973,968, 4,314,023, and 4,511,649, and European Patent No. 249,473A are preferable.

As magenta couplers, 5-pyrazolone-type magenta couplers and pyrazoloazole-series magenta couplers can be mentioned, and couplers described in, for example, U.S. Pat. Nos. 4,310,619 and 4,351,897, European Patent No. 73,636, U.S Pat. Nos. 3,061,432 and 3,725,067, JP-A Nos. 35730/1985, 118034/1980, and 185951/1985, U.S. Pat. No. 4,556,630, and International Publication No. W088/04795 are preferable, in particular.

As cyan couplers to be used in combination with the cyan coupler of the present invention, phenol-type couplers and naphthol-type couplers can be mentioned, and those described in U.S. Patent Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, European Patent Nos. 121,365A and 249,453A, U.S. Pat. Nos. 3,446,622, 4,333,999, 4,775,616, 4,451,559, 4,427,767, 4,690,889, 4,254,212, and 4,296,199, and JP-A No. 42658/1986 are preferable. Further, pyrazoloazole series couplers as described, for example, in JP-A Nos. 553/1989, 554/1989, 555/1989, and 556/1989, and imidazole series couplers as described, for example, in U.S. Pat. No. 4,818,672 can be used.

Typical examples of polymerized dye-forming coupler are described in, for example, U.S. Patent Nos. 3,451,820, 4,080,211, 4,367,282, 4,409,320, and 4,576,910, British Patent No. 2,102,137, and European Patent No. 341,188A.

As a coupler which forms a dye having moderate diffusibility, those described in U.S. Patent No. 4,366,237, British Patent No. 2,125,570, European Patent No. 96,570, and West German Patent Application (OLS) No. 3,234,533 are preferable.

As a colored coupler to rectify the unnecessary absorption of color-forming dyes, those couplers described in, paragraph VII-G of Research Disclosure No. 17643, paragraph VII-G of ibid. No. 307105, U.S. Pat. No. 4,163,670, JP-B No. 39413/1982, U.S. Pat. Nos. 4,004,929 and 4,138,258, and British Patent No. 1,146,368 are preferable. Further, it is preferable to use couplers to rectify the unnecessary absorption of color-forming dyes by a fluorescent dye released upon the coupling reaction as described in U.S. Pat. No. 4,774,181 and couplers having a dye precursor, as a group capable of being released, that can react with the developing agent to form a dye as described in U.S. Pat. No. 4,777,120.

A coupler that releases a photographically useful residue accompanied with the coupling reaction can be used favorably in this invention. As a DIR coupler that release a development retarder, those described in patents cited in paragraph VII-F of the above-mentioned *Research Disclosure* No. 17643 and in paragraph VII-F of ibid. No. 307105, JP-A Nos. 151944/1982, 154234/1982, 184248/1985, 37346/1988, and 37350/1986, and U.S. Pat. Nos. 4,248,962 and 4,782,012 are preferable.

A coupler that releases a bleaching accelerator, described, for example, in Research Disclosure Nos. 11449 and 24241, and JP-A No. 201247/1986, is effective for shortening the time of processing that has bleaching activity, and the effect is great in the case wherein the coupler is added in a photographic material using the above-mentioned tabular silver halide grains.

As a coupler that releases, imagewisely, a nucleating agent or a development accelerator upon developing, those described in British Patent Nos. 2,097,140 and 2,131,188, and JP-A Nos. 157638/1984 and 170840/1984 are preferable. Further, compounds which release a fogging agent, a developing accelerator, or a solvent for silver halide by a oxidation-reduction reaction with the oxidized product of developing agent as described in JP-A Nos. 107029/1985, 252340/1985, 44940/1989, and 45687/1989 are also preferable.

Other couplers that can be incorporated in the photographic material of the present invention include competitive couplers described in U.S. Pat. No. 4,130,427, multi-equivalent couplers described in U.S. Pat. Nos. 4,283,472, 4,338,393, and 4,310,618, couplers which release a DIR redox compound, couplers which release a DIR coupler, and redox compounds which release a DIR coupler or a DIR redox as described in JP-A Nos. 185950/1985 and 24252/1987, couplers which release a dye to regain a color after releasing as described in European Patent Nos. 173,302A and 313,308A, couplers which release a bleaching-accelerator as described in *Research Disclosure* Nos. 11449 and 24241, and JP-A No. 201247/1986, couplers which release a ligand as described in U.S. Patent No. 4,553,477, couplers which release a leuco dye as described in JP-A No. 75747/1988, and couplers which release a fluorescent dye as described in U.S. Pat. No. 4,774,181.

Couplers utilized in the present invention can be incorporated into a photographic material by various known methods.

Examples of high-boiling solvent for use in oil-in-water dispersion process are described in, for example, U.S. Patent No. 2,322,027. As specific examples of high-boiling organic solvent having a boiling point of 175° C. or over at atmospheric pressure for use in oil-in-water dispersion process can be mentioned phthalates (e.g., dibutyl phthalate, dicyclohexyl phthalate, di-2-ethylhexyl phthalate, decyl phthalate, bis(2,4-di-t-amylphenyl phthalate, bis(2,4-di-t-amylphenyl)isophthalate, and bis(1,1-diethylpropyl)phthalate), esters of phosphoric acid or phosphonic acid (e.g., triphenyl phosphate, tricrezyl phosphate, 2-ethylhexyldiphenyl phosphate, tricyclohexyl phophate, tri-2-ethylhexyl phosphate, tridodecyl phosphate, tributoxyethyl phosphate, trichloropropyl phosphate, and di-2-ethylhexylphenyl phosphate), benzoic esters (e.g., 2-ethylhexyl benzoate, dodecyl benzoate, and 2-ethylhexyl-p-hydroxy benzoate), amides (e.g., N,N-diethyldodecanamide, n,n-diethyllaurylamide, and N-tetradecylpyrrolidone), alcohols or phenols (e.g., isostearyl alcohol and 2,4-di-tert-amyl phenol), aliphatic carbonic acid esters (bis(2-ethylhexyl) sebacate, dioctyl azelate, glycerol tributylate, isostearyl lactate, and trioctyl citrate), aniline derivertives (N,N-dibutyl-2-butoxy-5-tert-octylaniline), and hydrocarbons (paraffin, dodecyl benzene, and diisopropyl naphthalene). Further, as a co-solvent an organic solvent having a boiling point of about 30° C. or over, preferably a boiling point in the range from 50° C. to about 160° C. can be used, and as typical example can be mentioned ethyl acetate, butyl acetate, ethyl propionate, methylethyl ketone, cyclohexanone, 2-rthoxyethyl acetate, and dimethyl formamide.

Specific examples of process and effects of latex dispersion method, and latices for impregnation are described in, for example, U.S. Pat. No. 4,199,363 and West German Patent Application (OLS) Nos 2,541,274 and 2,541,230.

In the photographic material of this invention, various antiseptics and antifungal agents, such as phenetyl alcohol, and 1,2-benzisothiazoline-3-one, n-butyl-p-hydroxybenzoate, phenol, 4-chloro-3,5-dimethylphenol, 2-phenoxyethanol, and 2-(4-thiazolyl)-bezimidazole as described in JP-A Nos. 257747/1988, 272248/1987, and 80941/1989 are preferably added.

The present invention can be adopted to various color photographic materials. Representable examples include a color negative film for general use or for cine, a color reversal film for slide or for television, a color paper, a color positive film, and a color reversal paper. Among them, a negative-type photographic material for photographing that employs a transparent support is one of preferable examples.

Suitable supports to be used in this invention are described in, for example, in the above-mentioned *Research Disclosure* No. 17643, page 28 and No. 18716, from page 647, right column to page 648, left column.

In the photographic material of the present invention, preferably the total layer thickness of all the hydrophilic colloid layers on the side having emulsion layers is 28 μm or below, more preferably 23 μm or below, further more preferably 20 μm or below, and particularly preferably 16 μm or below. Preferably the film swelling speed $T_{\frac{1}{2}}$ is 30 sec or below, more preferably 20 sec or below. The term "layer thickness" means layer thickness measured after moisture conditioning at 25° C. and a relative humidity of 55% for two days, and the film swelling speed $T_{\frac{1}{2}}$ can be measured in a manner known in the art. For example, the film swelling speed $T_{\frac{1}{2}}$ can be measured by using a swellometer (swell-measuring meter) of the type described by A. Green et al. in *Photocraphic Science and Engineering*, Vol. 19, No. 2, pp. 124–129, and $T_{\frac{1}{2}}$ is defined as the time required to reach a film thickness of ½ of the saturated film thickness that is 90% of the maximum swelled film thickness that will be reached when the film is treated with a color developer at 30° C. for 3 min 15 sec.

The film swelling speed $T_{\frac{1}{2}}$ can be adjusted by adding a hardening agent to the gelatin that is a binder or by changing the time conditions after the coating. Preferably the ratio of swelling is 150 to 400%. The ratio of swelling is calculated from the maximum swelled film thickness obtained under the above conditions according to the formula: (Maximum swelled film thickness −film thickness)/Film thickness.

It is preferable that the photographic material of the present invention is provided with a hydrophilic layer (designated as a back layer) having a total dried layer thickness of 2 μm to 20 μm at the opposite side of having emulsion layers. In such layer, it is preferable to be contained the above-mentioned light-absorbent, filter-dye, UV-absorbent, static preventer, film-hardener, binder, plasticizer, lubricant, coating auxiliary, and surface-active agent. The ratio of swelling of back layer is preferably 150 to 500%.

The photographic material in accordance with the present invention can be subjected to the development processing by an ordinary method as described in the above-mentioned RD No. 17463, pp. 28–29, ibid. No. 18716, p. 651, from left column to right column, and ibid. No. 307105, pp. 880–881.

Preferably, the color developer used for the development processing of the photographic material of the present invention is an aqueous alkaline solution whose major component is an aromatic primary amine color-developing agent. As the color-developing agent, aminophenol compounds are useful, though p-phenylene diamine compounds are preferably used, and typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, and 3-methyl-4-amino-N-ethyl-N-β-methoxy ethylaniline, and their sulfates, hydrochlorides, and p-toluenesulfonates. A combination of two or more of these compounds may be used in accordance with the purpose.

The color developer generally contains, for example, buffers, such as carbonates or phosphates of alkali metals, and development inhibitors or antifoggants, such as bromide salts, iodide salts, benzimidazoles, benzothiazoles, or mercapto compounds. The color developer may, if necessary, contain various preservatives, such as hydroxylamine, diethylhydroxylamine, sulfites, hydrazines for example N,N-biscarboxymethylhydrazine, phenylsemicarbazides, triethanolamine, and catecholsulfonic acids, organic solvents such as ethylene glycol and diethylene glycol, development accelerators such as benzyl alcohol, polyethylene qlycol, quaternary ammonium salts, and amines, dye forming couplers, competing couplers, auxiliary developers such as 1-phenyl-3-pyrazolidone, tackifiers, and various chelate agents as represented by aminopolycarboxylic acids, aminopolyphosphonic acids, alkylphosphonic acids, and phosphonocarboxylic acids, typical example thereof being ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and their salts.

If reversal processing is carried out, it is common that after black and white development and reversal processing are carried out, the color development is carried out. As the black and white developers, known black and white developing agents, such as dihydroxybenzenes, for example hydroquinone, 3-pyrazolidones, for example 1-phenyl-3-pyrazolidone, and aminophenols, for example N-methyl-p-aminophenol, can be used alone or in combination. Generally the pH of this color developer and black-and-white developing solution is 9 to 12. The replenishing amount of these developing solutions is generally 3 liter or below per square meter of the color photographic material to be processed, though the replenishing amount changes depending on the type of color photographic material, and if the concentration of bromide ions in the replenishing solution is lowered previously, the replenishing amount can be lowered to 500 ml or below per square meter of the color photographic material If it is intended to lower the replenishing amount, it is preferable to prevent the evaporation of the solution and oxidation of the solution with air by reducing the area of the solution in processing tank that is in contact with the air.

The contact area of the photographic processing solution with the air in the processing tank is represented by the opened surface ratio which is defined as follows:

$$\text{Opened surface ratio } (\text{cm}^{-1}) = \frac{\text{Contact surface area } (\text{cm}^2) \text{ of the processing solution with the air}}{\text{Whole volume } (\text{cm}^3) \text{ of the processing solution}}$$

wherein "contact surface area of the processing solution with the air" means a surface area of the processing solution that is not covered by anything such as floating lids or rolls.

The opened surface ratio is preferably 0.1 $cm^1$ or less, more preferably 0.001 to 0.05$cm^{-1}$. Methods for reducing the opened surface ratio that can be mentioned include a utilization of movable lids as described in JP-A No. 82033/1989 and a slit-developing process as described in JP-A No. 216050/1988, besides a method of providing a shutting materials such as floating lids. It is preferable to adopt the means for reducing the opened surface ratio not only in a color developing and black-and-white developing process but also in all succeeding processes, such as bleaching, bleach-fixing, fixing, washing, and stabilizing process. It is also possible to reduce the replenishing amount by using means of suppressing the accumulation of bromide ions in the developer.

Although the processing time of color developing is settled, in generally, between 2 and 5 minutes, the time can be shortened by, for example, processing at high temperature and at high pH, and using a color developer having high concentration of color developing agent.

The photographic emulsion layer are generally subjected to a bleaching process after color development.

The beaching process can be carried out together with the fixing process (bleach-fixing process), or it can be carried out separately from the fixing process. Further, to quicken the process bleach-fixing may be carried out after the bleaching process. In accordance with the purpose, the process may be arbitrarily carried out using a bleach-fixing bath having two successive tanks, or a fixing process may be carried out before the bleach-fixing process, or a bleaching process. As the bleaching agent, use can be made of, for example, compounds of polyvalent metals, such as iron (III). As typical bleaching agent, use can be made of organic complex salts of iron (III), such as complex salts of aminopolycarboxylic acids, for example ethylenediaminetetraacetic acid, diethylenetriaminetetraacetic acid, cyclohexanediaminetetraacetic acid, methyliminodiacetic acid, 1,3-diaminopropanetetraacetic acid, and glycoletherdiaminetetraacetic acid, citric acid, tartaric acid, and malic acid. Of these, aminopolycarboxylic acid iron (III) complex salts, including ethylenediaminetetraacetic acid iron (III) complex salts are preferable in view of rapid-processing and the prevention of pollution problem. Further, aminopolycarboxylic acid iron (III) complex salts are particularly useful in a bleaching solution as well as a bleach-fixing solution. The pH of the bleaching solution or the bleach-fixing solution using these aminopolycarboxylic acid iron (III) complex salts is generally 4.0 to 8.0, but if it is required to quicken the process, the process can be effected at a low pH.

In the bleaching solution, the bleach-fixing solution, and the bath preceding them a bleach-accelerating agent may be used if necessary. Examples of useful bleach-accelerating agents are compounds having a mercapto group or a disulfide linkage, described in U.S. Pat. No. 3,893,858, West German Patent Nos. 1,290,812 and 2,059,988, JP-A Nos. 32736/1978, 57831/1978, 37418/1978, 72623/1978, 95630/1978, 95631/1978, 104232/1978, 124424/1978, 141623/1978, and 28426/1978, and *Research Disclosure* No. 17129 (July, 1978); thiazolidine derivatives, described in JP-A No. 140129/1975; thiourea derivatives, described in JP-B No. 8506/1970, JP-A Nos. 0832/1977 and 32735/1978, and U.S. Pat. No. 3,706,561; iodide salts, described in West German Patent No. 1,127,715 and JP-A No. 16235/1983; polyoxyethylene compounds in West German Patent Nos. 966,410 and 2,748,430; polyamine compounds, described in JP-B No. 8836/1970; other compounds, described in JP-A Nos. 40943/1974, 59644/1974, 94927/1978, 35727/1979, 26506/1980, and 163940/1983; and bromide ions. Of these, compounds having a mercapto group or a disulfide group are preferable in view of higher acceleration effect, and in particular, compounds described in U.S. Pat. No. 3,893,858, West German Patent No. 1,290,812, and JP-A No. 95630/1978 are preferable. Further, compounds described in U.S. Pat. No. 4,552,834 are preferable. These bleach-accelerating agents may be added into a photographic material. When the color photographic materials for photographing are to be bleach-fixed, these bleach-accelerating agents are particularly effective.

In addition to the above compounds, an organic acid is preferably contained in the bleach solution or bleach-fix solution in order to prevent bleach stain. A particularly preferable organic acid is a compound having an acid dissociation constant (pKa) of 2 to 5, and specifically, for example, acetic acid and propionic acid are preferable.

As a fixing agent to be used in the fixing solution and the bleach-fix solution, thiosulfates, thiocyanates, thioether compounds, thioureas, and large amounts of iodides can be mentioned, although thiocyanates are used generally, and particularly ammonium thiosulfate is used most widely. A combination, for example, of a thiosulfate with a thiocyanate, a thioether compound, or thiourea is also used preferably. As preservatives for the fixing solution or the bleach-fix solution, sulfites, bisulfites, carbonyl bisulfite adducts, and sulfinic acid compounds described in European Patent No. 294,769A are preferable. Further, in order to stabilize the fixing solution or the bleach-fix solution, the addition of various aminopolycarboxylic acids or organic phosphonic acids to the solution is preferable.

In the present invention, to the fixing solution or the bleach-fix solution, a compound having a pKa of 6.0 to 9.0, preferably an imidazole, such as imidazole, 1-methylimidazole, 1-ethylimidazole, and 2-methylimidazole, is added in an amount of 0.1 to 10 mol/l in order to adjust the pH.

The total period of the desilvering step is preferably made shorter within the range wherein silver retention will not occur. A preferable period is 1 to 3 min, more preferably 1 to 2 min. The processing temperature is 25° to 50° .C, preferably 35° to 45° C. In a preferable temperature range, the desilvering speed is improved and the occurrence of stain after the processing can effectively be prevented.

In the desilvering step, preferably the stirring is intensified as far as possible. Specific methods for intensifying the stirring are a method described in JP-A No. 183460/1987, wherein a jet stream of a processing solution is applied to the emulsion surface of the photographic material; a method described in JP-A No. 183461/1987, wherein the stirring effect is increased by using a rotating means; a method wherein a photographic material is moved with a wiper blade placed in a solution in contact with the emulsion surface, to cause a turbulent flow to occur over the emulsion surface to improve the stirring effect, and a method wherein the amount of the circulating flow of the whole processing solution is increased. Such stirring improvement means are effective for any of the bleaching solution, the bleach-fix solution, and the fixing solution. The improvement of stirring seems to quicken the supply of the bleaching agent and the fixing agent to the emulsion coating, thereby bringing about an increase of the desilvering speed. The above stirring improvement means is more effective when a bleach accelerator is used and the means can increase the acceleration effect remarkably or can cancel the fixing inhibiting effect of the bleach accelerator.

Preferably, the automatic processor used for the present photographic material is provided with a photographic material conveying means described in JP-A Nos. 191257/1985, 191258/1985, and 191259/1985. As described in 191257/1985 mentioned above, such a conveying means can reduce extraordinarily the carry-in of the processing solution from one bath to the next bath, and therefore it is highly effective in preventing the performance of the processing solution from deteriorating. Such an effect is particularly effective in shortening the processing time in each step and in reducing the replenishing amount of the processing solution.

It is common for the silver halide color photographic material of the present invention to undergo, after a desilvering process such as fixing or bleach-fix, a washing step and/or a stabilizing step. The amount of washing water may be set within a wide range depending on the characteristics (e.g., due to the materials used, such as couplers), the application of the photographic material, the washing temperature, the number of washing tanks (the number if steps), the type of replenishing system, including, for example, the counter-current system and the direct flow system and other various conditions. Of these, the relationship between the number of water-washing tanks and the amount of washing water in the multi-stage counter current system can be found according to the method described in *Journal of Society of Motion Picture and Television Engineers*, Vol. 64, pages 248 to 253 (May 1955).

According to the multi-stage-counter-current system described in the literature mentioned above, although the amount of washing water can be considerably reduced, bacteria propagate with an increase of retention time of the washing water in the tanks, leading to a problem with the resulting suspend matter adhering to the photographic material. In processing the present color photographic material, as a measure to solve this problem the method of reducing calcium and magnesium described in JP-A No. 288838/1987 can be used quite effectively. Also chlorine-type bactericides such as sodium chlorinated isocyanurate, cyabendazoles, isothiazolone compounds described in JP-A No. 8542/1982, benzotriazoles, and other bactericides described by Hiroshi Horiguchi in *Bokin Bobai-zai no Kagaku*, (1986) published by Sankyo-Shuppan, *Biseibutsu no mekkin, Sakkin, Bobaigijutsu* (1982) edited by Eiseigijutsu-kai, published by Kogyo-Gijutsu-kai, and in *Bokin Bobaizai Jiten* (1986) edited by Nihon Bokin Bobai-gakkai), can be used.

The pH of the washing water used in processing the present photographic material is 4 to 9, preferably 5 to 8. The washing water temperature and the washing time to be set may vary depending, for example, on the characteristics and the application of the photographic material, and they are generally selected in the range of 15° to 45° C. for sec to 10 min, and preferably in the range of 25° to 40° C. for 30 sec to 5 min. Further, the photographic material of the present invention can be processed directly with a stabilizing solution instead of the above washing. In such a stabilizing process, any of known processes, for example, a multi-step counter-current stabilizing process or its low-replenishing-amount process, described in JP-A Nos. 8543/1982, 14834/1983, and 220345/1985.

In some cases, the above washing process is further followed by stabilizing process, and as an example thereof can be mentioned a stabilizing bath that is used as a final bath for color photographic materials for photography, which contains a dye-stabilizing agent and a surface-active agent. As an example of dye-stabilizing agent can be mentioned aldehyde (e.g., formalin and gulaldehyde), N-methylol compound, hexamethylenetetramine and aldehyde-sulfite adduct. In this stabilizing bath, each kind of the chelating agents and bactericides may be added.

The over-flow solution due to the replenishing of washing solution and/or stabilizing solution may be reused in other steps, such as a desilvering step.

When each of the above-mentioned processing solutions is concentrated due to the evaporation of water in the processing using an automatic processor, preferably water to correct the concentration is added into each solution.

The silver halide color photographic material of the present invention may contain therein a color-developing agent for the purpose of simplifying and quickening the process. To contain such a color-developing agent, it is preferable to use a precursor for color-developing agent. For example, indoaniline-type compounds described in U.S. Pat. No. 3,342,597, Schiff base-type compounds described in U.S. Pat. No. 3,342,599 and *Research Disclosure* Nos. 14850 and 15159, aldol compounds described in *Research Disclosure* No. 13924, and metal salt complexes described in U.S. Pat. No. 3,719,492, and urethane-type compounds described in JP-A No. 135628/1978 can be mentioned.

For the purpose of accelerating the color development, the present silver halide color photographic material may contain, if necessary, various 1-phenyl-3-pyrazolicones. Typical compounds are described in JP-A Nos. 64339/1981, 144547/1982, and 115438/1983.

The various processing solutions used for the present invention may be used at 10 to 50° C. Although generally a temperature of 33 to 38° C. may be standard, a higher temperature can be used to accelerate the process to reduce the processing time, or a lower temperature can be used to improve the image quality or the stability of the processing solution.

Further, the silver halide photographic material of the present invention can be adopted to photographic materials for heat development described in, for example, U.S. Pat. No. 4,500,626, JP-A Nos. 133449/1985, 218443/1984, and 23805/1986, and European Patent No. 210,660A2.

The silver halide color photographic material of the present invention is excellent in color formation and in image fastness under dark storage, and further excellent in color image fastness as a whole by higher image dye fastness under light irradiation.

Next, the present invention will be described in detail in accordance with examples, but the invention is not limited to them.

Couplers shown below were used as comparative couplers:

EXAMPLE 1

Samples 101 to 145 of monolayer color photographic material for evaluation test were prepared by coating two layers, whose compositions are shown below, using couplers ExY and ExQ as shown in Table 1, on a prime-coated triacetate cellulose film.

Composition of Photosensitive Layer

Figure corresponding to each component is indicated in a coating amount of g/m$^2$, but the coating amounts of ExY and ExQ are shown in mmol/m$^2$ and the coating amount of sensitizing dye is indicated in mol per mol of silver halide in the same layer.

| | |
|---|---|
| First layer (Blue-sensitive emulsion layer) | |
| Silver iodobromide emulsion silver | 0.43 |
| Average AgI content: 9.0% | |
| Average grain diameter: 0.71 μm | |
| (Deviation coefficient: 14%) | |
| Core/shell = 3/7 Double structure grains | |
| (AgI content = 25%/2%) | |
| Sensitizing dye | $3.6 \times 10^{-4}$ |
| ExY | 1.00 |
| ExQ | 0.10 |
| HBS-1 | 0.25 |
| W-2 | 0.10 |
| F-11 | 0.004 |
| B-5 | 0.014 |
| B-4 | 0.010 |
| Gelatin | 2.00 |
| Second layer (Protective layer) | |
| H-1 | 0.18 |
| W-3 | 0.10 |
| B-4 | 0.01 |
| B-1 (Diameter: 1.7 μm) | 0.05 |
| B-2 (Diameter: 1.7 μm) | 0.10 |
| B-3 | 0.10 |
| Gelatin | 1.20 |

(YC-1)

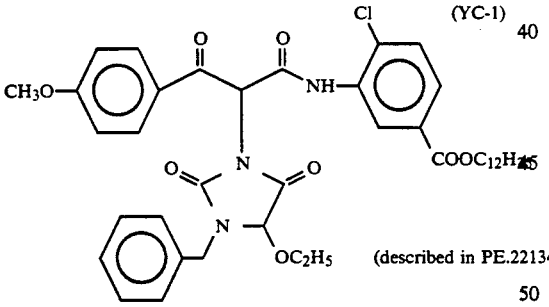

(described in PE.2213461)

HBS-1

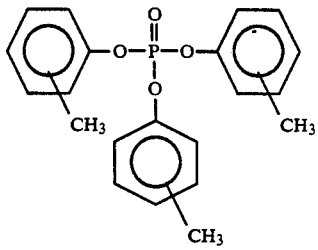

(YC-2)

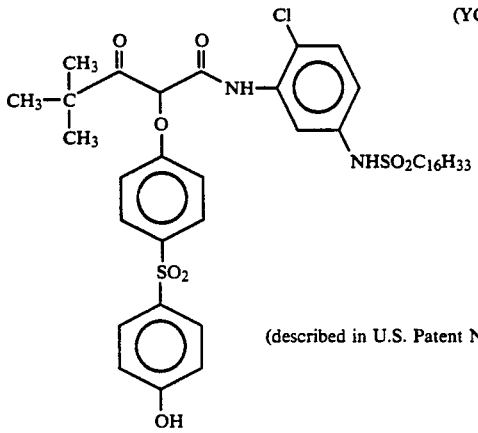

(described in U.S. Patent No. 3.933.501)

W-2

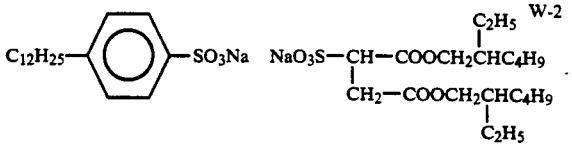

F-11

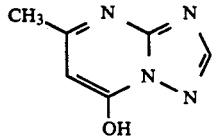

B-5

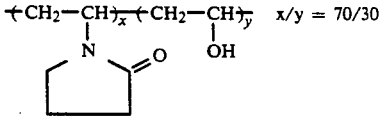

-continued

B-4

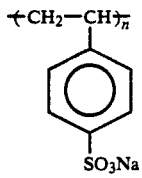

B-1

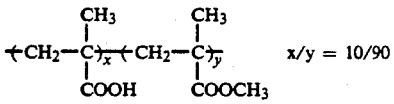

B-2

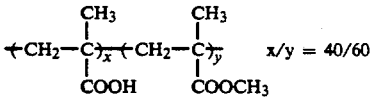

B-3

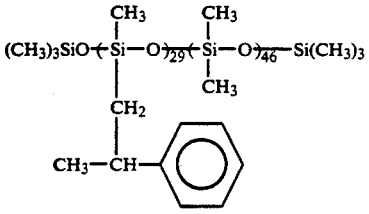

H-1

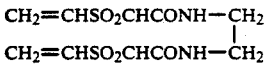

Sensitizing dye VII

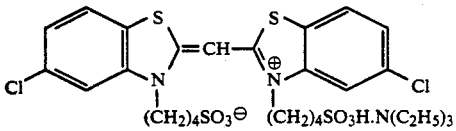

Thus-prepared samples were subjected to an image-wise exposure to light through an wedge and to the processing as shown below.

| Process | (Processing process) Processing time | Processing Temperature |
|---|---|---|
| Color developing | 2 min 45 sec | 38° C. |
| Bleaching | 6 min 30 sec | 38° C. |
| Water washing | 2 min 10 sec | 24° C. |
| Fixing | 4 min 20 sec | 38° C. |
| Water washing (1) | 1 min 05 sec | 24° C. |
| Water washing (2) | 1 min 00 sec | 24° C. |
| Stabilizing | 1 min 05 sec | 38° C. |
| Drying | 4 min 20 sec | 55° C. |

Compositions of processing solutions are as follows:

| | (gram) |
|---|---|
| (Color developer) | |
| Diethylenetriaminepentaacetate | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-Ethyl-N-β=hydroxyethylamino]-2-methylaniline sulfate | 4.5 |
| Water to make | 1.0 liter |
| pH | 10.05 |
| (Bleaching solution) | |
| Iron(III) sodium ethylenediamine-tetraacetate trihydrate | 100.0 |
| Disodium ethylenediaminetetraacetate | 10.0 |
| Ammonium bromide | 140.0 |
| Ammonium nitrate | 30.0 |
| Aqueous ammonia (27%) | 6.5 ml |
| Water to make | 1.0 liter |
| pH | 6.0 |
| (Stabilizing solution) | |
| Formalin (37%) | 2.0 ml |
| Polyoxyethylene-p-monononylphenyl ether (Degree of polymerization: 10) | 0.3 |
| Disodium ethylenediaminetetraacetate | 0.05 |
| Water to make | 1.0 liter |
| pH | 5.8–8.0 |

After processing, the characteristics of each photographic material was determined in blue light, to obtain maximum density (Dm).

Further each sample processed was subjected to evaluations of light fastness, wet-and-heat fastness, and heat fastness according to methods shown below.

Light Fastness

After light irradiation by a fluorescence lamp (100,000 lux) for two weeks, percentage of density (D) measured by blue light after irradiation to an initial density ($D_O$)=minimum density+1.2 was determined.

Wet-And-Heat Fastness

After storage at 60° C. and 70% relative humidity for two months, percentage of density (D) measured by blue light after storage to an initial density ($D_O$)=1.2 was determined.

Heat Fastness

After storage at 80° C. in dried conditions for two months, percentage of density (D) measured by blue light after storage to an initial density ($D_O$)=1.2 was determined.

Results are shown in Table 1.

TABLE 1

| Sample No. | Yellow coupler ExY | Quenching coupler ExQ | Dm | Light fastness (%) | Wet-and-heat fastness (%) | Heat fastness (%) | Remarks |
|---|---|---|---|---|---|---|---|
| 101 | YC-1 | — | 1.55 | 52 | 71 | 89 | Comparative example |
| 102 | " | IC-7 | 1.55 | 71 | 70 | 90 | " |
| 103 | YC-2 | — | 1.35 | 91 | 73 | 72 | " |
| 104 | " | IC-7 | 1.36 | 94 | 74 | 70 | " |
| 105 | $Y_1$-5 | — | 1.80 | 39 | 87 | 91 | " |
| 106 | " | IC-7 | 1.82 | 89 | 88 | 93 | This invention |
| 107 | " | IIC-3 | 1.79 | 85 | 87 | 90 | " |
| 108 | " | IIIC-26 | 1.79 | 86 | 85 | 92 | " |
| 109 | " | M-4 | 1.78 | 79 | 86 | 91 | " |
| 110 | " | M-33 | 1.80 | 81 | 88 | 93 | " |
| 111 | " | M-34 | 1.79 | 80 | 86 | 90 | " |

TABLE 1-continued

| Sample No. | Yellow coupler ExY | Quenching coupler ExQ | Dm | Light fastness (%) | Wet-and-heat fastness (%) | Heat fastness (%) | Remarks |
|---|---|---|---|---|---|---|---|
| 112 | " | m-1 | 1.87 | 77 | 86 | 91 | " |
| 113 | $Y_1$-28 | — | 1.50 | 38 | 92 | 95 | Comparative example |
| 114 | " | IC-7 | 1.51 | 91 | 91 | 95 | This invention |
| 115 | " | IIC-3 | 1.49 | 88 | 91 | 96 | " |
| 116 | " | IIIC-26 | 1.50 | 89 | 92 | 95 | " |
| 117 | $Y_1$-29 | — | 1.45 | 71 | 90 | 94 | Comparative example |
| 118 | " | IC-7 | 1.45 | 92 | 91 | 95 | This invention |
| 119 | $Y_1$-30 | — | 1.51 | 42 | 92 | 96 | Comparative example |
| 120 | " | IC-7 | 1.52 | 91 | 91 | 96 | This invention |
| 121 | $Y_1$-33 | — | 1.39 | 76 | 95 | 97 | Comparative example |
| 122 | " | IC-7 | 1.41 | 93 | 94 | 98 | This invention |
| 123 | $Y_1$-24 | — | 1.72 | 54 | 79 | 92 | Comparative example |
| 124 | " | IC-7 | 1.73 | 91 | 78 | 91 | This invention |
| 125 | $Y_2$-4 | — | 1.38 | 68 | 95 | 97 | Comparative example |
| 126 | " | IC-7 | 1.39 | 87 | 96 | 97 | This invention |
| 127 | " | IIC-3 | 1.37 | 83 | 95 | 98 | " |
| 128 | " | IIIC-26 | 1.37 | 84 | 97 | 98 | " |
| 129 | $Y_2$-15 | — | 1.77 | 66 | 95 | 97 | Comparative example |
| 130 | " | IC-7 | 1.78 | 90 | 94 | 97 | This invention |
| 140 | $Y_2$-20 | — | 1.65 | 64 | 91 | 95 | Comparative example |
| 141 | " | IC-7 | 1.65 | 88 | 92 | 95 | This invention |
| 142 | $Y_2$-47 | — | 1.75 | 67 | 94 | 96 | Comparative example |
| 143 | " | IC-7 | 1.76 | 90 | 96 | 97 | This invention |
| 144 | $Y_2$-51 | — | 1.70 | 63 | 95 | 98 | Comparative example |
| 145 | " | IC-7 | 1.72 | 89 | 95 | 97 | This invention |

As is apparent from the results in Table 1, although the light fastness is improved by adding a quenching coupler, when a quenching coupler is added to the Comparative coupler YC-1, the improvement of light fastness is small, and the wet-and-heat fastness is insufficient and unsatisfactory.

Further, with respect to Comparative Coupler YC-2, the merit of quenching coupler does not appear remarkably because of light fastness of coupler itself being excellent, and the heat fastness is lower than that of YC-1, thereby leading the total effect to prevent fading being insufficiently.

On the other hand, the improvement of light fastness of the coupler of formula (Y-I), (Y-II), or (Y-III) has been required because the light fastness of the coupler itself is not good, although the wet-and-heat fastness and heat fastness are excellent and the activity is high.

When a quenching coupler is added to the coupler of formula (Y-I), (Y-II), or (Y-III), the improvement ratio of light fastness is remarkably higher than when the quenching coupler is added to the Comparative coupler, and the synthetic fastness including light fastness, wet-and-heat fastness, and heat fastness is improved so much compared with the samples that used the Comparative coupler.

EXAMPLE 2

Samples 201 to 209 were prepared in the same manner as in Example 1, except that, in the first layer (Blue-sensitive emulsion layer), $Y_1$-28 was used as ExY, and IC-7 was used as ExQ, respectively, and the coating amount of IC-7 was changed as shown in Table 2.

Dm and the light fastness of each sample were evaluated in the same manner as in Example 1, and the results are shown in Table 2.

TABLE 2

| Sample No. | Yellow coupler ExY | Quenching Coupler ExQ | Quenching Coupler Coating amount (mmol/m$^2$) | Dm | Light fastness (%) | Remarks |
|---|---|---|---|---|---|---|
| 201 | $Y_1$-28 | IC-7 | 0 | 1.50 | 38 | Comparative example |
| 202 | " | " | $5 \times 10^{-3}$ | 1.50 | 78 | This invention |
| 203 | " | " | 0.01 | 1.51 | 86 | This invention (preferable) |
| 204 | " | " | 0.02 | 1.50 | 89 | This invention (most preferable) |
| 205 | " | " | 0.10 | 1.51 | 91 | This invention (most preferable) |
| 206 | " | " | 0.15 | 1.48 | 92 | This invention (most preferable) |
| 207 | " | " | 0.20 | 1.45 | 91 | This invention (most preferable) |
| 208 | " | " | 0.25 | 1.42 | 92 | This invention (preferable) |
| 209 | " | " | 0.50 | 1.20 | 93 | Comparative example |

As is apparent from the results in Table 2, the light fastness is improved by adding a quenching coupler to the coupler of formula (Y-I), (Y-II), or (Y-III), and the light fastness is improved most largely when the quenching coupler is added in an amount of 2% or more per mol of the yellow coupler.

On the other hand, when the amount of the quenching coupler to be added exceeds 25% per mol of the yellow coupler, Dm measured in blue light is decreased remarkably, and further a problem of color-mixing on color reproduction and the like occur.

EXAMPLE 3

Samples 301 to 314 were prepared in the same manner as in Example 1, except that quenching dye (synthesized by coupling a quenching coupler with the oxidized product of a developing agent), shown in Table 3, was used in equimolar instead of the quenching coupler in combination with yellow coupler shown in Table 3, the light fastness of each sample was tested. Results are shown in Table 3.

In Table 3, for example, the quenching dye ExD is represented by IC-7/A-1 which means a dye synthesized by the quenching coupler IC-1 and the oxidized product of developing agent A-1.

TABLE 3

| Sample No. | Yellow coupler ExY | Quenching dye ExD | Dm | Light fastness (%) | Wet-and-heat fastness (%) | Heat fastness (%) | Remarks |
|---|---|---|---|---|---|---|---|
| 301 | YC-1 | IC-7/A-1 | 1.72 | 73 | 71 | 88 | Comparative example |
| 302 | $Y_1$-28 | IC-7/A-1 | 1.68 | 92 | 90 | 94 | This invention |
| 303 | " | IC-7/A-2 | 1.65 | 91 | 89 | 95 | " |
| 304 | " | IC-7/A-3 | 1.69 | 89 | 89 | 94 | " |
| 305 | " | IC-7/A-4 | 1.71 | 88 | 91 | 95 | " |
| 306 | " | IIIC-26/A-1 | 1.64 | 89 | 90 | 95 | " |
| 307 | " | M-33/A-1 | 1.62 | 86 | 89 | 94 | " |
| 308 | $Y_1$-30 | IC-7/A-2 | 1.65 | 90 | 90 | 95 | " |
| 309 | $Y_1$-24 | IC-7/A-2 | 1.87 | 92 | 77 | 92 | " |
| 310 | $Y_2$-15 | IC-7/A-1 | 1.99 | 93 | 92 | 97 | " |
| 311 | " | IC-7/A-2 | 1.97 | 91 | 90 | 96 | " |
| 312 | " | m-1/A-2 | 2.02 | 86 | 89 | 96 | " |
| 313 | $Y_2$-47 | IC-7/A-1 | 1.95 | 91 | 95 | 97 | " |
| 314 | " | IC-7/A-2 | 1.94 | 90 | 94 | 96 | " |

As is apparent from the results in Table 3, when a quenching dye is added instead of the quenching coupler, the light fastness is similarly improved, and the image-dye fastness in total is improved by adding a quenching dye to the coupler of formula (Y-I), (Y-II), or (Y-III).

EXAMPLE 4

Samples 401 to 409 were prepared in the same manner as Example 1, except that ExY was divided into ExY-a and ExY-b and was added as shown in Table 4, provided that IC-7 was used as ExQ.

ExY-a 0.70

ExY-b 0.30

The figure represents coating amount designated by mmol/m$^2$.

Samples were processed in the same manner as in Example 1, and tested heat fastness, wet-and-heat fastness, and heat fastness. Results are shown in Table 4.

TABLE 4

| Sample No. | ExY-a | ExY-b | Light fastness (%) | Wet-and-heat fastness (%) | Heat fastness (%) | Remarks |
|---|---|---|---|---|---|---|
| 401 | YC-1 | YC-1 | 71 | 70 | 90 | Comparative example |
| 402 | " | $Y_1$-5 | 81 | 75 | 92 | This Invention |
| 403 | " | $Y_1$-28 | 83 | 78 | 93 | " |
| 404 | " | $Y_2$-15 | 84 | 81 | 95 | " |
| 405 | $Y_1$-5 | YC-1 | 86 | 83 | 94 | " |
| 406 | $Y_1$-28 | " | 88 | 85 | 95 | " |
| 407 | $Y_2$-15 | " | 87 | 86 | 96 | " |
| 408 | $Y_1$-5 | $Y_1$-28 | 91 | 89 | 92 | " |
| 409 | " | $Y_2$-15 | 90 | 93 | 96 | " |

As is apparent from the results in Table 3, although light fastness and wet-and-heat fastness are as low as insufficient by using only a quenching coupler, light fastness and wet-and-heat fastness, in particular light fastness are largely improved in a system including the coupler of formula (Y-I), (Y-II), or (Y-III).

EXAMPLE 5

A multilayer color photographic material (Sample 501) having layer-compositions described below was prepared by coating on a triacetate cellulose film base.

Composition of Layers

Figures represent coating amounts, in g/m$^2$ of Ag as regards silver halide and colloidal silver, in g/m$^2$ as regards coupler, additive, and casein, and in mol per mol of silver halide in same layer as regards sensitizing dye. The abbreviations representing additives have each meaning shown below. But, for multiple functions were represented by one of them.

UV: Ultraviolet ray absorber, Solv: High-boiling organic solvent, ExF: Dye, ExS: Sensitizing dye, ExC: Cyan coupler, ExM: Magenta coupler, ExY: Yellow coupler, Cpd: Additive.

| | | |
|---|---|---|
| First layer (Halation preventing layer) | | |
| Black colloidal silver | | 0.15 |
| Gelatin | | 2.33 |
| ExM-2 | | 0.11 |
| UV-1 | | $3.0 \times 10^{-2}$ |
| UV-2 | | $6.0 \times 10^{-2}$ |
| UV-3 | | $7.0 \times 10^{-2}$ |
| Solv-1 | | 0.16 |
| Solv-2 | | 0.10 |
| ExF-1 | | $1.0 \times 10^{-2}$ |
| ExF-2 | | $4.0 \times 10^{-2}$ |
| ExF-3 | | $5.0 \times 10^{-3}$ |
| Cpd-6 | | $1.0 \times 10^{-3}$ |
| Second layer (Low sensitivity red-sensitive emulsion layer) | | |
| Silver iodobromide emulsion (AgI: 4.0 mol %, uniform AgI content-type, diameter corresponding to a sphere: 0.4 μm, deviation coefficient of diameter corresponding to a sphere: 30%, tabular grains, diameter/thickness ratio: 3.0) | silver | 0.35 |
| Silver iodobromide emulsion (AgI: 6.0 mol %, higher AgI content at the inner part of core/shell ratio: 1/2, diameter corresponding to a sphere: 0.45 μm, deviation coefficient of diameter corresponding to a sphere: 23%, tabular grains, diameter/thickness ratio: 2.0) | silver | 0.18 |
| Gelatin | | 0.77 |
| ExS-1 | | $2.4 \times 10^{-4}$ |
| ExS-2 | | $1.4 \times 10^{-4}$ |
| ExS-5 | | $2.3 \times 10^{-4}$ |
| ExS-7 | | $4.1 \times 10^{-6}$ |
| ExC-1 | | 0.13 |
| ExC-2 | | $2.0 \times 10^{-2}$ |
| ExC-3 | | $4.0 \times 10^{-2}$ |

-continued

| | | |
|---|---|---|
| ExC-4 | | $2.0 \times 10^{-2}$ |
| ExC-5 | | 0.12 |
| ExC-6 | | $2.0 \times 10^{-2}$ |
| ExC-9 | | $1.0 \times 10^{-2}$ |

Third layer (Medium sensitivity red-sensitive emulsion layer)

Silver iodobromide emulsion (AgI: 6.0 mol %, higher AgI content at the inner part core/shell ratio: 1/2, diameter corresponding to a sphere: 0.65 μm, deviation coefficient of diameter corresponding to a sphere: 23%, tabular grains, diameter/thickness ratio: 2.0)

| | | |
|---|---|---|
| | silver | 0.80 |
| Gelatin | | 1.48 |
| ExS-1 | | $2.4 \times 10^{-4}$ |
| ExS-2 | | $1.4 \times 10^{-4}$ |
| ExS-5 | | $2.4 \times 10^{-4}$ |
| ExS-7 | | $4.3 \times 10^{-6}$ |
| ExC-1 | | 0.19 |
| ExC-2 | | $1.0 \times 10^{-2}$ |
| ExC-3 | | $2.5 \times 10^{-2}$ |
| ExC-4 | | $1.6 \times 10^{-2}$ |
| ExC-5 | | 0.19 |
| ExC-6 | | $2.0 \times 10^{-2}$ |
| ExC-7 | | $3.0 \times 10^{-2}$ |
| ExC-8 | | $1.0 \times 10^{-2}$ |
| ExC-9 | | $3.0 \times 10^{-2}$ |

Fourth layer (High sensitivity red-sensitive emulsion layer)

Silver iodobromide emulsion (AgI: 9.3 mol %, multi-structure grains of core/shell ratio of 3:4:2, AgI content: (from the core to shells) 24, 0, and 0.6 mol %, diameter corresponding to a sphere: 0.75 μm, deviation coefficient of diameter corresponding to a sphere: 23%, tabular grains, diameter/thickness ratio: 2.5)

| | | |
|---|---|---|
| | silver | 1.05 |
| Gelatin | | 1.38 |
| ExS-1 | | $2.0 \times 10^{-4}$ |
| ExS-2 | | $1.1 \times 10^{-4}$ |
| ExS-5 | | $1.9 \times 10^{-4}$ |
| ExS-7 | | $1.4 \times 10^{-5}$ |
| ExC-1 | | $8.0 \times 10^{-2}$ |
| ExC-4 | | $9.0 \times 10^{-2}$ |
| ExC-6 | | $2.0 \times 10^{-2}$ |
| ExC-9 | | $1.0 \times 10^{-2}$ |
| Solv-1 | | 0.20 |
| Solv-2 | | 0.53 |

Fifth layer (Intermediate layer)

| | | |
|---|---|---|
| Gelatin | | 0.62 |
| Cpd-1 | | 0.13 |
| Polyethylacrylate latex | | $8.0 \times 10^{-2}$ |
| Solv-1 | | $8.0 \times 10^{-2}$ |

Sixth layer (Low sensitivity green-sensitive emulsion layer)

Silver iodobromide emulsion (AgI: 4.0 mol %, uniform AgI content-type, diameter corresponding to a sphere: 0.45 μm, deviation coefficient of diameter corresponding to a sphere: 15%, tabular grains, diameter/thickness ratio: 4.0)

| | | |
|---|---|---|
| | silver | 0.13 |
| Gelatin | | 0.31 |
| ExS-3 | | $1.0 \times 10^{-4}$ |
| ExS-4 | | $3.1 \times 10^{-4}$ |
| ExS-5 | | $6.4 \times 10^{-4}$ |
| ExM-1 | | 0.12 |
| ExM-3 | | $2.1 \times 10^{-2}$ |
| Solv-1 | | 0.09 |
| Solv-4 | | $7.0 \times 10^{-3}$ |

Seventh layer (Medium sensitivity green-sensitive emulsion layer)

Silver iodobromide emulsion (AgI: 4.0 mol %, uniform AgI content-type, diameter corresponding to a sphere: 0.65 μm, deviation coefficient of diameter corresponding to a sphere: 18%, tabular grains, diameter/thickness ratio: 4.0)

| | | |
|---|---|---|
| | silver | 0.31 |
| Gelatin | | 0.54 |
| ExS-3 | | $2.7 \times 10^{-4}$ |
| ExS-4 | | $8.2 \times 10^{-4}$ |
| ExS-5 | | $1.7 \times 10^{-4}$ |
| ExM-1 | | 0.27 |
| ExM-3 | | $7.2 \times 10^{-2}$ |
| ExY-1 | | $5.4 \times 10^{-2}$ |
| Solv-1 | | 0.23 |
| Solv-4 | | $1.8 \times 10^{-2}$ |

Eighth layer (High sensitivity green-sensitive emulsion layer)

Silver iodobromide emulsion (AgI: 9.8 mol %, multi-structure grains of core/shell ratio of 3:4:2, AgI content: (from the core to shells) 24, 0, and 3 mol %, diameter corresponding to a sphere: 0.81 μm, deviation coefficient of diameter corresponding to a sphere: 23%, multi twins crystal tabular grains, diameter/thickness ratio: 2.5)

| | | |
|---|---|---|
| | silver | 0.49 |
| Gelatin | | 0.61 |
| ExS-4 | | $4.3 \times 10^{-4}$ |
| ExS-5 | | $8.6 \times 10^{-5}$ |
| ExS-8 | | $2.8 \times 10^{-5}$ |
| ExM-2 | | $1.0 \times 10^{-2}$ |
| ExM-5 | | $1.0 \times 10^{-2}$ |
| ExM-6 | | $3.0 \times 10^{-2}$ |
| ExY-1 | | $1.5 \times 10^{-2}$ |
| ExC-1 | | $0.4 \times 10^{-2}$ |
| ExC-4 | | $2.5 \times 10^{-3}$ |
| ExC-6 | | $0.5 \times 10^{-2}$ |
| Solv-1 | | 0.12 |
| Cpd-8 | | $1.0 \times 10^{-2}$ |

Ninth layer (Intermediate layer)

| | | |
|---|---|---|
| Gelatin | | 0.56 |
| Cpd-1 | | $4.0 \times 10^{-2}$ |
| Poly(ethyl acrylate) latex | | $5.0 \times 10^{-2}$ |
| Solv-1 | | $3.0 \times 10^{-2}$ |
| UV-4 | | $3.0 \times 10^{-2}$ |
| UV-5 | | $4.0 \times 10^{-2}$ |

Tenth layer (Donor layer of double layer effect for red-sensitive emulsion layer)

Silver iodobromide emulsion (AgI: 8.0 mol %, higher AgI content at the inner part core/shell ratio: 1/2, diameter corresponding to a sphere: 0.72 μm, deviation coefficient of diameter corresponding to a sphere: 28%, multilayer twins tabular grains, diameter/thickness ratio: 2.0)

| | | |
|---|---|---|
| | silver | 0.67 |

Silver iodobromide emulsion (AgI: 10.0 mol %, higher AgI content at the inner part of core/shell ratio: 1/3, diameter corresponding to a sphere: 0.40 μm, deviation coefficient of diameter corresponding to a sphere: 15%, crystal grains)

| | | |
|---|---|---|
| | silver | 0.20 |
| Gelatin | | 0.87 |
| ExS-3 | | $6.7 \times 10^{-4}$ |
| ExM-4 | | 0.06 |
| ExM-8 | | 0.10 |
| Solv-1 | | 0.30 |
| Solv-6 | | $3.0 \times 10^{-2}$ |

Eleventh layer (Yellow filter layer)

| | | |
|---|---|---|
| Yellow colloidal silver | | $9.0 \times 10^{-2}$ |
| Gelatin | | 0.84 |
| Cpd-2 | | 0.13 |
| Solv-1 | | 0.13 |
| Cpd-1 | | $5.0 \times 10^{-2}$ |
| Cpd-6 | | $2.0 \times 10^{-3}$ |
| H-1 | | 0.25 |

Twelfth layer (Low sensitivity blue-sensitive emulsion layer)

Silver iodobromide emulsion (AgI: 9.0 mol %, multilayer structure grains, diameter corresponding to a sphere: 0.70 μm, deviation coefficient of diameter corresponding to a sphere: 20%, tabular grains, diameter/thickness ratio: 7.0, grains having rearrangement lines of 10 or more observed by 200 kv transmission electron -continued

| | | |
|---|---|---|
| microscope were contained 50% or more of total grains) | | |
| | silver | 0.50 |
| Silver iodobromide emulsion (AgI: 2.5 mol %, uniform AgI content-type, diameter corresponding to a sphere: 0.50 μm, deviation coefficient of diameter corresponding to a sphere: 30%, tabular grains, diameter/thickness ratio: 6.0) | | |
| | silver | 0.30 |
| Gelatin | | 2.18 |
| ExS-6 | | $9.0 \times 10^{-4}$ |
| IC-7 | | 0.05 |
| YC-1 | | 1.09 |
| ExY-2 | | 0.10 |
| Solv-1 | | 0.55 |
| Thirteenth layer (Intermediate layer) | | |
| Gelatin | | 0.30 |
| ExY-3 | | 0.14 |
| Solv-1 | | 0.14 |
| Fourteenth layer (High sensitivity blue-sensitive emulsion layer) | | |
| Silver iodobromide emulsion (AgI: 10.0 mol %, higher AgI content at the inner part, diameter corresponding to a sphere: 1.2 μm, deviation coefficient of diameter corresponding to a sphere: 25%, multilayer twins tabular grains, diameter/thickness ratio: 2.0) | | |
| | silver | 0.40 |
| Gelatin | | 0.59 |
| ExS-6 | | $2.6 \times 10^{-4}$ |
| YC-1 | | 0.20 |
| ExY-2 | | $1.0 \times 10^{-2}$ |
| IC-7 | | $1.0 \times 10^{-2}$ |
| Solv-1 | | 0.10 |
| Fifteenth layer (First protective layer) | | |
| Fine grain silver iodobromide emulsion (AgI: 2.0 mol %, uniform AgI content-type, diameter corresponding to a sphere: 0.07 μm) | | |
| | silver | 0.12 |
| Gelatin | | 0.63 |
| UV-4 | | 0.11 |
| UV-5 | | 0.18 |
| Solv-5 | | $2.0 \times 10^{-2}$ |
| Cpd-5 | | 0.10 |
| Poly(ethyl acrylate) latex | | $9.0 \times 10^{-2}$ |
| Sixteenth layer (Second protective layer) | | |
| Fine grain silver iodobromide emulsion (AgI: 2.0 mol %, uniform AgI content-type, diameter corresponding to a sphere: 0.07 μm) | | |
| | silver | 0.36 |
| Gelatin | | 0.85 |
| B-1 (diameter: 2.0 μm) | | $8.0 \times 10^{-2}$ |
| B-2 (diameter: 2.0 μm | | $8.0 \times 10^{-2}$ |
| B-3 | | $2.0 \times 10^{-2}$ |
| W-4 | | $2.0 \times 10^{-2}$ |
| H-1 | | 0.18 |

In the thus prepared samples, besides above-described components, 1,2-benzisothiazoline-3-one (average amounts of 200 ppm to gelatin), n-butyl-p-hydroxybenzoate (average amounts of ca. 1,000 ppm), and 2-phenoxy ethanol (average amounts of ca. 10,000 ppm) were added. Further, B-4, B-5, F-1, F-2, F-3, F-4, F-5, F-6, F-7, F-8, F-9, F10, F-11, F-12, and salts of iron, lead, gold, platinum, iridium, and rhodium were contained.

In each layer, surface-active agents W-1, W-2, and W-3 were added as coating aids or emulsion dispersing agent

UV-1

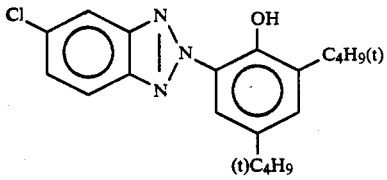

UV-2

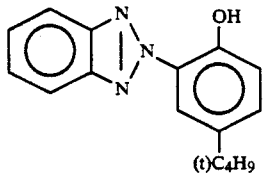

UV-3

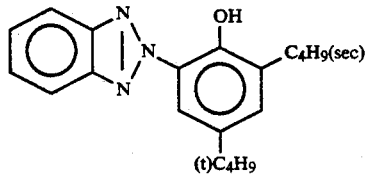

UV-4

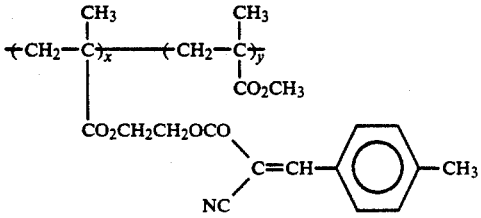

x:y = 70:30 (wt %)

-continued
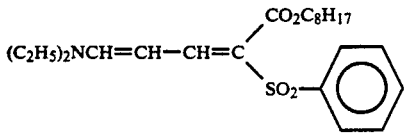
UV-5
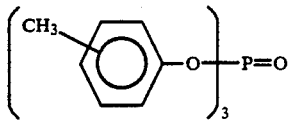
Solv-1
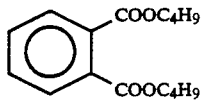
Solv-2
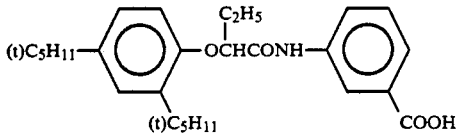
Solv-4
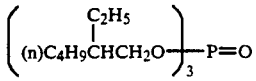
Solv-5
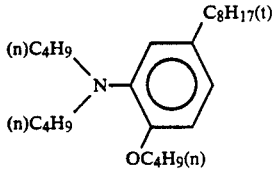
Solv-6
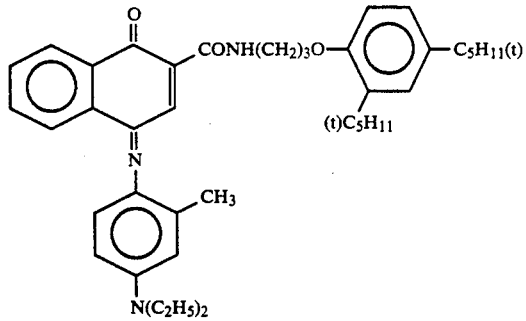
ExF-1
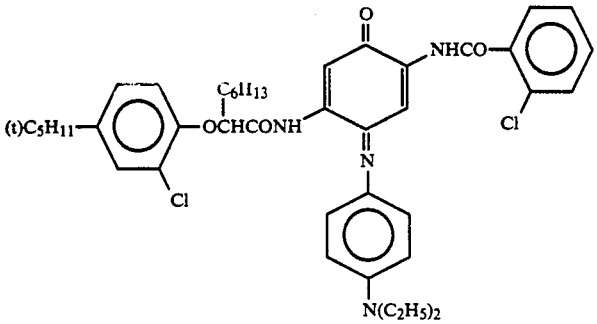
ExF-2

-continued
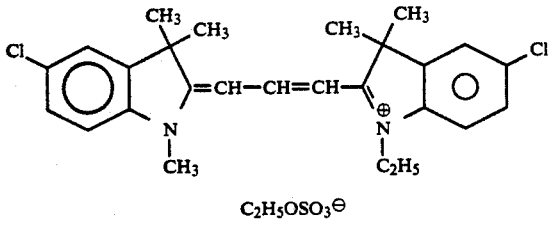
ExF-3
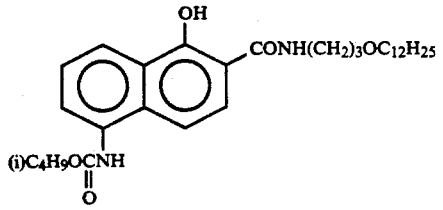
ExC-1
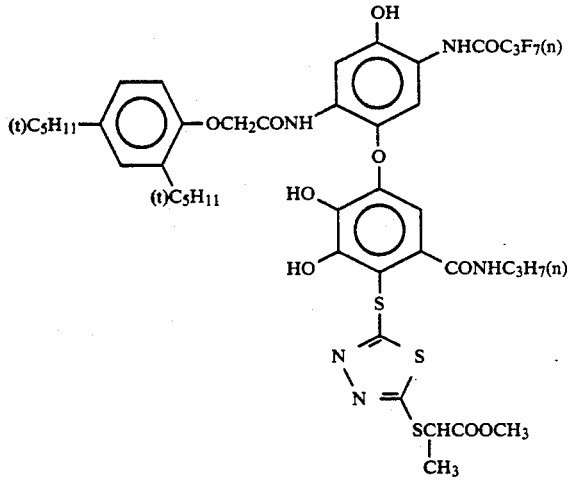
ExC-2
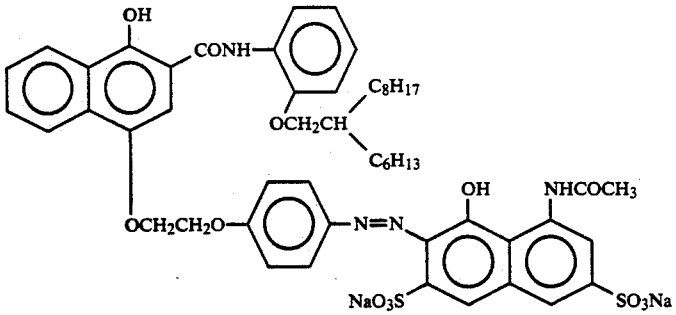
ExC-3
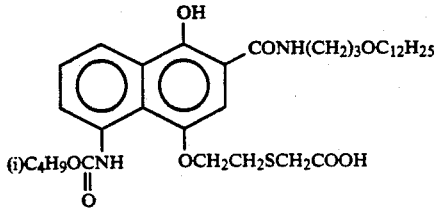
ExC-4

-continued
ExC-5
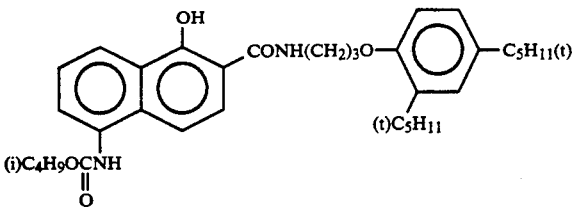
ExC-6
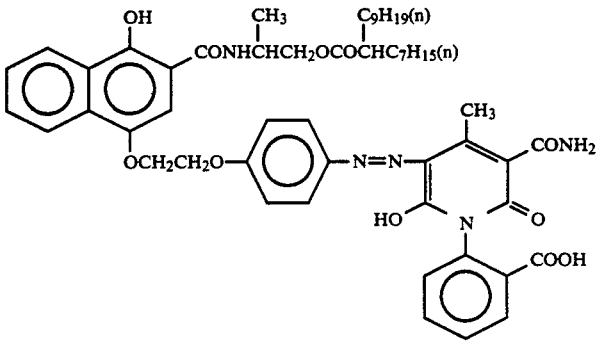
ExC-7
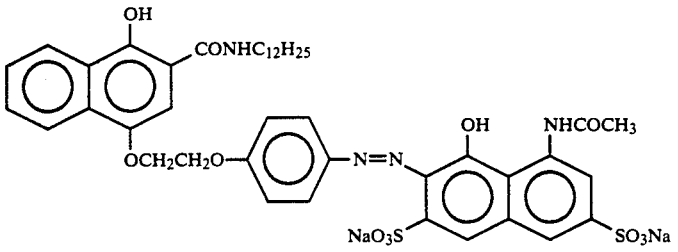
ExC-8
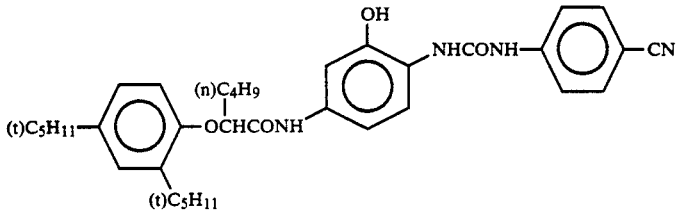
ExC-9
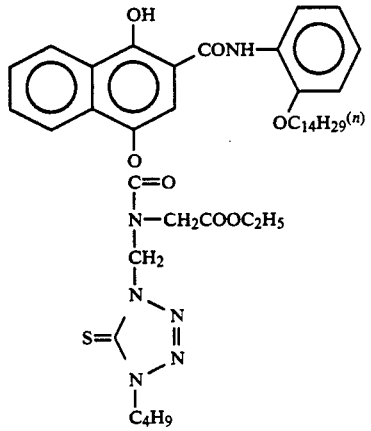

-continued
ExM-1
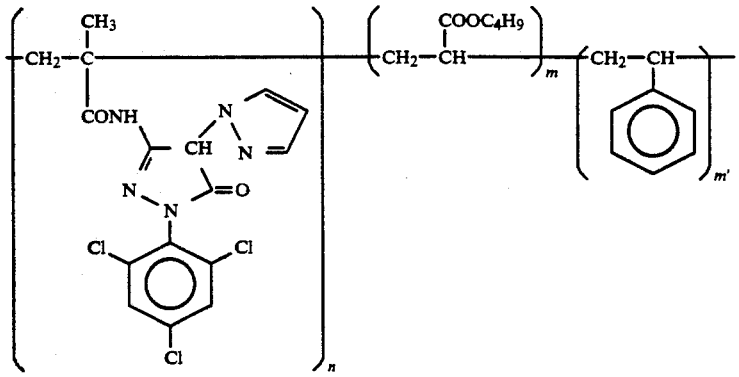
n = 50
m = 25
m' = 25
mol. wt. ca 20,000
ExM-2
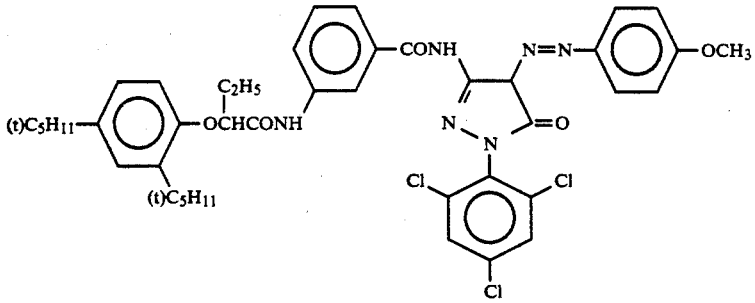
ExM-3
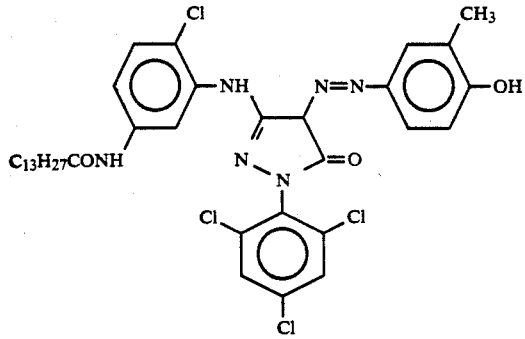
ExM-4
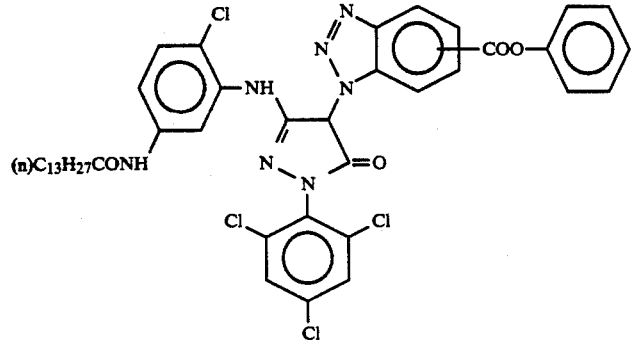

-continued
ExM-5
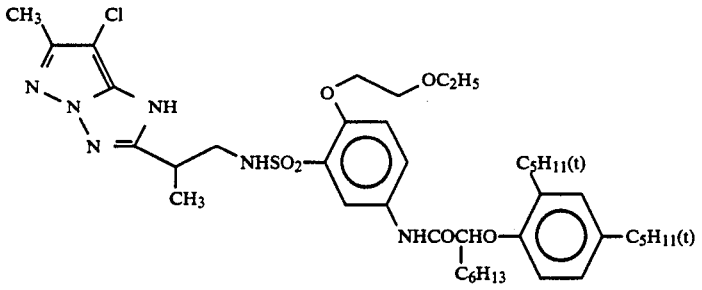
ExM-6
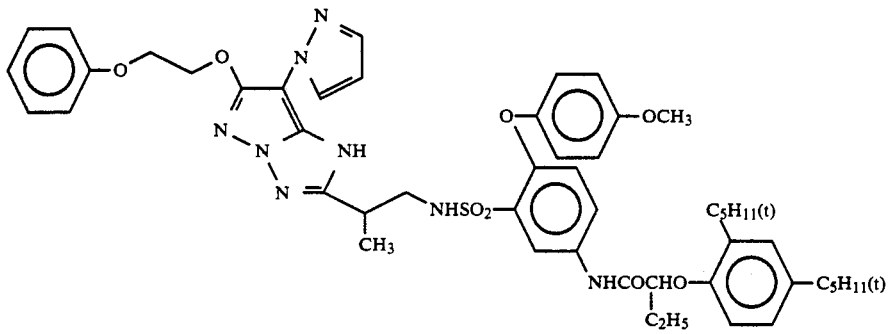
ExM-7
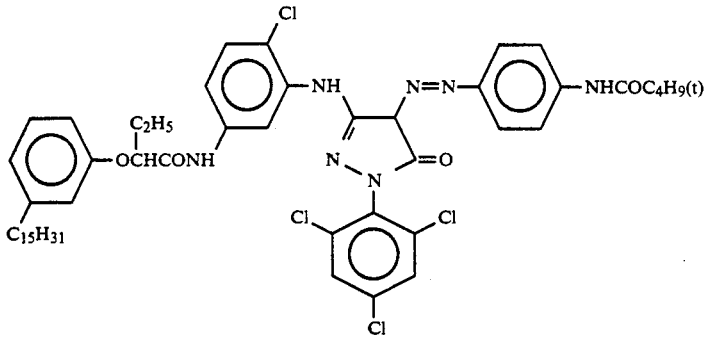
ExM-8
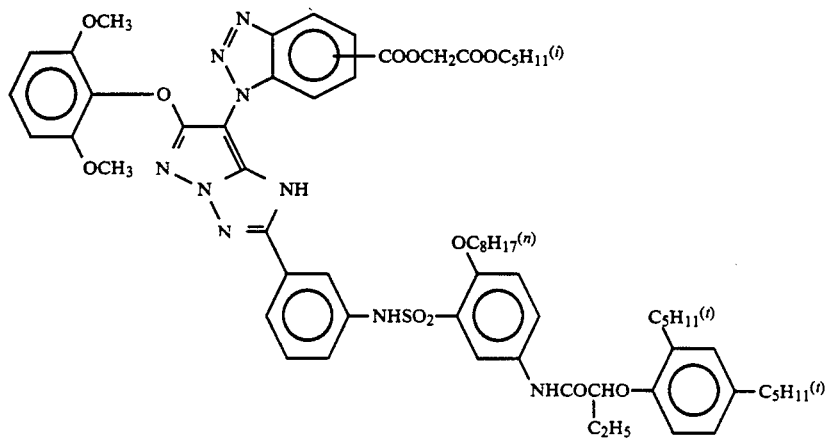

-continued
ExY-1
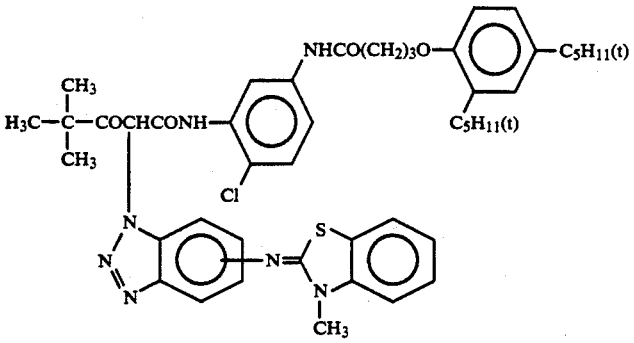
ExY-2
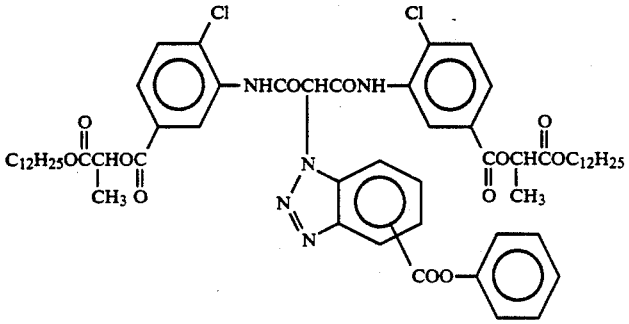
ExY-3
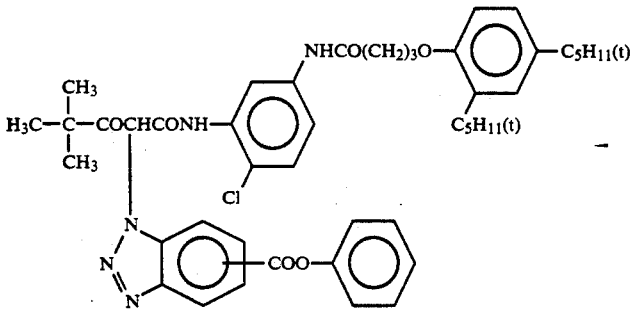
Cpd-1
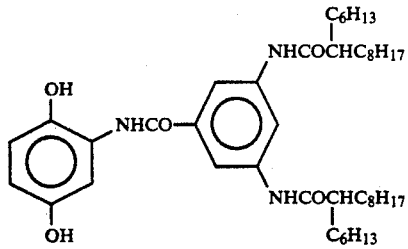
Cpd-2
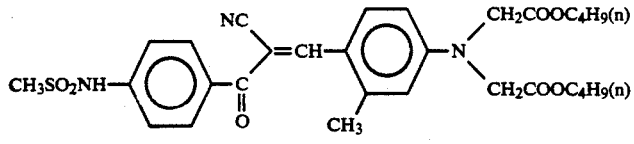
Cpd-5
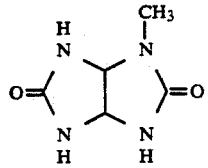

-continued
Cpd-6
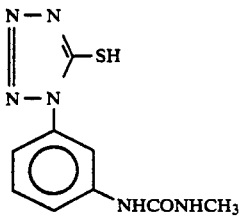
Cpd-8
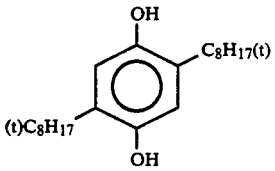
H-1
$CH_2{=}CH{-}SO_2{-}CH_2{-}CONH{-}CH_2$
$CH_2{=}CH{-}SO_2{-}CH_2{-}CONH{-}CH_2$
W-1
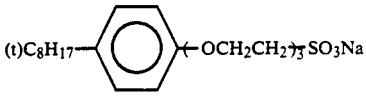
W-2
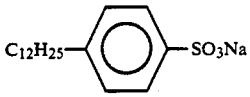
W-3
$(n)C_4H_9CH(C_2H_5)CH_2COOCH_2$
$(n)C_4H_9CH(C_2H_5)CH_2COOCH(SO_3Na)$
W-4
$C_8F_{17}SO_2N(C_3H_7)CH_2COOK$
ExS-1
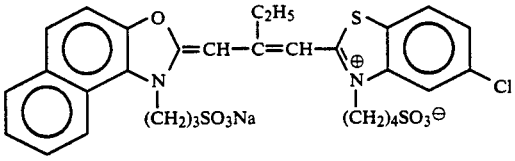
ExS-2
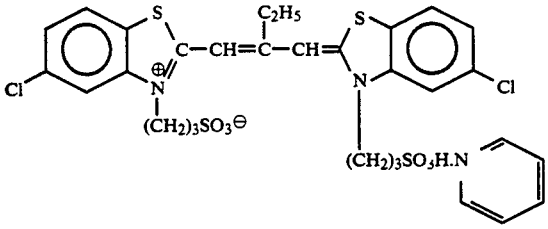
ExS-3
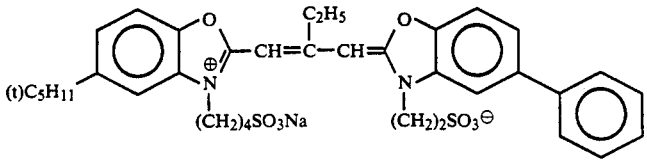

-continued
ExS-4
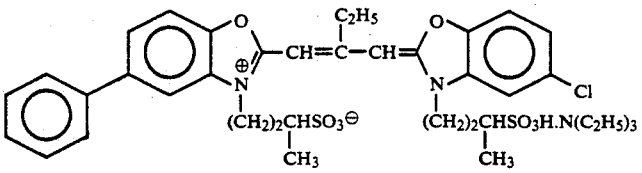
ExS-5
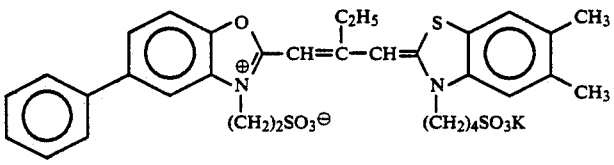
ExS-6
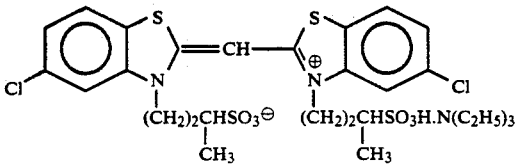
ExS-7
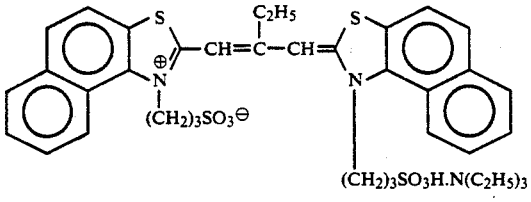
ExS-8
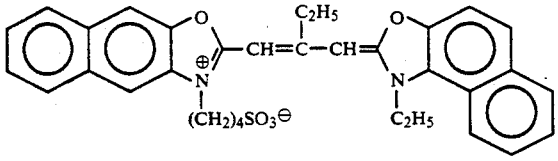
F-1
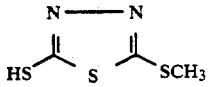
F-2
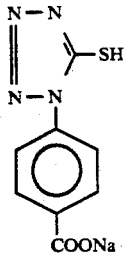
F-3
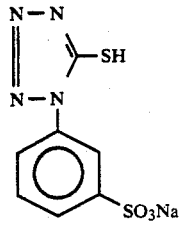

-continued
F-4
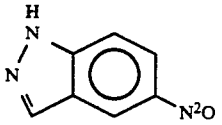
F-5
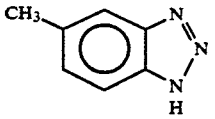
F-6
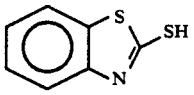
F-7
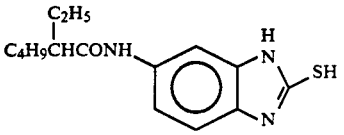
F-8
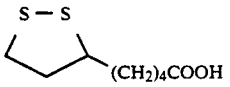
F-9
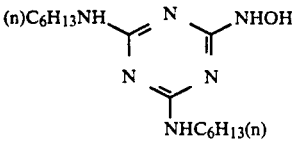
F-10
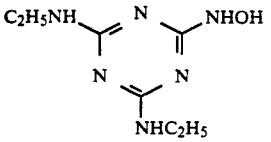
F-11
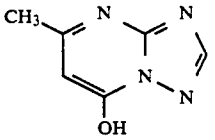
F-12
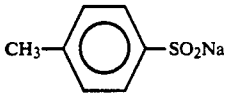
B-1
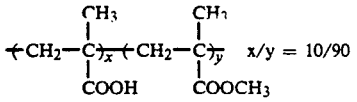
x/y = 10/90
B-2
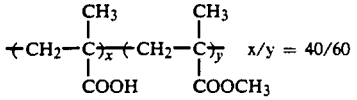
x/y = 40/60

-continued

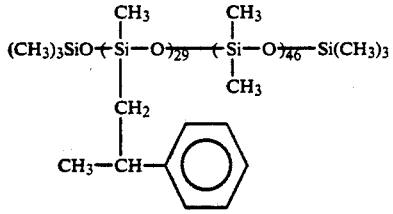

B-3

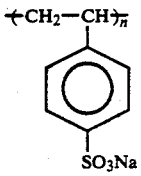

B-4

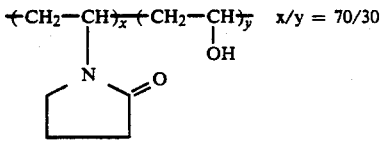

x/y = 70/30

B-5

Samples 502 t 512 were prepared by changing YC-1 and quenching coupler IC-7 of Sample 501 to couplers shown in Table 7 respectively in equimolar amount.

The above prepared samples were processed according to the processing process shown below, after imagewise exposure to light through an optical wedge.

| | Processing process | | | |
|---|---|---|---|---|
| Processing step | Time | Temperature | Replenisher* | Tank Volume |
| Color developing | 3 min 15 sec | 37.8° C. | 25 ml | 10 liter |
| Bleaching | 45 sec | 38.0° C. | 5 ml | 5 liter |
| Fixing (1) | 45 sec | 38.0° C. | — | 5 liter |
| Fixing (2) | 45 sec | 38.0° C. | 30 ml | 5 liter |
| Stabilizing (1) | 20 sec | 38.0° C. | — | 5 liter |
| Stabilizing (2) | 20 sec | 38.0° C. | — | 5 liter |
| Stabilizing (3) | 20 sec | 38.0° C. | 40 ml | 5 liter |
| Drying | 1 min | 55° C. | | |

Note. *Replenisher amount: ml per $m^2$ of photographic material. (Fixing steps: counter-current flow system from the tank (2) to the tank (1), Stabilizing steps: counter-current flow system from the tank of (3) towards the tank of (1))

The amount of color developer carried over into the bleaching process and the amount of fixing solution carried over into the stabilizing process are 2.5 ml and 2.0 ml, per meter of length and 35 mm of width of photographic material, respectively.

The compositions of each processing solution were as follows:

| | Mother Solution | Replenisher |
|---|---|---|
| (Color developer) | | |
| Diethylenetriaminepentaacetate | 5.0 g | 6.0 g |
| Sodium sulfite | 4.0 g | 5.0 g |
| Potassium carbonate | 30.0 g | 37.0 g |
| Potassium bromide | 1.3 g | 0.5 g |
| Potassium iodide | 1.2 mg | — |
| Hydroxylamine sulfate | 2.0 g | 3.6 g |
| 4-(N-ethyl-N-β-hydroxyethylamino)-2-methylaniline sulfonate | 4.7 g | 6.2 g |
| Water to make | 1000 ml | 1000 ml |
| pH | 10.00 | 10.15 |
| (Bleaching solution) | | |
| Fe(III) ammonium 1,3-diaminopropanetraacetate monohydrate | 144.0 g | 206.0 g |
| 1,3-Diaminopropanetetraacetic acid | 2.8 g | 4.0 g |
| Ammonium bromide | 84.0 g | 120.0 g |
| Ammonium nitrate | 17.5 g | 25.0 g |
| Aqueous ammonia (27%) | 10.0 g | 1.8 g |
| Acetic acid (98%) | 51.1 g | 73.0 g |
| Water to make | 1000 ml | 1000 ml |
| pH | 4.3 | 3.4 |
| (Fixing solution) (Both mother solution and replenisher) | | |
| Disodium ethylenediaminetetraacetate | 1.7 g | |
| Sodium sulfite | 14.0 g | |
| Sodium bisulfite | 10.0 g | |
| Ammonium thiosulfate (70% w/v) | 210.0 ml | |
| Ammonium thiocyanate | 163.0 g | |
| Thiourea | 1.8 g | |
| Water to make | 1000 ml | |
| pH | 6.5 | |
| (Stabilizing solution) (Both tank solution and replenisher) | | |
| Surface-active agent $[C_{10}H_{21}-O-(CH_2CH_2O)_{10}H]$ | 0.5 g | |
| Triethanolamine | 2.0 g | |
| 1,2-Benzisothiazoline-3-one methanol | 0.3 g | |
| Formalin (37%) | 1.5 g | |
| Water to make | 1000 ml | |
| pH | 6.5 | |

After processing, each sample was determined for light fastness, wet-and-heat fastness, and heat fastness by the same methods as in Example 1.

Results are shown in Table 5.

TABLE 5

| Sample No. | Yellow coupler | Quenching coupler (quenching dye) | Light fastness (%) | Wet-and-heat fastness (%) | Heat fastness (%) | Remarks |
|---|---|---|---|---|---|---|
| 501 | YC-1 | IC-7 | 68 | 74 | 93 | Comparative example |
| 502 | " | — | 54 | 76 | 91 | Comparative example |
| 503 | $Y_1$-5 | — | 38 | 90 | 92 | Comparative example |

TABLE 5-continued

| Sample No. | Yellow coupler | Quenching coupler (quenching dye) | Light fastness (%) | Wet-and-heat fastness (%) | Heat fastness (%) | Remarks |
|---|---|---|---|---|---|---|
| 504 | " | IC-7 | 88 | 89 | 91 | This invention |
| 505 | " | IIC-3 | 84 | 87 | 92 | This invention |
| 506 | " | IIIC-26 | 85 | 89 | 92 | This invention |
| 507 | " | M-33 | 78 | 89 | 91 | This invention |
| 508 | $Y_1$-28 | — | 40 | 90 | 94 | Comparative example |
| 509 | " | IC-7 | 91 | 92 | 92 | This invention |
| 510 | $Y_2$-15 | — | 65 | 93 | 95 | Comparative example |
| 511 | " | IC-7 | 89 | 94 | 96 | This invention |
| 512 | " | IC-7/A-1 | 91 | 93 | 96 | This invention |

As in apparent from the results in Table 5, in a multi-layer color photographic material, the light fastness is remarkably improved by adding a quenching coupler and/or a quenching dye, as similar to a mono-layer color photographic material. Samples of the present invention is apparently excellent in fastness of image dye in total compared with Comparative Samples.

EXAMPLE 6

Samples 601 to 610 were prepared in the same manner as Sample 501 in Example 5, except that YC-1 and IC-7 in the 12th layer were changed to ExY-a' and ExQ-a', respectively, and YC-1 and IC-7 in the 14th layer were changed to ExY-b' and ExQ-b', respectively, so as to each compound is to be equimolar to coupler shown in Table 6.

Each sample was processed in the same manner as in Example 5, and then determined its light fastness, wet-and-heat fastness, and heat fastness. Results are shown in Table 6.

TABLE 6

| Sample No. | ExY-a' | ExQ-a' | ExY-a' | ExQ-b' | Light fastness (%) | Wet-and-heat fastness (%) | Heat fastness (%) | Remarks |
|---|---|---|---|---|---|---|---|---|
| 601 | YC-1 | — | YC-1 | — | 54 | 76 | 91 | Comparative example |
| 602 | " | — | $Y_1$-5 | — | 45 | 79 | 92 | " |
| 603 | " | IC-7 | " | — | 51 | 80 | 90 | " |
| 604 | " | — | " | IC-7 | 78 | 78 | 91 | This Invention |
| 605 | " | IC-7 | " | " | 84 | 81 | 91 | " |
| 606 | $Y_1$-5 | " | YC-1 | " | 80 | 87 | 90 | " |
| 607 | " | " | $Y_1$-28 | — | 62 | 90 | 91 | " |
| 608 | " | — | " | IC-7 | 71 | 91 | 91 | " |
| 609 | " | IC-7 | " | " | 90 | 89 | 92 | " |
| 610 | $Y_1$-28 | " | $Y_2$-15 | " | 89 | 93 | 94 | " |

As is apparent from the results in Table 6, the light fastness is fairly improved by containing the coupler of formula (Y-I), (Y-II), or (Y-III) and quenching coupler IC-7 in at least one layer, and, particularly, the light fastness is remarkably improved by containing the coupler of formula (Y-I}, (Y-II), or (Y-III) and quenching coupler in a high sensitivity blue-sensitive emulsion layer.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic material having at least one photosensitive silver halide emulsion layer on a support, which comprises, in said photosensitive silver halide emulsion layer, at least one coupler selected from the group consisting of acylacetamide series yellow dye-forming couplers represented by the following formula (Y-I) and yellow dye-forming couplers represented by the following formula (Y-II) or (Y-III); and at least one coupler selected from the group consisting of dye-forming couplers represented by the following formula (C-I), (C-II), (C-III), (M), or (m):

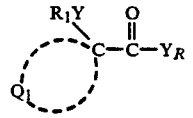

formula (Y-I)

wherein $R_1^Y$ represents a monovalent group, $Q_1$ represents a group of non-metallic atoms to form together with the C a substituted or unsubstituted 3- to 5-membered hydrocarbon ring or a substituted or unsubstituted 3- to 5-membered heterocyclic ring moiety having in the moiety at least one heteroatom selected from the group consisting of N, S, O, and P, and YR represents a residue remaining after removing the acyl group

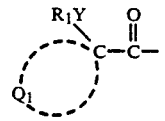

at the α position of the acetamide moiety from the acylacetamide yellow dye-forming coupler represented by formula (Y-I), provided that $R_1^Y$ is not a hydrogen atom and does not bond to $Q_1$ to form a ring,

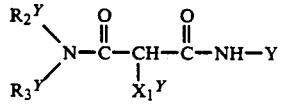

formula (Y-II)

wherein $R_2^Y$ and $R_3^Y$ each represent an alkyl group, an aryl group, or a heterocyclic group, Y represents an aryl group or a heterocyclic group, and $X_1^Y$ represents a hydrogen atom or a group capable of being released upon a coupling reaction of the coupler represented by the formula with the oxidized product of an aromatic primary amine developing agent,

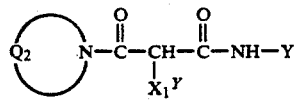

formula (Y-III)

wherein $Q_2$ represents an organic residue to form a nitrogen-containing heterocyclic group together with >N-and Y and $X_1^Y$ have the same meanings as those of Y and $X_1^Y$ of formula (Y-II),

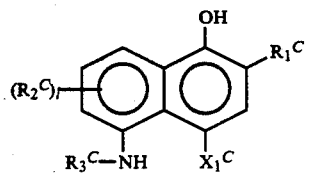

formula (C-I)

wherein $R_1^C$ represents $-CONR_4^CR_5^C$, $-SO_2NR_4^CR_5^C$, $-NHCOR_4^C$, $-NHCOOR_6^C$, $-NHSO_2R_6^C$, $-NHCONR_4^CR_5^C$, or $-NHSO_2NR_4^CR_5^C$, $R_2^C$ represents a group capable of substituting on a naphthalene group, l is an integer of 0 to 3, $R_3^C$ represents a substituent, $X_1^C$ represents a hydrogen atom or a group capable of being released upon a coupling reaction of the coupler represented by the formula with the oxidized product of developing agent, $R_4^C$ and $R_5^C$, which may be the same or different, each independently represent a hydrogen atom, an alkyl group, an aryl group, or a heterocyclic group, $R_6^C$ represents an alkyl group, an aryl group, or a heterocyclic group, when l is 2 or 3, the $R_2^C$ groups may be the same or different and may bond together to form a ring, $R_2^C$ and $R_3^C$ or $R_3^C$ and $X_1^C$ may bond together to form a ring, and the compound may form a dimer or more higher polymer by linking through a bivalent group or more higher polyvalent group at $R_1^C$, $R_2^C$, $R_3^C$, or $X_1^C$,

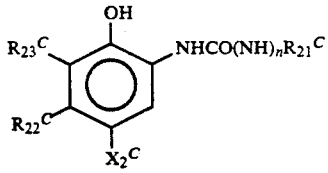

formula (C-II)

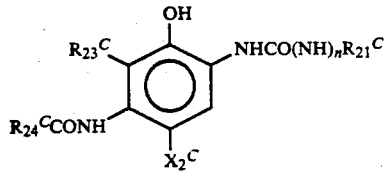

formula (C-III)

wherein $R_{21}^C$ represents an alkyl group, an aryl group, or a heterocyclic group, $R_{22}^C$ represents an alkyl group, $R_{23}^C$ represents a hydrogen atom, a halogen atom, an alkyl group, an aryl group, an alkoxy group, an aryloxy group, a carbonamido group, or a ureido group, $R_{24}^C$ represents an alkyl group, an aryl group, an alkoxy group, a heterocyclic group, an aryloxy group, or an amino group, $X_2^C$ represents a hydrogen atom or a group capable of being released upon a coupling reaction of the coupler represented by the formula with the oxidized product of developing agent, and n is 0 or 1,

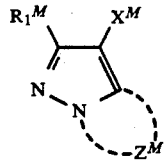

formula (M)

wherein $R_1^M$ represents a hydrogen atom or a substituent, $Z^M$ represents a group of non-metallic atoms to form a 5-membered azole ring containing 2 to 4 nitrogen atoms which may have a substituent, and $X^M$ represents a hydrogen atom or a group capable of being released upon a coupling reaction of the coupler represented by the formula with the oxidized product of developing agent,

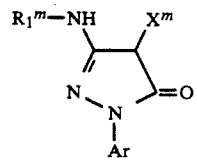

formula (m)

wherein $R_1^m$ represents an alkyl group, an aryl group, an acyl group, or a carbamoyl group, Ar represents a phenyl group or a phenyl group substituted by one or more halogen atoms or alkyl, cyano, alkoxy, alkoxycarbonyl, or acylamino groups, and $X^m$ represents a hydrogen atom or a group capable of being released upon a coupling reaction of the coupler represented by the formula with the oxidized product of developing agent.

2. A silver halide color photographic material having at least one photosensitive silver halide emulsion layer on a support, which comprises, in said silver halide emulsion layer, at least one coupler selected from the group consisting of yellow dye-forming couplers represented by the following formulas (Y-I), (Y-II), and (Y-III) and at least one dye selected from the group consisting of dyes formed by the coupling reaction of a dye-forming coupler represented by the following formula (C-I), (C-II), (C-III), (M), or (m), with the oxidized product of a developing agent represented by the following formula (A):

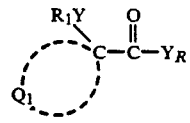

formula (Y-I)

wherein $R_1^Y$ represents a monovalent group, $Q_1$ represents a group of non-metallic atoms to form together with the C a substituted or unsubstituted 3- to 5-membered hydrocarbon ring or a substituted or unsubstituted 3- to 5-membered heterocyclic ring moiety having in the moiety at least one heteroatom selected from the group consisting of N, S, O, and P, and $Y_R$ represents a residue remaining after removing the acyl group

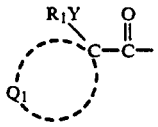

at the α position of the acetamide moiety from the acylacetamide yellow dye-forming coupler represented by formula (Y-I), provided that $R_1^Y$ is not a hydrogen atom and does not bond to $Q_1$ to form a ring,

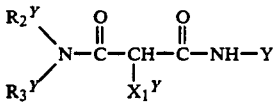

formula (Y-II)

wherein $R_2^Y$ and $R_3^Y$ each represent an alkyl group, an aryl group, or a heterocyclic group, Y represents an aryl group or a heterocyclic group, and $X_1^Y$ represents a hydrogen atom or a group capable of being released upon a coupling reaction of the coupler represented by the formula with the oxidized product of an aromatic primary amine developing agent,

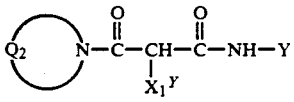

formula (Y-III)

wherein $Q_2$ represents an organic residue to form a nitrogen-containing heterocyclic group together with >N-and Y and $X_1^Y$ have the same meanings as those of Y and $X_1^Y$ of formula (Y-II),

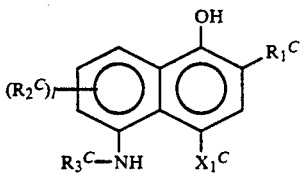

formula (C-I)

wherein $R_1^C$ represents $-CONR_4^CR_5^C$, $-SO_2NR_4^CR_5^C$, $-NHCOR_4^C$, $-NHCOOR_6^C$, $-NHSO_2R_6^C$, $-NHCONR_4^CR_5^C$, or $-NHSO_2NR_4^CR_5^C$, $R_2^C$ represents a group capable substituting on a naphthalene group, l is an integer of 0 to 3, $R_3^C$ represents a substituent, $X_1^C$ represents a hydrogen atom or a group capable of being released upon a coupling reaction of the coupler represented by the formula with the oxidized product of developing agent, $R_4^C$ and $R_5^C$, which may be the same or different, each independently represent a hydrogen atom, an alkyl group, an aryl group, or a heterocyclic group, $R_6^C$ represents an alkyl group, an aryl group, or a heterocyclic group, when l is 2 or 3, the $R_2^C$ groups may be the same or different and may bond together to form a ring, $R_2^C$ and $R_3^C$ or $R_3^C$ and $X_1^C$ may bond together to form a ring, and the compound may form a dimer or more higher polymer by linking through a bivalent group or more higher polyvalent group at $R_1^C$, $R_2^C$, $R_3^C$, or $X_1^C$,

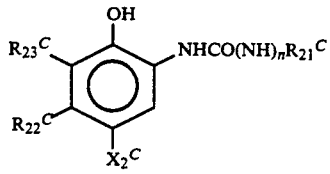

formula (C-II)

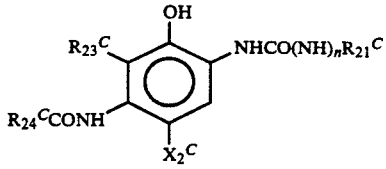

formula (C-III)

wherein $R_{21}^C$ represents an alkyl group, an aryl group, or a heterocyclic group, $R_{22}^C$ represents an alkyl group, $R_{23}^C$ represents a hydrogen atom, a halogen atom, an alkyl group, an aryl group, an alkoxy group, an aryloxy group, a carbonamido group, or a ureido group, $R_{24}^C$ represents an alkyl group, an aryl group, an alkoxy group, a heterocyclic group, an aryloxy group, or an amino group, $X_2^C$ represents a hydrogen atom or a group capable of being released upon a coupling reaction of the coupler represented by the formula with the oxidized product of developing agent, and n is 0 or 1,

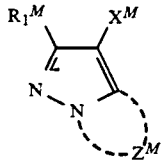

formula (M)

wherein $R_1^M$ represents a hydrogen atom or a substituent, $Z^M$ represents a group of non-metallic atoms to form a 5-membered azole ring containing 2 to 4 nitrogen atoms which may have a substituent, and $X^M$ represents a hydrogen atom or a group capable of being released upon a coupling reaction of the coupler represented by the formula with the oxidized product of developing agent,

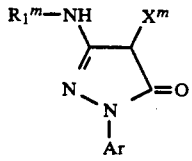

formula (m)

wherein $R_1^m$ represents an alkyl group, an aryl group, an acyl group, or a carbamoyl group, Ar represents a phenyl group or a phenyl group substituted by one or more halogen atoms or alkyl, cyano, alkoxy, alkoxycarbonyl, or acylamino groups, and $X^m$ represents a hydrogen atom or a group capable of being released upon a coupling reaction of the coupler represented by the formula with the oxidized product of developing agent,

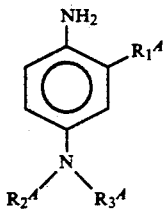

formula (A)

wherein $R_1^A$ represents a hydrogen atom or an alkyl group and $R_2^A$ and $R_3^A$, which may be the same or different, each represent a hydrogen atom, an alkyl group, an aryl group, or a heterocyclic group.

3. The silver halide color photographic material as claimed in claim 1, wherein the yellow dye-forming coupler is represented by formula (Y-I).

4. The silver halide color photographic material as claimed in claim 1, wherein the dye-forming coupler is represented by formulas (C-I) to (C-III).

5. The silver halide color photographic material as claimed in claim 4, wherein the dye-forming coupler is represented by formula (C-I).

6. The silver halide color photographic material as claimed in claim 3, wherein the acylacetamide yellow dye-forming coupler of formula (Y-I) is represented by formula (Y-IV):

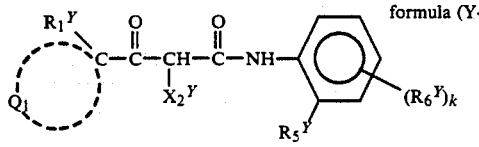

formula (Y-IV)

wherein $R_1^Y$ represents a monovalent substituent other than hydrogen; $Q_1$ represents a group of non-metallic atoms to form together with the C a substituted or unsubstituted 3- to 5-membered cyclic hydrocarbon ring or a substituted or unsubstituted 3- to 5-membered heterocyclic ring moiety that has in the group at least one heteroatom selected from a group consisting of N, O, S, and P; $R_5^Y$ represents a hydrogen atom, a halogen atom, an alkoxy group, an aryloxy group, an alkyl group, or an amino group, $R_6^Y$ represents a group capable of substitution onto a benzene ring, $X_2^Y$ represents a halogen atom or a group capable of being released upon a coupling reaction of the coupler represented by the formula with the oxidized product of developing agent, k is an integer of 0 to 4, and when k is 2 or more, the $R_6^Y$ groups may be the same or different.

7. The silver halide color photographic material as claimed in claim 6, wherein $R_1^Y$ in formula (Y-IV) is an alkyl group having a C-number of 1 to 30.

8. The silver halide color photographic material as claimed in claim 7, wherein $R_1^Y$ in formula (Y-IV) is methyl, ethyl, or n-propyl group.

9. The silver halide color photographic material as claimed in claim 6, wherein $Q_1$ represents a group of non-metallic atoms which form together with the C a 3- to 5-membered cyclic hydrocarbon ring.

10. The silver halide color photographic material as claimed in claim 6, wherein $Q_1$ represents $-[C(R)_2]_2-$ which form a 3-membered ring together with the C bonded thereto, wherein R represents a hydrogen atom, a halogen atom, or an alkyl group.

11. The silver halide color photographic material as claimed in claim 1, wherein the coupler represented by formula (C-I), (C-II), or (C-III) is used in the range of 0.01 to 0.20 of molar ratio to the yellow coupler.

12. The silver halide color photographic material as claimed in claim 1, wherein the coupler represented by formula (C-I), (C-II), or (C-III) is used in the range of 0.02 to 0.15 of molar ratio to the yellow coupler.

13. The silver halide color photographic material as claimed in claim 1, wherein the coupler represented by formula (M) or (m) is used in the range of $5\times10^{-3}$ to 0.15 of molar ratio to the yellow coupler.

14. The silver halide color photographic material as claimed in claim 2, wherein the yellow dye-forming coupler is represented by formula (Y-I).

15. The silver halide color photographic material as claimed in claim 2, wherein the dye-forming coupler is represented by formulas (C-I) to (C-III).

16. The silver halide color photographic material as claimed in claim 14, wherein the acylacetamide yellow dye-forming coupler of formula (Y-I) is represented by formula (Y-IV):

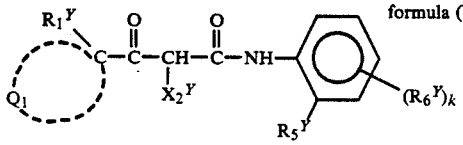

formula (Y-IV)

wherein $R_1^Y$ represents a monovalent substituent other than hydrogen; $Q_1$ represents a group of non-metallic atoms to form together with the C a substituted or unsubstituted 3- to 5-membered cyclic hydrocarbon ring or a substituted or unsubstituted 3- to 5-membered heterocyclic ring moiety that has in the group at least one heteroatom selected from a group consisting of N, O, S, and P; $R_5^Y$ represents a hydrogen atom, a halogen atom, an alkoxy group, an aryloxy group, an alkyl group, or an amino group, $R_6^Y$ represents a group capable of substitution onto a benzene ring, $X_2^Y$ represents a halogen atom or a group capable of being released upon a coupling reaction of the coupler represented by the formula with th e oxidized product of developing agent, k is an integer of 0 to 4, and when k is 2 or more, the $R_6^Y$ group may be the same or different.

17. The silver halide color photographic material as claimed in claim 2, wherein the coupler represented by formula (C-I), (C-II), or (C-III) is used in the range of 0.01 to 0.20 of molar ratio to the yellow coupler.

18. The silver halide color photographic material as claimed in claim 2, wherein the coupler represented by formula (M) or (m) is used in the range of $5\times10^{-3}$ to 0.15 of molar ratio to the yellow coupler.

19. The silver halide color photographic material as claimed in claim 1, wherein the silver halide contained in the photosensitive emulsion layer of the photographic material is silver bromoiodide or silver bromochloroiodide containing about 2 to about 10 mol. % of silver iodide.

20. The silver halide color photographic material as claimed in claim 2, wherein the silver halide contained in the photosensitive emulsion layer of the photographic material is silver bromoiodide or silver bromochloroiodide containing about 2 to about 10 mol. % of silver iodide.

21. The silver halide color photographic material as claimed in claim 1, wherein the silver halide color photographic material is a negative-type photographic material for photographing that employs a transparent support.

* * * * *